US008028486B2

(12) United States Patent
Pervan et al.

(10) Patent No.: US 8,028,486 B2
(45) Date of Patent: Oct. 4, 2011

(54) FLOOR PANEL WITH SEALING MEANS

(75) Inventors: Darko Pervan, Viken (SE); Tony Pervan, Stockholm (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 10/205,395

(22) Filed: Jul. 26, 2002

(65) Prior Publication Data

US 2003/0024199 A1 Feb. 6, 2003

Related U.S. Application Data

(60) Provisional application No. 60/313,462, filed on Aug. 21, 2001.

(30) Foreign Application Priority Data

Jul. 27, 2001 (SE) ..... 0102620

(51) Int. Cl.
*E04B 2/00* (2006.01)

(52) U.S. Cl. ..... 52/588.1; 52/390; 52/539; 52/592.2; 428/50

(58) Field of Classification Search ..... 52/592.1, 52/592.4, 589.1, 591.1, 578, 393, 597.1, 52/588.1, 582.1, 582.2, 587.1, 586.1, 586.2, 52/585.1, 390, 392, 533, 534, 539, 553, 581.1, 52/590.3, 591.2, 591.3, 591.4, 591.5, 582.4, 52/745.08, 745.19, 747.1, 747.11, 748.1, 52/748.11; 403/375, 334, 345, 364–368, 403/372, 376, 381; 428/44, 47–50, 57, 58, 428/60, 61, 106, 192–194
See application file for complete search history.

(56) References Cited

U.S. PATENT DOCUMENTS

| | | | | |
|---|---|---|---|---|
| 1,194,636 | A | 8/1916 | Joy | |
| 1,371,856 | A | 3/1921 | Cade | |
| 1,790,178 | A | 1/1931 | Sutherland, Jr. | |
| 1,809,393 | A | 6/1931 | Rockwell | |
| 1,925,068 | A | 8/1933 | Gray | |
| 1,995,264 | A | 3/1935 | Mason | |
| 2,026,511 | A | 12/1935 | Storm | |
| 2,113,076 | A | 4/1938 | Bruce | |
| 2,123,409 | A | 7/1938 | Elmendorf | |
| 2,141,708 | A | 12/1938 | Elmendorf | |
| 2,149,026 | A | 2/1939 | McBride | |
| 2,266,464 | A * | 12/1941 | Kraft | 52/586.2 |
| 2,269,926 | A | 1/1942 | Crooks | |
| 2,306,295 | A | 12/1942 | Casto | |
| 2,495,862 | A | 1/1950 | Osborn | |

(Continued)

FOREIGN PATENT DOCUMENTS

AT 218725 B 12/1961

(Continued)

OTHER PUBLICATIONS

Webster's Dictionary, Random House: New York (1987), p. 862.

(Continued)

*Primary Examiner* — William Gilbert
(74) *Attorney, Agent, or Firm* — Buchanan Ingersoll & Rooney PC

(57) ABSTRACT

Floor panels and floor elements therefore are made of sheet-shaped cores which before application of the surface of the floor panels are formed with sealing means for counteracting changes in the properties of the floor panels caused by moisture.

21 Claims, 17 Drawing Sheets

U.S. PATENT DOCUMENTS 2,497,837 A 2/1950 Nelson
2,928,456 A 3/1955 Potchen et al.
2,805,852 A 9/1957 Malm
2,851,740 A 9/1958 Baker
2,865,058 A 12/1958 Andersson et al.
2,872,712 A 2/1959 Brown et al.
2,914,815 A 12/1959 Cook
2,947,040 A * 8/1960 Schultz ..... 52/592.4
3,120,083 A 2/1964 Dahlberg et al.
3,200,553 A 8/1965 Frashour et al.
3,204,380 A 9/1965 Smith
3,234,074 A 2/1966 Bryant
3,247,638 A 4/1966 Gay, Jr.
3,301,147 A 1/1967 Clayton et al.
3,347,048 A 10/1967 Brown et al.
3,377,931 A 4/1968 Hilton
3,387,422 A 6/1968 Wanzer
3,440,790 A 4/1969 Nerem
3,460,304 A 8/1969 Braeuninger et al.
3,481,810 A 12/1969 Waite
3,508,523 A 4/1970 De Meerleer et al.
3,526,420 A 9/1970 Brancalcone
3,538,665 A 11/1970 Gohner
3,548,559 A 12/1970 Levine
3,553,919 A 1/1971 Omholt
3,555,762 A 1/1971 Costanzo, Jr.
3,579,941 A 5/1971 Tibbals
3,694,983 A 10/1972 Couquet
3,714,747 A 2/1973 Curran
3,720,027 A 3/1973 Christensen
3,729,368 A 4/1973 Ingham et al.
3,731,445 A 5/1973 Hoffmann et al.
3,759,007 A 9/1973 Thiele
3,768,846 A 10/1973 Hensley et al.
3,786,608 A 1/1974 Boettcher
3,842,562 A 10/1974 Daigle
3,857,749 A 12/1974 Yoshida
3,859,000 A 1/1975 Webster
3,888,061 A 6/1975 Kahr
3,902,293 A 9/1975 Witt et al.
3,908,053 A 9/1975 Hettich
3,936,551 A 2/1976 Elmendorf et al.
3,988,187 A 10/1976 Witt et al.
4,037,377 A * 7/1977 Howell et al. ..... 52/309.9
4,084,996 A 4/1978 Wheeler
4,090,338 A 5/1978 Bourgade
4,099,358 A 7/1978 Compaan
4,100,710 A * 7/1978 Kowallik ..... 52/309.9
4,169,688 A 10/1979 Toshio
RE30,233 E 3/1980 Lane et al.
4,196,554 A 4/1980 Anderson et al.
4,227,430 A 10/1980 Jansson et al.
4,242,390 A 12/1980 Nemeth
4,299,070 A 11/1981 Oltmanns et al.
4,304,083 A 12/1981 Anderson
4,426,820 A 1/1984 Terbrack et al.
4,471,012 A 9/1984 Maxwell
4,489,115 A 12/1984 Layman et al.
4,501,102 A 2/1985 Knowles
4,561,233 A 12/1985 Harter et al.
4,567,706 A 2/1986 Wendt
4,574,099 A 3/1986 Nixon
4,612,074 A 9/1986 Smith et al.
4,612,745 A 9/1986 Hovde
4,641,469 A 2/1987 Wood
4,643,237 A 2/1987 Rosa
4,646,494 A 3/1987 Saarinen et al.
4,648,165 A 3/1987 Whitehorne
4,653,242 A 3/1987 Ezard
4,694,627 A 9/1987 Omholt
4,703,597 A 11/1987 Eggemar
4,715,162 A 12/1987 Brightwell
4,716,700 A 1/1988 Hagemeyer
4,738,071 A 4/1988 Ezard
4,769,963 A 9/1988 Meyerson
4,819,932 A 4/1989 Trotter, Jr.
4,822,440 A 4/1989 Hsu et al.
4,831,806 A 5/1989 Niese et al.
4,845,907 A 7/1989 Meek
4,905,442 A 3/1990 Daniels
5,029,425 A 7/1991 Bogataj
5,113,632 A 5/1992 Hanson
5,117,603 A 6/1992 Weintraub
5,148,850 A 9/1992 Urbanick
5,165,816 A 11/1992 Parasin
5,179,812 A 1/1993 Hill
5,216,861 A 6/1993 Meyerson
5,253,464 A 10/1993 Nilsen
5,271,564 A 12/1993 Smith
5,274,979 A 1/1994 Tsai
5,286,545 A 2/1994 Simmons, Jr.
5,295,341 A 3/1994 Kajiwara
5,349,796 A 9/1994 Meyerson
5,390,457 A 2/1995 Sjolander
5,433,806 A 7/1995 Pasquali et al.
5,474,831 A 12/1995 Nystrom
5,497,589 A 3/1996 Porter
5,502,939 A * 4/1996 Zadok et al. ..... 52/309.9
5,540,025 A 7/1996 Takehara et al.
5,560,569 A 10/1996 Schmidt
5,567,497 A 10/1996 Zegler et al.
5,570,554 A 11/1996 Searer
5,597,024 A 1/1997 Bolyard et al.
5,613,894 A 3/1997 Delle Vedove
5,618,602 A * 4/1997 Nelson ..... 428/60
5,630,304 A 5/1997 Austin
5,653,099 A 8/1997 MacKenzie
5,671,575 A 9/1997 Wu
5,695,875 A 12/1997 Larsson et al.
5,706,621 A * 1/1998 Pervan ..... 52/403.1
5,755,068 A 5/1998 Ormiston
5,768,850 A 6/1998 Chen
5,797,237 A 8/1998 Finkell, Jr.
5,823,240 A 10/1998 Bolyard et al.
5,827,592 A 10/1998 Van Gulik et al.
5,858,160 A 1/1999 Piacente et al.
5,860,267 A 1/1999 Pervan
5,899,038 A 5/1999 Stroppiana
5,900,099 A 5/1999 Sweet et al.
5,925,211 A 7/1999 Rakauskas
5,935,668 A 8/1999 Smith
5,943,239 A 8/1999 Shamblin et al.
5,968,625 A 10/1999 Hudson
5,987,839 A 11/1999 Hamar et al.
6,006,486 A 12/1999 Moriau et al.
6,023,907 A 2/2000 Pervan
6,029,416 A * 2/2000 Andersson ..... 52/592.1
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,173,548 B1 * 1/2001 Hamar et al. ..... 52/582.1
6,182,410 B1 2/2001 Pervan
6,182,413 B1 2/2001 Magnusson
6,203,653 B1 3/2001 Seidner
6,205,639 B1 3/2001 Pervan
6,209,278 B1 4/2001 Tychsen
6,212,838 B1 4/2001 Eda
6,216,403 B1 4/2001 Belbeoc'h
6,216,409 B1 4/2001 Roy et al.
6,247,285 B1 6/2001 Moebus
6,314,701 B1 * 11/2001 Meyerson ..... 52/588.1
6,324,803 B1 12/2001 Pervan
6,332,733 B1 * 12/2001 Hamberger et al. ..... 403/329
6,339,908 B1 1/2002 Chuang
6,345,481 B1 2/2002 Nelson
6,363,677 B1 4/2002 Chen et al.
6,385,936 B1 5/2002 Schneider
6,397,547 B1 6/2002 Mårtensson
6,421,970 B1 7/2002 Martensson et al.
6,438,919 B1 * 8/2002 Knauseder ..... 52/586.2
6,446,405 B1 9/2002 Pervan
6,490,836 B1 12/2002 Moriau et al.
6,497,079 B1 12/2002 Pletzer et al.
6,505,452 B1 1/2003 Hannig et al.
6,510,665 B2 1/2003 Pervan

| | | | |
|---|---|---|---|
| 6,516,579 | B1 | 2/2003 | Pervan |
| 6,532,709 | B2 | 3/2003 | Pervan |
| 6,536,178 | B1 | 3/2003 | Palsson et al. |
| 6,546,691 | B2 | 4/2003 | Leopolder |
| 6,584,747 | B2 | 7/2003 | Kettler et al. |
| 6,591,568 | B1 | 7/2003 | Pålsson |
| 6,601,359 | B2 | 8/2003 | Olofsson |
| 6,606,834 | B2 | 8/2003 | Martensson |
| 6,647,689 | B2 | 11/2003 | Pletzer et al. |
| 6,647,690 | B1 | 11/2003 | Martensson |
| 6,670,019 | B2 | 12/2003 | Andersson |
| 6,679,011 | B2 | 1/2004 | Beck et al. |
| 6,682,254 | B1 | 1/2004 | Olofsson et al. |
| 6,684,592 | B2 | 2/2004 | Martin |
| 6,722,809 | B2 | 4/2004 | Hamberger |
| 6,763,643 | B1 | 7/2004 | Martensson |
| 6,766,622 | B1 | 7/2004 | Thiers et al. |
| 6,769,218 | B2 | 8/2004 | Pervan |
| 6,769,219 | B2 | 8/2004 | Schwitte et al. |
| 6,786,019 | B2 * | 9/2004 | Thiers ..... 52/589.1 |
| 6,804,926 | B1 | 10/2004 | Eisermann |
| 6,854,235 | B2 * | 2/2005 | Martensson ..... 52/601 |
| 6,874,292 | B2 | 4/2005 | Moriau et al. |
| 6,880,307 | B2 | 4/2005 | Schwitte et al. |
| 6,898,913 | B2 | 5/2005 | Pervan |
| 6,933,043 | B1 | 8/2005 | Son et al. |
| 7,022,189 | B2 | 4/2006 | Delle Vedove |
| 7,040,068 | B2 | 5/2006 | Moriau et al. |
| 7,055,290 | B2 | 6/2006 | Thiers |
| 7,121,058 | B2 | 10/2006 | Palsson et al. |
| 7,131,242 | B2 | 11/2006 | Martensson et al. |
| 7,137,229 | B2 | 11/2006 | Pervan |
| 7,251,916 | B2 | 8/2007 | Konzelmann et al. |
| 7,441,385 | B2 | 10/2008 | Palsson et al. |
| 7,484,338 | B2 | 2/2009 | Pervan et al. |
| 7,584,583 | B2 | 9/2009 | Bergelin et al. |
| 7,596,920 | B2 | 10/2009 | Konstanczak |
| 7,603,826 | B1 | 10/2009 | Moebus |
| 7,632,561 | B2 | 12/2009 | Thiers |
| 7,874,119 | B2 | 1/2011 | Pervan et al. |
| 2001/0029720 | A1 | 10/2001 | Pervan |
| 2001/0034992 | A1 | 11/2001 | Pletzer et al. |
| 2002/0007608 | A1 | 1/2002 | Pervan |
| 2002/0007609 | A1 | 1/2002 | Pervan |
| 2002/0014047 | A1 | 2/2002 | Thiers |
| 2002/0020127 | A1 | 2/2002 | Thiers et al. |
| 2002/0031646 | A1 | 3/2002 | Chen et al. |
| 2002/0046528 | A1 | 4/2002 | Pervan et al. |
| 2002/0059765 | A1 | 5/2002 | Nogueria et al. |
| 2002/0069611 | A1 | 6/2002 | Leopolder |
| 2002/0083673 | A1 | 7/2002 | Kettler et al. |
| 2002/0095894 | A1 | 7/2002 | Pervan |
| 2002/0100231 | A1 | 8/2002 | Miller et al. |
| 2002/0112433 | A1 | 8/2002 | Pervan |
| 2002/0178673 | A1 | 12/2002 | Pervan |
| 2002/0178674 | A1 | 12/2002 | Pervan |
| 2002/0178682 | A1 | 12/2002 | Pervan |
| 2003/0009972 | A1 | 1/2003 | Pervan et al. |
| 2003/0033777 | A1 | 2/2003 | Thiers et al. |
| 2003/0033784 | A1 | 2/2003 | Pervan |
| 2003/0041545 | A1 | 3/2003 | Stanchfield |
| 2003/0084636 | A1 | 5/2003 | Pervan |
| 2003/0101681 | A1 | 6/2003 | Tychsen |
| 2003/0233809 | A1 | 12/2003 | Pervan |
| 2004/0031227 | A1 | 2/2004 | Knauseder |
| 2004/0177584 | A1 | 9/2004 | Pervan |
| 2004/0241374 | A1 | 12/2004 | Thiers et al. |
| 2004/0255541 | A1 | 12/2004 | Thiers et al. |
| 2005/0034404 | A1 | 2/2005 | Pervan |
| 2005/0034405 | A1 | 2/2005 | Pervan |
| 2005/0055943 | A1 | 3/2005 | Pervan |
| 2005/0102937 | A1 | 5/2005 | Pervan |
| 2005/0138881 | A1 | 6/2005 | Pervan |
| 2005/0161468 | A1 | 7/2005 | Wagner |
| 2005/0193677 | A1 | 9/2005 | Vogel |
| 2005/0208255 | A1 | 9/2005 | Pervan |
| 2005/0235593 | A1 | 10/2005 | Hecht |
| 2006/0117696 | A1 | 6/2006 | Pervan |
| 2006/0196139 | A1 | 9/2006 | Pervan et al. |
| 2006/0283127 | A1 | 12/2006 | Pervan |
| 2007/0119110 | A1 | 5/2007 | Pervan |
| 2007/0159814 | A1 | 7/2007 | Jacobsson |
| 2007/0175143 | A1 | 8/2007 | Pervan et al. |
| 2007/0175148 | A1 | 8/2007 | Bergelin |
| 2007/0175156 | A1 | 8/2007 | Pervan et al. |
| 2008/0000182 | A1 | 1/2008 | Pervan |
| 2008/0000189 | A1 | 1/2008 | Pervan |
| 2008/0005989 | A1 | 1/2008 | Pervan et al. |
| 2008/0005992 | A1 | 1/2008 | Pervan |
| 2008/0008871 | A1 | 1/2008 | Pervan |
| 2008/0028707 | A1 | 2/2008 | Pervan |
| 2008/0060308 | A1 | 3/2008 | Pervan |
| 2008/0256890 | A1 | 10/2008 | Pervan et al. |
| 2009/0151291 | A1 | 6/2009 | Pervan |
| 2009/0155612 | A1 | 6/2009 | Pervan et al. |
| 2010/0300030 | A1 | 12/2010 | Pervan et al. |
| 2011/0072754 | A1 | 3/2011 | Pervan et al. |

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CA | 2 363 184 | | 7/2001 |
| CH | 200949 | | 1/1939 |
| CH | 211877 | | 1/1941 |
| CH | 690 242 | A5 | 6/2000 |
| CN | 2106197 | U | 6/1992 |
| DE | 1 212 275 | | 3/1966 |
| DE | 7102476 | | 1/1971 |
| DE | 1 534 278 | | 11/1971 |
| DE | 2 159 042 | | 6/1973 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 3343601 | A1 | 6/1985 |
| DE | 35 38 538 | A1 | 10/1985 |
| DE | 8304004 | | 6/1986 |
| DE | 8604004 | | 6/1986 |
| DE | 3512204 | A1 | 10/1986 |
| DE | 3544845 | A1 | 6/1987 |
| DE | 36 31 390 | A1 | 12/1987 |
| DE | 39 18 676 | | 8/1990 |
| DE | 40 02 547 | A1 | 8/1991 |
| DE | 41 30 115 | A1 | 9/1991 |
| DE | 4134452 | A1 | 4/1993 |
| DE | 4215273 | A1 | 11/1993 |
| DE | 4242530 | A1 | 6/1994 |
| DE | 43 13 037 | C1 | 8/1994 |
| DE | 93 17 191 | U1 | 4/1995 |
| DE | 295 17 995 | U1 | 2/1996 |
| DE | 296 10 462 | U1 | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 198 51 200 | C1 | 3/2000 |
| DE | 299 22 649 | U1 | 4/2000 |
| DE | 200 01 225 | U1 | 8/2000 |
| DE | 200 02 744 | U1 | 9/2000 |
| DE | 199 25 248 | A1 | 12/2000 |
| DE | 200 13 380 | U1 | 12/2000 |

| | | | |
|---|---|---|---|
| DE | 200 17 461 | U1 | 3/2001 |
| DE | 200 18 284 | U1 | 3/2001 |
| DE | 100 01 248 | A1 | 7/2001 |
| DE | 100 32 204 | C1 | 7/2001 |
| DE | 201 08 358 | U1 | 9/2001 |
| DE | 203 07 580 | U1 | 7/2003 |
| DE | 20 2004 001 038 | U1 | 5/2004 |
| DE | 20 2005 006 300 | U1 | 8/2005 |
| DE | 10 2004 054 368 | A1 | 5/2006 |
| EP | 0 248 127 | A1 | 12/1987 |
| EP | 0 487 925 | A1 | 6/1992 |
| EP | 0 623 724 | A1 | 11/1994 |
| EP | 0 652 340 | A1 | 5/1995 |
| EP | 0 665 347 | A1 | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 958 441 | | 11/1998 |
| EP | 0 661 135 | B1 | 12/1998 |
| EP | 0 903 451 | A2 | 3/1999 |
| EP | 0 903 451 | A3 | 8/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | A1 | 2/2000 |
| EP | 1 045 083 | | 10/2000 |
| EP | 1 048 423 | A2 | 11/2000 |
| EP | 1 251 219 | A1 | 7/2001 |
| EP | 1 120 515 | A1 | 8/2001 |
| EP | 1 165 906 | | 1/2002 |
| EP | 1 223 265 | A2 | 7/2002 |
| EP | 1 262 609 | A1 | 12/2002 |
| EP | 1 317 983 | A2 | 6/2003 |
| EP | 1 338 344 | A2 | 8/2003 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1171337 | | 11/1969 |
| GB | 1237744 | | 6/1971 |
| GB | 1275511 | | 5/1972 |
| GB | 1 394 621 | | 5/1975 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A | 11/1992 |
| JP | 54-65528 | | 5/1979 |
| JP | 57-119056 | | 7/1982 |
| JP | 57-185110 | | 11/1982 |
| JP | 59-186336 | | 11/1984 |
| JP | 59-185346 | U | 12/1984 |
| JP | 1-178659 | A | 7/1989 |
| JP | 1-33702 | Y2 | 10/1989 |
| JP | 2-194269 | A | 7/1990 |
| JP | 2-121236 | U | 10/1990 |
| JP | 3-169967 | | 7/1991 |
| JP | 4-106264 | | 4/1992 |
| JP | 4-191001 | | 7/1992 |
| JP | 5-96282 | U | 2/1993 |
| JP | 5-021027 | U | 3/1993 |
| JP | 5-148984 | | 6/1993 |
| JP | 6-39840 | B2 | 5/1994 |
| JP | 6-56310 | | 5/1994 |
| JP | 6-146553 | A | 5/1994 |
| JP | 6-158831 | A | 6/1994 |
| JP | 6-280376 | A | 10/1994 |
| JP | 6-320510 | A | 11/1994 |
| JP | 7-076923 | A | 3/1995 |
| JP | 7-102745 | A | 4/1995 |
| JP | 7-26467 | U | 5/1995 |
| JP | 7-180333 | A | 7/1995 |
| JP | 7-300979 | A | 11/1995 |
| JP | 7-310426 | A | 11/1995 |
| JP | 8-086080 | | 4/1996 |
| JP | 8-109734 | | 4/1996 |
| JP | 8-300316 | A | 11/1996 |
| JP | 9-38906 | | 2/1997 |
| JP | 9-038906 | A | 2/1997 |
| JP | 9-53319 | A | 2/1997 |
| JP | 9-938906 | | 2/1997 |
| JP | 9-88315 | | 3/1997 |
| JP | 10-299230 | A | 11/1998 |
| JP | 11-131771 | A | 5/1999 |
| JP | 2000 179137 | | 6/2000 |
| JP | 2000-226932 | | 8/2000 |
| JP | 2001-145980 | A | 5/2001 |
| JP | 2001 173213 | | 6/2001 |
| JP | 2001 179710 | | 7/2001 |
| JP | 2001 254503 | | 9/2001 |
| JP | 2001 260107 | | 9/2001 |
| JP | 2001 329681 | | 11/2001 |
| JP | 2001-329681 | A | 11/2001 |
| NL | 7601773 | | 8/1976 |
| NL | 1008945 | C1 | 10/1999 |
| NO | 157871 | | 7/1984 |
| NO | 305614 | | 5/1995 |
| PL | 24931 | U | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| SU | 1680359 | A1 | 9/1991 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | WO 97/19232 | A1 | 5/1997 |
| WO | WO 97/47834 | | 12/1997 |
| WO | WO 98/22677 | A1 | 5/1998 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/58254 | A1 | 11/1999 |
| WO | WO 99/66151 | | 12/1999 |
| WO | WO 99/66152 | | 12/1999 |
| WO | WO 00/06854 | | 1/2000 |
| WO | 00/20706 | A1 | 4/2000 |
| WO | WO 00/20705 | A1 | 4/2000 |
| WO | WO 00/47841 | A1 | 8/2000 |
| WO | WO 00/66856 | A1 | 11/2000 |
| WO | WO 01/02669 | A1 | 1/2001 |
| WO | WO 01/07729 | A1 | 2/2001 |
| WO | 01/51733 | A1 | 7/2001 |
| WO | WO 01/51732 | A1 | 7/2001 |
| WO | 01/66877 | A1 | 9/2001 |

| | | | |
|---|---|---|---|
| WO | WO 01/66876 | A1 | 9/2001 |
| WO | 01/98604 | A1 | 12/2001 |
| WO | WO 01/96688 | A1 | 12/2001 |
| WO | WO 01/98603 | A2 | 12/2001 |
| WO | 02/050810 | A1 | 7/2002 |
| WO | 02/055809 | A1 | 7/2002 |
| WO | 02/055810 | A1 | 7/2002 |
| WO | WO 02/060691 | A1 | 8/2002 |
| WO | WO 03/012224 | A1 | 2/2003 |
| WO | WO 03/016654 | A1 | 2/2003 |
| WO | WO 03/016655 | A1 | 2/2003 |
| WO | WO 03/025307 | A1 | 3/2003 |
| WO | 03/070384 | A1 | 8/2003 |
| WO | 03/078761 | A1 | 9/2003 |
| WO | WO 03/074814 | A1 | 9/2003 |
| WO | 03/099461 | A1 | 12/2003 |
| WO | 2005/077625 | A1 | 8/2005 |
| WO | 2005/110677 | A1 | 11/2005 |
| WO | 2006/008578 | A1 | 1/2006 |
| WO | 2006/111437 | A1 | 10/2006 |
| WO | 2006/113757 | A2 | 10/2006 |

OTHER PUBLICATIONS

Knight's American Mechanical Dictionary, Hurd and Houghton: New York (1876), p. 2051.
Opposition EP 0.698,162 B1—Facts-Grounds-Arguments, dated Apr. 1, 1999, pp. 1-56.
Opposition II EP 0.698,162 B1—Facts-Grounds-Arguments, dated Apr. 30, 1999, (17 pages)—with translation (11 pages).
Opposition I: Unilin Decor N.V./Välinge Aluminum AB, communication dated Jun. 8, 1999 to European Patent Office, pp. 1-2.
Opposition I: Unilin Decor N.V./Välinge Aluminum AB, communication dated Jun. 16, 1999 to European Patent Office, pp. 1-2.
FI Office Action dated Mar. 19, 1998.
NO Office Action dated Dec. 22, 1997.
NO Office Action dated Sep. 21, 1998.
Opposition EP 0.877.130 B1—Facts—Arguments, dated Jun. 28, 2000, pp. 1-13.
RU Application Examiner Letter dated Sep. 26, 1997.
NZ Application Examiner Letter dated Oct. 21, 1999.
European prosecution file history to grant, European Patent No. 94915725.9-2303/0698162, grant date Sep. 16, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Communication of Notices of Intervention by E.F.P. Floor Products dated Mar. 17, 2000 in European Patent Application 0698162, pp. 1-11 with annex pp. 1-21.
Response to the E.F.P. Floor Products intervention dated Jun. 28, 2000, pp. 1-5.
Letters from the ,Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
*Pergo, Inc.* v. *Välinge Aluminium AB, Berry Finance NV, and Alloc, Inc.*; U.S. District Court for the District of Columbia; Civil Action No. 1:OOCVO1618.
*Alloc, Inc.* v. *Unilin Decor NV and BHK of America, Inc.*; U.S. District Court for the Eastern District of Wisconsin; Civil Action No. OO-C-0999.
*Unilin Beheer B.V., Unilin Decor, N.V., and BHK of America, Inc.* v. *Välinge Aluminium AB*; U.S. District Court for the District of Columbia; Civil Action No. 1:OOCVO1823.
*Alloc, Inc., Berry Finance NV, and Välinge Aluminium AB* v. *Unilin Decor NV, BHK of America, Inc., Pergo, Inc., Meister-Leisten Schulte GmbH, Akzenta Paneele + Profile GmbH, Tarkett, Inc., and Roysol*; ITC No. 337-TA-443 filed Dec. 4, 2000.
*Alloc, Inc., Berry Finance NV, and Välinge Aluminium AB* v. *Tarkett, Inc.*; U.S. District Court for the Eastern District of Wisconsin; Civil Action No. OO-CV-1377.
Välinge, Fibo-Trespo Brochure, Distributed at the Domotex Fair in Hannover, Germany, Jan. 1996.
Träindustrins Handbook "Snickeriarbete", 2nd Edition, Malmö 1952, pp. 826, 827, 854, and 855, published by Teknografiska Aktiebolaget, Sweden.
"Träbearbetning", Anders Grönlund, 1986, ISBN 91-970513-2-2, pp. 357-360, published by Institutet for Trateknisk Forskning, Stockholm, Sweden.
Drawing Figure 25/6107 from Buetec Gmbh dated Dec. 16, 1985.
Pamphlet from Serexhe for Compact-Praxis, entitled "Selbst Teppichböden, PVC und Parkett verlegen", Published by Compact Verlag, München, Germany 1985, pp. 84-87.
Pamphlet from Junckers Industrser A/S entitled"Bøjlesystemet til Junckers boliggulve" Oct. 1994, Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Tony Pervan, U.S. Appl. No. 09/534,007 entitled *"System for Joining Building Boards"* filed Mar. 24, 2000.
Darko Pervan, U.S. Appl. No. 09/714,514 entitled *"Locking System and Flooring Board"* filed Nov. 17, 2000.
Darko Pervan, U.S. Appl. No. 10/043,149 entitled *"Floorboards and Methods for Production and Installation Thereof"* filed Jan. 14, 2002.
Darko Pervan et al., U.S. Appl. No. 10/171,752 entitled *"Method for Making a Building Board"* filed Jun. 17, 2002.
Tony Pervan, U.S. Appl. No. 10/202,093 entitled *"System for Joining Building Panels"* filed Jul. 25, 2002.
Tony Pervan, U.S. Appl. No. 10/202,098 entitled *"System for Joining Building Panels"* filed Jul. 25, 2002.
Tony Pervan, U.S. Appl. No. 10/202,102 entitled *"System for Joining a Building Board"* filed Jul. 25, 2002.
Darko Pervan et al. U.S. Appl. No. 10/235,940 entitled *"Flooring and Method for Laying and Manufacturing the Same"* filed Sep. 6, 2002.
Darko Pervan U.S. Appl. No. 10/256,167 entitled *"Locking System for Mechanical Joining of Floorboards and Method for Production Thereof"* filed Sep. 27, 2002.
Darko Pervan, U.S. Appl. No. 10/359,615 entitled "Locking System for Floorboards" filed Feb. 7, 2003.
Darko Pervan, U.S. Appl. No. 10/361,815 entitled "Locking System and Flooring Board" filed Feb. 11, 2003.
Darko Pervan, U.S. Appl. No. 10/413,478 entitled "Mechanical Locking System for Floating Floor" filed Apr. 15, 2003.
Darko Pervan, U.S. Appl. No. 10/413,479 entitled "Floorboards for Floating Floor" filed Apr. 15, 2003.
Darko Pervan, U.S. Appl. No. 10/413,566 entitled "Floorboards with Decorative Grooves" filed Apr. 15, 2003.
Tony Pervan, U.S. Appl. No. 10/430,273 entitled "System for Joining Building Panels" filed May 7, 2003.
Darko Pervan et al. U.S. Appl. No. 10/235,940 entitled *"Flooring and Method for Laying and Manufacturing the Same"* filed Sep. 6, 2002.
Darko Pervan U.S. Appl. No. 10/256,167 entitled *"Locking System for Mechanical Joining of Floorboards and Method for Production Thereof"* filed Sep. 27, 2002.

Darko Pervan, U.S. Appl. No. 10/359,615 entitled "Locking System for Floorboards" filed Feb. 7, 2003.
Darko Pervan, U.S. Appl. No. 10/361,815 entitled "Locking System and Flooring Board" filed Feb. 11, 2003.
Darko Pervan, U.S. Appl. No. 10/413,478 entitled "Mechanical Locking System for Floating Floor" filed Apr. 15, 2003.
Darko Pervan, U.S. Appl. No. 10/413,479 entitled "Floorboards for Floating Floor" filed Apr. 15, 2003.
Darko Pervan, U.S. Appl. No. 10/413,566 entitled "Floorboards with Decorative Grooves" filed Apr. 15, 2003.
Tony Pervan, U.S. Appl. No. 10/430,273 entitled "System for Joining Building Panels" filed May 7, 2003.
Darko Pervan, U.S. Appl. No. 10/808,455, entitled "Flooring and Method for Installation and Manufacturing Thereof" filed Mar. 25, 2004.
Darko Pervan, U.S. Appl. No. 10/730,131 entitled "Floorboards, Flooring Systems and Methods for Manufacturing and Installation Thereof" filed Dec. 9, 2003.
Darko Pervan, U.S. Appl. No. 10/768,677 entitled "Mechanical Locking System for Floorboards" filed Feb. 2, 2004.
Darko Pervan, U.S. Appl. No. 10/708,314 entitled "Floorboard and Method of Manufacturing Thereof" filed Feb. 24, 2004.
Webster's Dictionary, Random House: New York (1987), p. 862.
Knight's American Mechanical Dictionary, Hurd and Houghton: New York (1876), p. 2051.
Opposition EP 0.698,162 B1—Facts-Grounds-Arguments, dated Apr. 1, 1999, pp. 1-56.
Opposition II EP 0.698,162 B1—Facts-Grounds-Arguments, dated Apr. 30, 1999, (17 pages)—with translation (11 pages).
Opposition I: Unilin Decor N.V./Välinge Aluminum AB, communication dated Jun. 8, 1999 to European Patent Office, pp. 1-2.
Opposition I: Unilin Decor N.V./Välinge Aluminum AB, communication dated Jun. 16, 1999 to European Patent Office, pp. 1-2.
Opposition EP 0.877.130 B1—Facts-Arguments, dated Jun. 28, 2000, pp. 1-13.
European prosecution file history to grant, European Patent No. 94915725.9-2303/0698162, grant date Sep. 16, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Communication of Notices of Intervention by E.F.P. Floor Products dated Mar. 17, 2000 in European Patent Application 0698162, pp. 1-11 with annex pp. 1-21.
Response to the E.F.P. Floor Products intervention dated Jun. 28, 2000, pp. 1-5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
*Pergo, Inc.* v. *Välinge Aluminium AB, Berry Finance NV, and Alloc, Inc.*; U.S. District Court for the District of Columbia; Civil Action No. 1:OOCV01618.
*Alloc, Inc.* v. *Unilin Decor NV and BHK of America, Inc.*; U.S. District Court for the Eastern District of Wisconsin; Civil Action No. OO-C-0999.
*Unilin Beheer B.V., Unilin Decor, N.V., and BHK of America, Inc.*, v. *Välinge Aluminium AB*; U.S. District Court for the District of Columbia; Civil Action No. 1:OOCV01823.
*Alloc, Inc., Berry Finance NV, and Välinge Aluminium AB* v. *Unilin Decor NV, BHK of America, Inc., Pergo, Inc.*, Meister-Leisten Schulte GmbH, Akzenta Paneele + Profile GmbH, Tarkett, Inc., and Roysol; ITC No. 337-TA-443, filed Dec. 4, 2000.
*Alloc, Inc., Berry Finance NV, and Välinge Aluminium AB* v. *Tarkett, Inc.*; U.S. District Court for the Eastern District of Wisconsin; Civil Action No. OO-CV-1377.
Välinge, Fibo-Trespo Brochure, Distributed at the Domotex Fair In Hannover, Germany, Jan. 1996.
Träindustrins Handbook "Snickeriarbete", 2nd Edition, Malmö 1952, pp. 826, 827, 854, and 855, published by Teknografiska Aktiebolaget, Sweden.
"Träbearbetning", Anders Grönlund, 1986, ISBN 91-970513-2-2, pp. 357-360, published bu Institutet for Trateknisk Forskning, Stockholm, Sweden.
Drawing Figure 25/6107 from Buetec Gmbh dated Dec. 16, 1985.
Pamphlet from Serexhe for Compact-Praxis, entitled "Selbst Teppichböden, PVC und Parkett verlegen", Published by Compact Verlag, München, Germany 1985, pp. 84-87.
Pamphlet from Junckers Industrser A/S entitled "Bøjlesystemet til Junckers boliggulve" Oct. 1994, , Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Tony Pervan, U.S. Appl. No. 09/534,007 entitled *"System for Joining Building Boards"* filed Mar. 24, 2000.
Darko Pervan, U.S. Appl. No. 09/714,514 entitled *"Locking System and Flooring Board"* filed Nov. 17, 2000.
Darko Pervan, U.S. Appl. No. 10/043,149 entitled *"Floorboards And Methods For Production And Installation Thereof"* filed Jan. 14, 2002.
Darko Pervan et al., U.S. Appl. No. 10/171,752 entitled *"Method for Making a Building Board"* filed Jun. 17, 2002.
Tony Pervan, U.S. Appl. No. 10/202,093 entitled *"System for Joining Building Panels"* filed Jul. 25, 2002.
Tony Pervan, U.S. Appl. No. 10/202,098 entitled *"System for Joining Building Panels"* filed Jul. 25, 2002.
Tony Pervan, U.S. Appl. No. 10/202,102 entitled *"System for Joning A Building Board"* filed Jul. 25, 2002.
Darko Pervan et al. U.S. Appl. No. 10/235,940 entitled *"Flooring and Method for Laying and Manufacturing the Same"* filed Sep. 6, 2002.
Darko Pervan U.S. Appl. No. 10/256,167 entitled *"Locking System for Mechanical Joining of Floorboards and Method for Production Thereof"* filed Sep. 27, 2002.
Darko Pervan, U.S. Appl. No. 10/359,615 entitled "Locking System for Floorboards" filed Feb. 7, 2003.
Darko Pervan, U.S. Appl. No. 10/361,815 entitled "Locking System and Flooring Board" filed Feb. 11, 2003.
Darko Pervan, U.S. Appl. No. 10/413,478 entitled "Mechanical Locking System for Floating Floor" filed Apr. 15, 2003.
Darko Pervan, U.S. Appl. No. 10/413,479 entitled "Floorboards for Floating Floor" filed Apr. 15, 2003.
Darko Pervan, U.S. Appl. No. 10/413,566 entitled "Floorboards with Decorative Grooves" filed Apr. 15, 2003.
Tony Pervan, U.S. Appl. No. 10/430,273 entitled "System for Joining Building Panels" filed May 7, 2003.
Jacobsson, Jan, et al, U.S. Appl. No. 11/521,439, entitled "Device and Method for Compressing an Edge of a Building Panel and a Building Panel With Compressed Edges", filed Sep. 15,2006.
Pervan, Darko, U.S. Appl. No. 11/627,971, entitled "Locking System for Floorboards", filed Jan. 28, 2007.
Pervan, Darko, et al., U.S. Appl. No. 11/635,674, entitled "Laminate Floor Panels", filed Dec. 8, 2006.
Pervan, Darko, et al., U.S. Appl. No. 11/635,633, entitled "Laminate Floor Panels" filed Dec. 8, 2006.
Hakansson, Niclas, U.S. Appl. No. 11/643,881, entitled "V-GROOVE", filed Dec. 22, 2006.

Bergelin, Marcus, et al., U.S. Appl. No. 11/649,837, entitled "Resilient Groove", filed Jan. 5, 2007.
Pervan, Darko, et al., U.S. Appl. No. 11/575,600, entitled "Mechanical Locking of Floor Panels with a Flexible Tongue", filed Mar. 20, 2007.
Pervan, Darko, U.S. Appl. No. 11/806,478, entitled "Wear Resistant Surface", filed May 31, 2007.
Pervan, Darko, et al., U.S. Appl. No. 11/770,771, entitled "Locking System Comprising a Combination Lock for Panels", filed Jun. 29, 2007.
Pervan, Darko, et al., U.S. Appl. No. 11/775,885, entitled "Mechanical Locking of Floor Panels with a Flexible Bristle Tongue", filed Jul. 11, 2007.
Pervan, Darko, et al., U.S. Appl. No. 11/635,674, entitled "Laminate Floor Panels", filed Dec. 8, 2006.
Pervan, Darko, et al., U.S. Appl. No. 11/635,633, entitled "Laminate Floor Panels" filed Dec. 8, 2006.
Hakansson, Niclas, U.S. Appl. No. 11/643,881, entitled "V-GROOVE", filed Dec. 22, 2006.
Bergelin, Marcus, et al., U.S. Appl. No. 11/649,837, entitled "Resilient Groove", filed Jan. 5, 2007.
Pervan, Darko, et al., U.S. Appl. No. 11/575,600, entitled "Mechanical Locking of Floor Panels with a Flexible Tongue", filed Mar. 20, 2007.
Pervan, Darko, U.S. Appl. No. 11/806,478, entitled "Wear Resistant Surface", filed May 31, 2007.
Pervan, Darko, et al., U.S. Appl. No. 11/770,771, entitled "Locking System Comprising a Combination Lock for Panels", filed Jun. 29, 2007.
Pervan, Darko, et al., U.S. Appl. No. 11/775,885, entitled "Mechanical Locking of Floor Panels with a Flexible Bristle Tongue", filed Jul. 11, 2007.
Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.
Pervan, U.S. Appl. No. 12/785,784, entitled "Locking System for Floorboards," filed in the U. S. Patent and Trademark Office on May 24, 2010.
Pervan, U.S. Appl. No. 12/834,258, entitled "Locking System for Mechanical Joining of Floorboards and Method for Production Thereof," filed in the U. S. Patent and Trademark Office on Jul. 12, 2010.
U.S. Appl. No. 12/959,971, Pervan et al.
Pervan, Darko et al., U.S. Appl. No. 12/959,971, entitled "Locking System, Floorboard Comprising Such a Locking System, as Well as Method for Making Floorboards," filed in the U. S. Patent and Trademark Office on Dec. 3, 2010.
Bergelin, Marcus, et al., U.S. Appl. No. 13/046,011, entitled "Resilient Groove," filed in the U. S. Patent and Trademark Office on Mar. 11, 2011.
U.S. Appl. No. 13/011,398, Pervan et al.
U.S. Appl. No. 13/099,488, Pervan.
Pervan, Darko, et al., U.S. Appl. No. 13/011,398, entitled "Floor Panel With Sealing Means," filed in the U. S. Patent and Trademark Office Jan. 21, 2011.
Pervan, Darko, U.S. Appl. No. 13/099,488, entitled "Locking System and Flooring Board," filed in the U. S. Patent and Trademark Office May 3, 2011.
Official Action issued by the Japanese Patent Office in JP Patent Application No. 2003-517390, Dec 18, 2007, pp. 1-3; and English-language translation thereof.
Darko Pervan et al., U.S. Appl. No. 10/508,198 entitled "Floorboards With Decorative Grooves" filed Sep. 20, 2004.
Darko Pervan, U.S. Appl. No. 10/509,885 entitled "Mechanical Locking System for Floorboards" filed Oct. 4, 2004.
Darko Pervan, U.S. Appl. No. 10/510,580 entitled "Floorboards for Floorings" filed Oct. 8, 2004.
Darko Pervan, U.S. Appl. No. 10/970,282 entitled "Mechanical Locking System for Floor Panels" filed Oct. 22, 2004.
Darko Pervan, U.S. Appl. No. 10/975,923 entitled "Flooring Systems and Methods for Installation" filed Oct. 29, 2004.
Darko Pervan, U.S. Appl. No. 11/000,912 entitled "Floorboard, System and Method for Forming a Flooring, and Flooring Formed Thereof" filed Dec. 2, 2004.
Darko Pervan, U.S. Appl. No. 11/008,213 entitled "Metal Strip for Interlocking Floorboard and a Floorbaord Using Same" filed Dec. 10, 2004.
Darko Pervan, U.S. Appl. No. 11/034,059 entitled "Floor Covering and Locking System" filed Jan. 13, 2005.
Darko Pervan, U.S. Appl. No. 11/034,060 entitled "Floor Covering and Locking System" filed Jan. 13, 2005.
Darko Pervan, U.S. Appl. No. 10/906,356 entitled "Building Panel With Compressed Edges and Method of Making Same" filed Feb. 15, 2005.
Darko Pervan, U.S. Appl. No. 11/092,748 entitled "Mechanical Locking System for Panels and Method of Installing Same" filed Mar. 30, 2005.
Darko Pervan, U.S. Appl. No. 10/908,658 entitled "Mechanical Locking System for Floor Panels" filed May 20, 2005.
Darko Pervan et al, U.S. Appl. No. 11/161,520 entitled "Method of Making a Floorboard and Mehtod of Making a Floor With the Floorboard" filed Aug. 6, 2005.
Darko Pervan et al, U.S. Appl. No. 11/163,085 entitled "Appliance and Method for Surface Treatment of a Board Shaped Material and Floorboard" filed Oct. 4, 2005.

* cited by examiner

PRIOR ART

PRIOR ART

PRIOR ART

PRIOR ART

FLOOR PANEL WITH SEALING MEANS

This application claims priority under 35 U.S.C. §119(e) to U.S. Provisional Application No. 60/313,462 entitled FLOOR PANELS WITH SEALING MEANS and filed on Aug. 21, 2001, the entire content of which is hereby incorporated by reference.

BACKGROUND

1. Technical Field

The invention relates generally to the field of moisture-proof joint systems for floor panels. The invention relates to a moisture-proof locking system for floor panels which can be joined mechanically; floor panels provided with such a locking system; semi-manufactures for producing such floor panels; and methods for producing such semi-manufactures and floor panels. Exemplary embodiments can be used in mechanical locking systems integrated with the floor panel, for instance, of the type described and shown in WO9426999, WO9966151, WO9966152, SE0100100-7 and SE0100101-5 (owner Välinge Aluminium AB) but is also usable in optional joint systems which can be used for joining of floors.

More specifically, the invention relates to moisture-proof locking systems for floors of the type having a core and a decorative surface layer on the upper side of the core.

2. Field of Application of the Invention

Exemplary embodiments of the present invention can be used for use for floating floors, which are made of floor panels which on the one hand are joined mechanically with a joint system which is integrated with the floor panel, i.e., factory mounted, and, on the other hand, are made up of one or more preferably moisture-proof upper layers of a decorative laminate or decorative plastic material, an intermediate core of fiberboard-based material or plastic material and preferably a lower balancing layer on the rear side of the core. The following description of the state of the art, problems associated with known systems and the objects and features of the invention will therefore, as a non-restricting example, focus first of all on this field of application and, in particular, on laminate flooring made of rectangular floor panels, intended to be mechanically joined on both long sides and short sides. However, it should be noted that the invention can be used in optional floor panels with optional joint systems where the floor panels have a core and are given their final shape by cutting. The invention can thus also be applicable to homogeneous wooden flooring and wooden flooring having two or more layers of wood or fiberboard-based material and a decorative surface layer of wood. Thus, the invention may be applied to floor panels comprising any wood fiber-based material, such as solid wood, plywood, particle board, fiberboard, MDF, HDF etc. Further, the discussion related to moisture penetrating into the joint system from the front side of the floor panel is also applicable to the case of preventing moisture from penetrating into the joint system from the rear side of a floor panel.

BACKGROUND OF THE INVENTION

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

Laminate flooring is usually composed of a core of a 6-9 mm (0.236-0.354 inches) thick fiberboard, a 0.2-0.8 mm (0.008-0.031 inches) thick upper decorative surface layer of laminate and a 0.1-0.6 mm (0.004-0.024 inches) thick lower balancing layer of laminate, plastic, paper and like material. The surface layer provides appearance and durability to the floor panels. The core provides stability, and the balancing layer keeps the panel plane when the relative humidity (RH) varies during the year. The RH can vary between 15% in winter and 90% in summer. The floor panels are usually laid floating, i.e. without gluing, on an existing subfloor which need not be entirely smooth or plane. Any irregularities are eliminated by means of underlay material in the form of, for instance, board or foam which is arranged between the floor panels and the subfloor. Traditional hard floor panels in floating flooring of this type are as a rule joined with the aid of glued tongue-and-groove joints (i.e. joints with a tongue on one floor panel and a tongue groove in an adjoining floor panel) on long side and short side. When laying, the panels are joined horizontally, a projecting tongue along the joint edge of one panel being inserted into a tongue groove along a joint edge of an adjoining panel. The same method is applied to long side as well as short side.

In addition to such traditional floors, which are joined by means of glued tongue-and-groove joints, floor panels have recently been developed which do not require the use of glue and instead are joined mechanically by means of so-called mechanical joint systems. These systems contain locking means which lock the panels horizontally and vertically. The mechanical joint systems can be made by machining the core of a panel. Alternatively, parts of the locking system can be made of a separate material which is integrated with the floor panel, i.e. joined with the floor panel even in connection with the production thereof.

An advantage of floating floors with mechanical joint systems are that they can be easily and rapidly laid by different combinations of inward angling and snapping-in. They can also easily be taken up again and be reused in another place. A further advantage of the mechanical joint systems is that the edge portions of the floor panels can be made of materials which need not have good gluing properties. The most common core material is wood in parquet flooring and in laminate flooring fiberboard of high density and good stability usually referred to as HDF—high density fiberboard. Sometimes MDF—medium density fiberboard—is used as core.

Laminate flooring and also many other floorings with a surface layer of plastic, wood, veneer, cork and the like are produced by a surface layer and a balancing layer being applied to a core material. This application can take place by gluing of a previously manufactured decorative layer, for instance when the fiberboard is provided with a decorative high pressure laminate which has been made in a separate operation where a plurality of impregnated sheets of paper are compressed under high pressure and at a high temperature. The currently most common method in producing laminate flooring, however, is direct laminating which is based on a more modern principle where both production of the decorative laminate layer and the attachment to the fiberboard take place in one and the same step of production. Impregnated sheets of paper are applied directly to the board and are compressed under pressure and heat without gluing.

In addition to these two methods, a number of other methods for providing the core with a surface layer can be used. A decorative pattern can be printed on the surface of the core, which is then, for instance, coated with a wear layer. The core can also be provided with a surface layer of wood, veneer, decorative paper or plastic film, and these materials can then be coated with a wear layer.

The above methods can result in a floorboard element in the form of a large panel which is then sawn into, for instance, some ten floorboards, which are then machined to floor panels. In some cases, the above methods may result in completed floorboards and then sawing is not necessary before machining to completed floor panels is carried out. Production of individual floorboards usually takes place when the boards have a surface layer of wood or veneer.

The above floorboards can be individually machined along their edges to floor panels. Edge machining can be carried out in advanced milling machines where the floorboard is exactly positioned between one or more chains and bands mounted so that it can be moved at high speed and with great accuracy past a number of milling motors which are provided with diamond cutting tools or metal cutting tools which process the edge of the floorboard. By using a plurality of milling motors which operate at different angles, advanced joint geometries can be formed at speeds exceeding 100 m/min (328.08 ft/min) and with an accuracy of 0.02 mm (0.0008 inches).

DEFINITION OF SOME TERMS

In the following text, the visible surface of the completed, mounted floor panel is called "front side", while the opposite side of the floor panel facing the subfloor is called "rear side".

The sheet-shaped starting material that is used is called a "core". By "fiberboard core" is meant a core material containing wood fibers such as homogeneous wood, MDF, HDF, particle board, flake board, plywood and the like. When the core has been coated with a surface layer closest to the front side and preferably also a balancing layer closest to the rear side, it forms a semi-manufacture, which is related to as a "floorboard" or a "floor element".

A "floorboard" is generally of the same size as the floor panel which is to be produced from the floorboard. Thus, the floorboard is generally formed into a floor panel.

The "floor element", on the other hand, is typically so large that at least two floor panels may be produced from it. Thus, the floor element is usually divided into several floor boards, which are subsequently formed into floor panels.

Hence, when the edges of the floorboards have been machined so as to give the floorboards their final shape, including the joint system, they are related to as "floor panels". By "surface layer" are meant all layers that are applied to the core closest to the front side and that cover preferably the entire front side of the floorboard. "Decorative layer" relates to layers that are intended to give the floor its decorative appearance. "Wear layer" relates to layers that are above all intended to improve the durability of the front side.

The outer parts of the floor panel at the edge of the floor panel between the front side and the rear side are related to as "joint edge". As a rule the joint edge has several "joint surfaces" that can be vertical, horizontal, angled, rounded, beveled, etc. These joint surfaces are to be found on different materials included in the floor panel and the joint system, e.g., laminate, fiberboard, wood, plywood, plastic, metal (especially aluminum) or sealing material. "Joint edge portion" relates to joint edge and part of the floor panel portions closest to the joint edge.

By "joint" or "joint system" are meant cooperating connecting means which join the floor panels vertically and/or horizontally.

Laminate flooring and also wooden flooring are often laid in kitchens, hallways and public rooms where they are continually exposed to water, for instance in the form of people walking on the floor with wet shoes and when cleaning the floor with water and the like. In recent years, laminate flooring is being used in bathrooms as well. Laminate and wooden flooring are being sold all over the world and installed in humid climates where the relative humidity may exceed 90%.

When water penetrates into a material or when evaporated or condensed water is to be found on or in materials, it is generally related to as "moisture".

By "moisture-proof material" are generally meant materials which to a limited extent absorb moisture or materials that are not damaged by moisture.

Moisture in Floors

When a laminate floor with a fiberboard-based core is exposed to moisture to a limited extent in the rooms mentioned above, the moisture can penetrate, via the joint between neighboring floor panels, into the upper parts of the joint system closest to the front side and thus penetrate into the core and its wood fibers. If the amount of moisture supplied is small, the water usually evaporates after some time, but, as a result, a permanent swelling of the joint edge portion, rising of the edge of the upper joint edge portion and cracks in the surface layer may arise in particular if the quality of the core is not high and if the laminate is thin. Rising of the edge also causes great wear on the surface layer round the joint edges. In a wooden floor, the joint edges may also swell at a high relative humidity and cause damage to the joint edges.

If the supply of moisture is extensive or if it takes place regularly for a long time, moisture may also penetrate through the entire joint system and into the subfloor and cause considerable damage such as in the form of mold. This may take place even if the floor panel is made of a moisture-proof core since this moisture-proof core can merely counteract swelling of the joint edge portions or prevent moisture from spreading into the core. The moisture-proof core may not prevent moisture from spreading through the joint system and into the subfloor. This moisture migration through the joint system is reinforced if the geometry of the mechanical joint contains many joint surfaces on a floor panel, which do not have contact with corresponding joint surfaces on the neighboring floor panel. Such a geometric design facilitates, for instance, manufacture and facilitates displacements of a floor panel in its locked position along the joint edge of a neighboring floor panel, but such a geometric form may not be advantageous in counteracting the possibility of moisture penetrating through the joint system.

A common misconception is that mechanical joint systems are more sensitive to moisture than traditional joint systems with glue since glue is considered to prevent moisture from penetrating into the joint system. Glued floors with environment-friendly water-based glue systems, however, cannot prevent moisture from penetrating into the joint system. One reason is that glue is found only in parts of the joint system. Another reason is that moisture that comes into contact with the glue layer can dissolve the glue joint. The moisture penetrates through the joint system and the panels come loose in the joint.

Laminate floors and wooden floors could take a considerably greater market share, especially from plastic floors and tiled floors, if they could resist in a better way the effect of high relative humidity and of water on the surface.

Prior-Art Technique and Problems Thereof

When a laminate floor is exposed to water on its surface, a moisture-proof surface layer will counteract that moisture penetrates through the surface and into the core. The limited amount of moisture penetrating through the surface layer and into the core may not cause any damage. However, in the joints, moisture can penetrate between the upper joint edges of neighboring floor panels, and as the moisture passes the moisture-proof surface layer and reaches the significantly more moisture-sensitive core, the moisture can spread into the core and at the same time continue towards the rear side of the floor panel. If the core contains wood fibers, these can swell. As a result, the thickness of the floor panel within the joint edge portion increases and the surface layer rises. This vertical swelling in turn causes damage to the floor. If additional moisture is supplied, the moisture can spread downwards to the rear side until it has passed the joint system and reaches the underlay board and the subfloor. This may cause even greater damage.

Various methods have been used to counteract these problems. Attempts have been made to prevent moisture from penetrating into the floor panel from the joint edge by coating the joint surfaces with a moisture-sealing material, for instance wax or silicone. This type of solution is described in, inter alia, WO9426999 (Välinge Aluminium AB) and EP0903451 (Unilin Beheer B.V.). One has tried to counteract moisture migration from the front side to the rear side of the floor panels along the joint by inserting elastic sealing means between neighboring floor panels. Such solutions are disclosed in, inter alia, WO9747834 (Unilin Beheer B.V.).

Thus use has been made of several methods in order to improve in various ways the possibilities of the joint systems withstanding the effect of water and moisture.

One common method is to make the core of the floor panel of a HDF panel of high quality as regards, e.g., density and protection against moisture. The core's protection against moisture can also be improved by adding specific binders, in many cases in combination with use of special wood fibers when making the core. This method can significantly reduce, but not entirely eliminate, swelling as moisture penetrates. The main disadvantage of this method is the cost. The entire floor panel will have the same high quality although these specific properties are only utilized in a limited part of the floor panel in connection with the joint edge. Another disadvantage is that this method does not afford protection against moisture migration through the joint system from the front side to the rear side of the floor.

It is also known that it is possible to counteract penetration of moisture into the core of the floor panels by spraying on, or otherwise applying to, the joint edges special chemicals which impregnate or reinforce the wood fibers in the joint system. This application of chemicals takes place after the joint by machining has been given is final shape and geometric form. The impregnation can take place immediately in connection with the machining of the edges of the floor panels since it is desirable to use the condition that in this step of production the panel is held in the correct position by drive chains or belts in the machining equipment.

The impregnating materials can be applied in the joint system using different methods which can involve application by spraying, rolling, spreading and the like. A common impregnating material is melted wax and liquids of different kinds such as oils, polyurethane-based impregnating agents and a number of other chemicals which all contribute to counteracting penetration of moisture from the joint edge into the core so as to reduce the risk of swelling as moisture penetrates between the upper joint edges.

Methods of application can be complicated, expensive and give an unsatisfactory result. It can be particularly difficult to provide moisture-proof corners. If application by spraying on a moving floor panel, for instance, starts too late, part of the edge closest to the corner will have no impregnation. If spraying is terminated too late, impregnating liquid will reach the open air, and this will cause undesirable smearing of equipment and also spreading of undesirable solvents or impregnating materials in the air and the room where production takes place. It can also be difficult to impregnate the core at the joint edge immediately under the surface layer without simultaneously causing smearing of the surface of the floor panel closest to the joint edge. It is also difficult to obtain deep and even impregnation in the areas immediately under the surface layer which are most exposed to moisture and swelling. Everything can be made worse by the fact that machining and thus subsequent impregnation take place at very high speeds and with the surface layer of the floor panels facing downwards. Further disadvantages are that the impregnation, especially if it is water-based and environment-friendly, may cause fibers to swell or a layer of solidified impregnating agent to settle in the joint system in such manner that the geometry of the joint is changed in an uncontrolled manner.

Besides the above methods do not result in a reliable seal against moisture migration from the front side of the floor panels along the joint surfaces down to the rear side of the floor panels. Nor can they solve the problem of swelling of upper joint edge portions in wooden floors.

It is also known that is possible to use core materials of plastic which do not swell and do not absorb moisture. This can give a seal against moisture migration horizontally away from the joint between two joined floor panels. However, plastic is disadvantageous since panels of plastic material are considerably more expensive than fiberboard and since it is difficult to glue or directly laminate a decorative surface layer on a panel of plastic material. Moreover machining of plastic is much more difficult than machining of fiberboard-based material for making the connecting means of the floor panels along all four edges. An example of a floor panel having a plastic core is provided in EP1045083A1. An example of a floor panel having connecting means made of plastic materials is provided in U.S. Pat. No. 6,101,778.

The above-mentioned publication WO9426999 (Välinge Aluminium AB) discloses a system for counteracting moisture penetration into the floor panels from the joint edges and for counteracting moisture migration from the front side of the floor panels to their rear side. This publication suggests the use of silicone or some other sealing compound, a rubber strip or some other sealing device which is applied in the joint system before installation. The system according to WO9426999 (Välinge Aluminium AB), i.e., sealing against moisture using a sealing compound or a sealing device, which is applied in the joint in connection with manufacturing, also has drawbacks. The drawbacks are similar to those associated with edge impregnation by spraying or spreading. It is also difficult to handle panels with a smeary sealing compound. The properties of the sealing compound can also change in course of time. If the sealing compound is applied in connection with laying, laying will be difficult and expensive.

One possibility of establishing a seal against penetration of moisture is to insert, in connection with laying, a sealing device in the form of e.g. a sealing strip of rubber into the joint. Also this method is difficult and expensive. When the sealing means is applied in the joint in connection with manufacture, it is not known how the sealing means is to be designed for optimal functions, how the application should take place in a rational manner and how the corners should be designed so that the seal can function along the joint edge of the entire floor panel both on the long sides and on the short sides. The above-mentioned publication WO9747834 (Unilin Beheer B.V.) shows in FIG. 10 how sealing means have been applied in a visible manner between the upper joint edges, so that a narrow gap is to be seen between the neighboring floor panels.

The use of inserted elastic sealing means in joints is known also in connection with the joining of story-high wall elements. This is shown in for instance GB2117813 (Ostrovsky) disclosing a joint system, which, however, is not suitable for floor panels that are to be laid without great visible joint gaps.

Furthermore, it is known to apply a sealing paste or a water resistant glue in a joint between the floor panels as is shown in EP 0665347A1. However, such a procedure would require the seal to be applied at the time the panels are installed. Furthermore it would be associated with most of the drawbacks inherent in floor panels which are connected by means of glue.

It is also known (according to WO 9966152, Välinge Aluminium AB) that it is possible to provide the edge of the core on the long side or the short side with separate materials which are attached to the core and which are then machined to achieve specific functions in the locking system, such as strength, protection against moisture or flexibility. However, it is not known how these materials are to be applied and formed in order to solve the moisture problems described above in an optimal manner.

A specific problem, which is related to moisture penetration in floor panels from the joint edges, arises in connection with wooden floor panels which have several wooden layers with different directions of fibers since wood swells to a greater extent transversely of the direction of fibers than along the direction of fibers. This means that in a wooden floor, which has a surface layer with its direction of fibers in the longitudinal direction of the floor panel and a core having a different direction of fibers, for instance transversely of the floor panel, and which is installed in an environment which is moist or has a high relative humidity, the surface layer will swell to a greater extent in the transverse direction of the floor panel than does the core. As a result, the upper joint edge portions and especially the parts closest to the joint surface will swell and expand parallel with the surface of the floor panel and move the floor panels apart whereas the joint system made in the core largely retains its form. This may cause damage, for instance, by the decorative layer (surface layer) being compressed, the joint system breaking or the locking function of the locking system being wholly or partly lost.

It may therefore be established that moisture problems in connection with joined floor panels are associated with vertical and horizontal swelling of the joint edge portions by moisture penetration through the joint system.

Summing up, it can be said that as regards the providing of a seal against moisture migration in the floor panels from the joint edges, there are a plurality of known methods, none of which provides a result which is satisfactory as regards quality as well as cost. As regards sealing against moisture migration along the joint from the front side to the rear side of the floor panels, known solutions do not allow an integrated design where the panel even in connection with manufacture is provided with a seal that counteracts such moisture migration.

SUMMARY OF THE INVENTION

The invention is based on the understanding that several types of seals may be involved for a moisture-proof locking system for floor panels which can be joined together, viz. "material seal" which counteracts swelling of joint edges, "material seal" and "joint seal" which counteract swelling and moisture penetration through the joint system, "compensation seal" which compensates for swelling and shrinkage of joint edges.

By "material seal" is meant a seal which prevents or counteracts spreading of moisture from the joint edge of a floor panel into the floor panel. By "joint seal" is meant a seal which prevents or counteracts migration of moisture through the joint along the joint surfaces. By "compensation seal" is meant a seal which adjusts to material movements caused by moisture in a floor panel (swelling and shrinkage) owing to changes of the moisture content, for instance by changes in relative humidity in the ambient air, and which counteracts stress under compression and the arising of a visible gap between the upper joint edges of neighboring floor panels owing to such material movements caused by moisture.

As is evident from that stated above, the known solutions to problems caused by the moisture in connection with floor panels and floor materials are not quite satisfactory. Some of the solutions are insufficient as regards the intended effect, others have deficiencies which cause difficulties in connection with manufacture or laying, whereas others are unsatisfactory from the viewpoint of cost.

Therefore an object of the present invention is to eliminate or significantly reduce one or more of the remaining problems associated with moisture sealing in connection with manufacture and use of floor panels. A further object of the invention is to provide a rational and cost-efficient manufacturing method for manufacturing floor panel cores, floorboard elements, floorboards and floor panels.

These and other objects are achieved by floor panels, floors and manufacturing methods having the features that are stated in the independent claims. The dependent claims and the following description define embodiments of the invention.

The invention is especially suited for use in floor panels with mechanical locking systems and in floor panels which are made from board elements which are divided into a plurality of boards before machining. However the invention can also be used for floors with a joint system that is glued and for floor panels that are produced directly as separate floorboards for machining to floor panels and which are thus not manufactured by dividing large board elements before subsequent machining of the individual floorboards.

Thus, according to a first aspect of the invention, there is provided a floor panel, having a body comprising a wood fiber-based core, in which floor panel at least at two opposite parallel joint edge portions have connecting means for mechanical joining of the floor panel in the horizontal direction with similar floor panels, the connecting means having active locking surfaces for cooperation with corresponding active locking surfaces of neighboring floor panels after the floor panel has been joined therewith. The active locking surfaces wholly or partly are made of an elastically deformable material, other than that of the body of the floor panel.

According to a second aspect of the invention, there is provided a system for forming a joint between two adjoining edges of floor panels, which have a core and a surface layer applied to the upper side of the core and consisting of at least one layer, and which at their adjoining joint edge portions have connecting means for joining the floor panels with each other in the vertical direction and whose upper adjoining joint edges meet in a vertical joint plane. At least one of the opposite joint edge portions of the floor panels, when the floor panels are joined together, has a joint seal for counteracting penetration of moisture along the joint surfaces of the joint edges between neighboring floor panels, and that this joint seal is made of an elastic sealing material and secured in at least one of the floor panels, formed in connection with the forming of the joint edges (82, 83) of the floor panels, and compressed when neighboring floor panels are joined together.

According to a third aspect of the invention, there is provided a floor panel having a core and a surface layer applied to the upper side of the core and consisting of at least one layer, the floor panel at opposite joint edge portions having connecting means for joining the floor panel with similar floor panels in the vertical direction, so that joined floor panels have upper joint edges which meet in a vertical joint plane. At least one of the opposite joint edge portions of the floor panels has a joint seal for counteracting penetration of moisture along the joint surfaces of the joint edges between neighboring floor panels, and that this joint seal is made of an elastic sealing material and secured in the floor panel, formed in connection with the forming of the joint edges (82, 83) of the floor panels and is elastically deformed when the floor panel is joined with a similar floor panel.

Thus, according to the first, second and third aspects of the invention, the core can be provided with inserted and fixedly secured elastically deformable materials, which may act as a sealing means and/or as compensation means for swelling or shrinking of the floor panels. The elastically deformable materials are applied in portions that will later will be machined for making the connecting means of the completed floor panel. The elastically deformable material will thus be machined simultaneously as or in connection with the machining of the remaining parts of the joint system. As a result, the elastically deformable material can be made into accurately positioned and accurately dimensioned seals for forming the above-mentioned joint seals or compensation means.

According to a fourth aspect of the invention, there is provided a method of making a core which is intended for production of floor boards or floor elements to be divided into floor boards which in turn are intended for cutting to floor panels with opposite joint edge portions, said core being made of a sheet-shaped material, especially a sheet-shaped wood fiber-based material. The sheet-shaped material within band-shaped areas, from which the connecting means for vertical joining of the floor panels to be are intended to be formed, is provided with grooves extending from a surface of the sheet-shaped material, and that an elastic sealing material is inserted in said grooves.

According to a fifth aspect of the invention, there is provided a method for use in manufacturing a floor panel, the method comprising the steps described above in connection with the fourth aspect of the invention. The elastic sealing material is formed into a joint seal in connection with the forming of the connecting means.

By suitable methods, such as sawing or milling, the core can, before application of the surface layer (for instance a decorative surface layer), be pretreated so that, for instance, one or more grooves are formed in the surface in the areas where edge machining of the joint system will later take place. Subsequently, a suitable sealing material is applied in the groove, suitably by impregnation or extrusion or any other suitable method. The sealing material may form a material seal and/or may have the property of changing into a solid, moisture-proof and elastically deformable material which could be formed to a joint seal. The surface layer can then be applied to the surface of the core over the groove with the sealing material. According to this aspect of the invention, the sealing material can also be applied in a similar way after the application of the surface layer. The groove is then made in the floor element or the floorboard in the surface layer and in the core, or merely in the core of the floorboard. When the floor element is sawn up in floorboards, the edges will contain the sealing material. If the sealing material is applied in a groove or a machined edge part of the floorboard it is preferred that a reference surface is machined in connection with the application of the sealing material. This reference surface could be an outer portion of the edge of the floorboard. The final machining of the locking system and the joint sealing could then be made in a second production step, where the reference surface could be used to position the floorboard in relation to the machining tools. With this method it is possible to position sealing material with a tolerance of about 0.01 mm (0.0004 inches) in relation to the joint surfaces, and the surface of the floor panel. It is possible to position and form a joint sealing in the core and in the lower part of a 0.1-0.5 mm (0.004-0.020 inches) thick surface layer. The joint sealing will protect the wood fiber core and prevent moisture from penetrating trough the locking system. This method makes it possible to apply and form a seal in all types of laminate floors that could be produced with the sealing material. It is obvious that the method could be used for thicker surfaces of, for instance, 1-3 mm (0.039-0.118 inches) plastic and linoleum surfaces. Such a sealing will not be visible from the surface and it will protect the wood fiber core under the moisture proof surface layer. If the sealing material is flexible, it may also prevent moisture from penetrating trough the locking system.

To form a joint sealing it is possible, in principle, to use any known sealing material, which can be applied in liquid form or in semi-liquid form by extrusion, such as foam or the like, and which after application are formable, elastically deformable and moisture-proof. It is an advantage if the sealing materials have properties which allow adhesion to the core. Such adhesiveness, however, is not necessary since the sealing material can also be attached mechanically in, for instance, undercut grooves.

The subsequent machining in the production of the floor panels is carried out in such manner that the sealing material is only partly removed or reshaped. For instance, the sealing material can be formed by cutting into an elastically deformable joint seal which will be exactly positioned along the entire long side and the entire short side and in the corners and also exactly positioned in relation to the surface layer.

The joint seal and especially its active part, which provides the moisture seal, can be formed with an optional outer geometry by cutting which can be made with very narrow tolerances in connection with the rest of the joint system being formed.

If the joint system between the decorative layer and the joint seal also has a material seal, the result will be a floor with floor panels which all have moisture-proof joints on the long sides and the short sides and in the corners. If the floor is also provided with moisture-proof baseboards made of, e.g., plastic material which in connection with the floor have a suitable sealing material or sealing strip, the floor will be quite moisture-proof in all joints and along the walls.

The material seal between the surface layer and the joint seal can, in addition to the above-described impregnation, be provided in many different ways, for instance:

The core can be made of a moisture-proof material. In a direct-laminated floor, the upper part of the core can immediately under the decorative layer be impregnated, e.g., according to what is described below. Impregnating material can also be applied in the grooves of the core where also the joint seal is applied. In a floor of high pressure laminate, the laminate's reinforcement layer of phenol-impregnated kraft paper under the decorative layer can constitute a material seal.

Another alternative is that a moisture-proof plastic layer is applied between the core and the decorative surface layer in the entire panel.

In the same way as the joint seal is applied, also materials with other properties, for instance non-compressible materials, can be applied in order to protect the joint edge and form a material seal.

The material seal can consist of one or more materials which cover the entire core surface and which are also resilient and sound-reducing. The advantage is that it is possible to obtain, at the same cost, a moisture seal, sound reduction and a softer floor. Parts of the joint seal may also constitute a material seal. Finally, the entire joint seal, or parts thereof, can also constitute a material seal. This means that the joint seal may also serve as a material seal with or without impregnation of the core.

As is evident from that stated above, this aspect of the invention is suitable for core materials which are wood fiber-based, e.g., fiberboard-based, but also for moisture-proof core materials, such as plastic and various combinations of plastic and fiberboard-based materials.

As non-limiting examples of materials that can be used to provide a joint seal, mention can be made of acrylic plastic-based materials, elastomers of synthetic rubber, urethane rubber, silicone rubber or the like, or polyurethane-based hot-melt adhesive.

In one embodiment, the floor panels may have a mechanical joint system which for a long time and during swelling and shrinkage of the floor panels holds together the joint edge with the sealing material in close contact with another sealing means or with the other joint edge. The method and the system may also function in a traditionally glued tongue-and-groove joint, but it is considerably more expensive and more difficult to provide a tight joint than with a mechanical joint system.

In connection with laying, it is possible to add glue, sealing material and the like to the above-described joint system for the purpose of, for instance, additionally reinforcing the strength or moisture resistance of the joint in parts of the floor or in the entire floor.

Within the scope of the invention, long sides and short sides can be formed in various ways. The reason may be that the connecting method during laying can be different at long sides and short sides. For instance, the long side can be locked by inward angling and the short side by snapping-in, and this may necessitate different material properties, joint geometries and seal geometries, where one side is optimized for inward angling and the other for snapping-in. Another reason is that each square meter of floor contains considerably more long side joint than short side joint if the panels are elongate. An optimization of the material cost can give different joint designs.

Impregnation and edge reinforcement of the core in certain areas before application of surface layer and balancing layer can also be used on the rear side in order to, for instance, reinforce that part where the lower parts of the joint system are formed. This can be used, for instance, to make a strong and flexible strip or lower lip and a strong looking element when the strip or the lower lip is formed integrally with the core. If, for instance, the strip is made of a material other than that of the core, for instance aluminum, impregnation from the rear side can be used to reinforce critical parts, where the strip is secured or where the panel cooperates with the locking element.

The above described manufacturing methods can also be used to produce a mechanical joint system, which contains elastic locking means. These elastic locking means can be pressed together as adjoining upper joint edges swell and can expand as they shrink. In this way, the horizontal swelling problems and the arising of visible gaps in a dry floor can be counteracted. Since this swelling problem is mainly related to the long side, the corners are not involved in this respect. The elastically deformable material can therefore also be mechanically applied in solid form in the groove for instance by snapping-in or pressing-in into undercut grooves of by gluing to the edge of the groove. Thus these elastic locking means will serve as an "elastic compensation seal".

The above-described manufacturing method of providing a partial material seal in predetermined areas in a core can also be used in connection with manufacture of the sheet-shaped core. Impregnating material is then applied either in the compound of wood fiber and binder which is formed to a core or in connection with the core getting its final shape in the manufacturing process.

According to a sixth aspect of the invention, there is provided a rectangular floor panel having long sides, short sides, a core and a surface layer applied to the upper side of the core and comprising at least one decorative layer, the floor panel adjacent to opposite joint edge portions having connecting means for joining the floor panel with similar floor panels in the vertical direction and in the horizontal direction along the long sides and short sides. The floor panel seen from the front side, adjacent to joint edge portions at least at one long side and one short side has a wear layer, a decorative layer applied under the wear layer, a portion located under the decorative layer and constituting a material seal for counteracting penetration of moisture from the joint edge of the floor panel into the core and an elastically deformable joint seal which is located under the material seal and is fixedly secured in the floor panel and which, when the floor panel is joined with a similar floor panel, counteracts penetration of moisture along the joint surfaces of the joint edges between the neighboring floor panels, and that at least one of the vertical connecting means is made from the core.

According to a seventh aspect of the invention, there is provided a floorboard for use in forming at least two floor panels, the floorboard comprising a wood fiber-based core and a surface layer that is attached to a surface of the core. A groove is provided in the surface of the core and/or in the surface layer, said groove being arranged in a portion of the board where a mechanical locking system is to be formed, and said groove being provided with an elastically deformable material and/or an impregnation agent. The elastically deformable material may be formed into the joint seal described above at least partly in connection with the forming of the connecting means.

According to an eight aspect of the invention, there is provided a floorboard for use in forming a floor panel, the floorboard comprising a wood fiber-based core and a surface layer that is attached to a surface of the core. A groove is provided in an upper edge portion of the floorboard, where a mechanical locking system is to be formed, said groove being provided with an elastically deformable material and/or an impregnation agent.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DESCRIPTION OF PREFERRED EMBODIMENTS

Figure 1A:
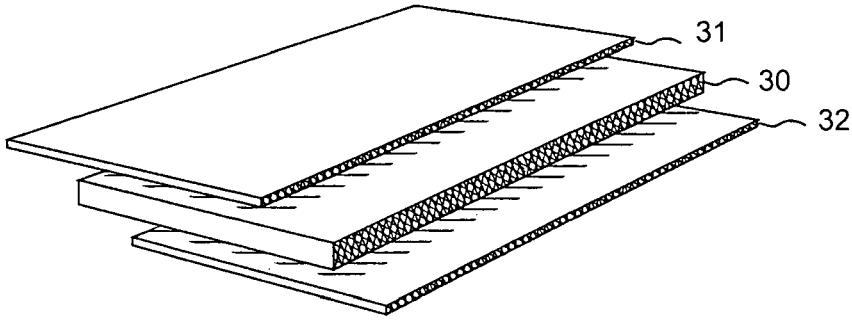
FIGS. 1*a-d* illustrate different steps in the production of a floor panel.
Figure 1B:
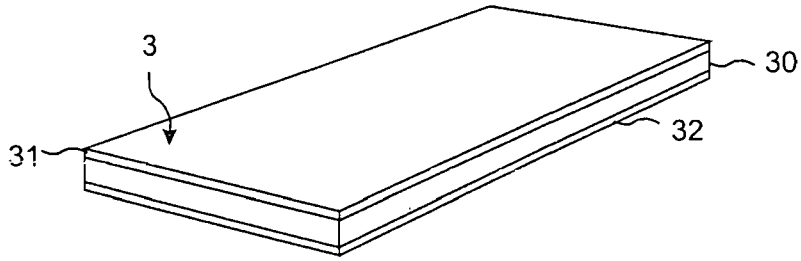
Figure 1C:
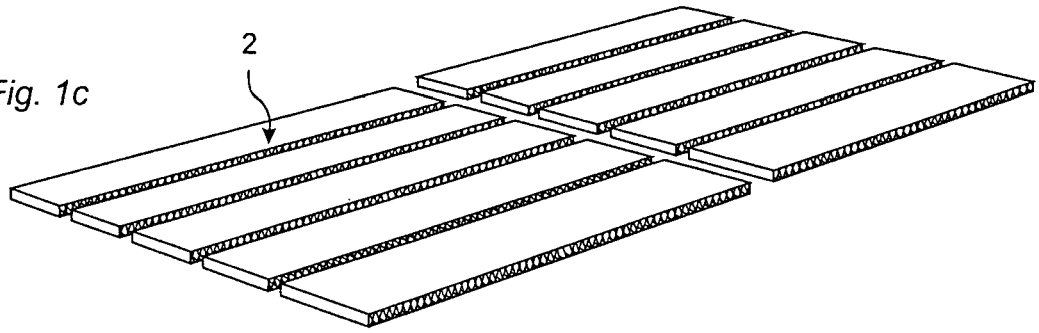
Figure 1D:
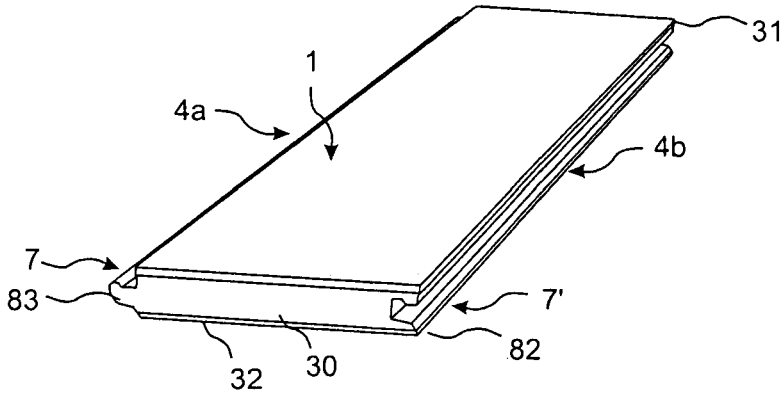

FIGS. 1*a-d* illustrate in four steps the manufacture of a floor panel. FIG. 1*a* shows the three main components surface layer 31, core 30 and balancing layer 32. FIG. 1*b* shows a floor element 3, where the surface layer and the balancing layer have been applied to the core. FIG. 1*c* shows how floorboards 2 are made by dividing the floor element. FIG. 1*d* shows how the floorboard 2 after edge machining obtains its final shape and becomes a completed floor panel 1 with a joint system 7, 7' on the long sides 4*a*, 4*b*, which joint system in this case is mechanical.

Figure 2A:
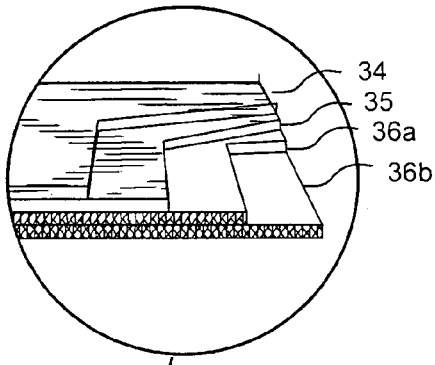
FIGS. 2*a-e* show the composition of a laminate floor with a surface of high-pressure laminate and direct laminate.
Figure 2B:
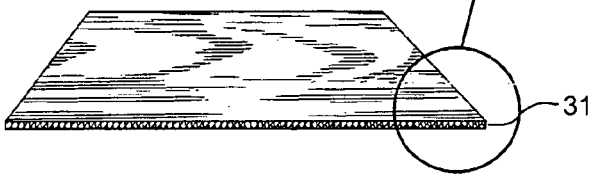

FIG. 2*a* shows manufacture of high pressure laminate. A wear layer 34 of a transparent material having a high wearing strength is impregnated with melamine with addition of aluminum oxide. A decorative layer 35 of paper impregnated with melamine is placed under this layer 34. One or more layers of reinforcement layers 36*a*, 36*b* made of paper core and impregnated with phenol are placed under the decorative layer 35, and the entire packet is placed in a press in which it is caused to cure under pressure and heat to a surface layer 31 of high pressure laminate having a thickness of about 0.5-0.8 mm (0.020-0.031 inches).

Figure 2C:
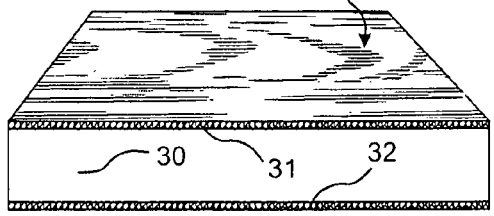

FIG. 2*c* shows how the surface layer 31 and a balancing layer 32 are then glued to a core 30 so as to form a board element 3.

Figure 2D:
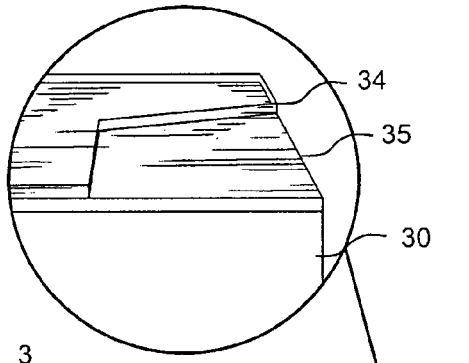
Figure 2E:
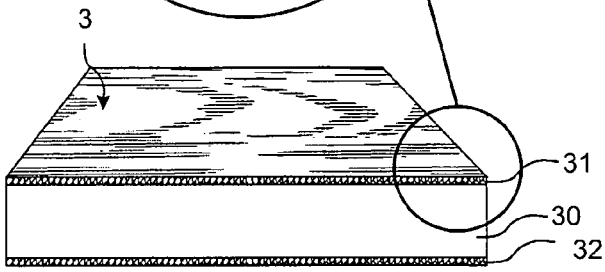

FIGS. 2*d* and 2*e* illustrate direct lamination. A wear layer 34 in the form of an overlay and a decorative layer 35 of decoration paper are placed directly on a core 30, after which all three parts and, also a rear balancing layer 32 are placed in a press where they are caused to cure under heat and pressure to a board element 3 with a decorative surface layer 31 having a thickness of about 0.2 mm (0.008 inches).

Figure 3A:
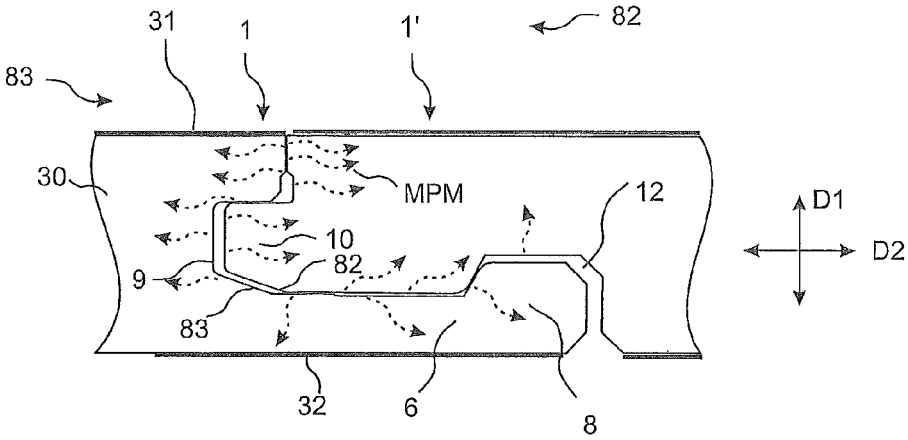
FIGS. 3*a-c* illustrate examples of different mechanical joint systems and moisture migration.
Figure 3B:
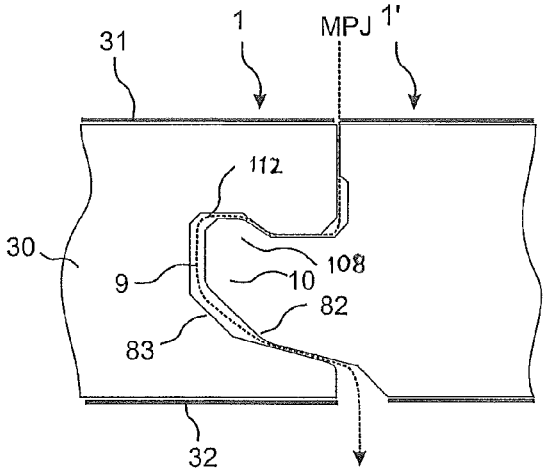
Figure 3C:
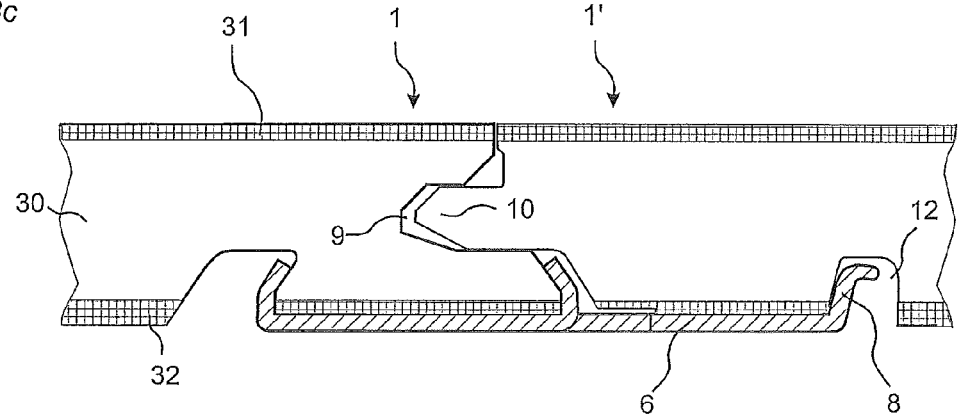
Figure 4A:
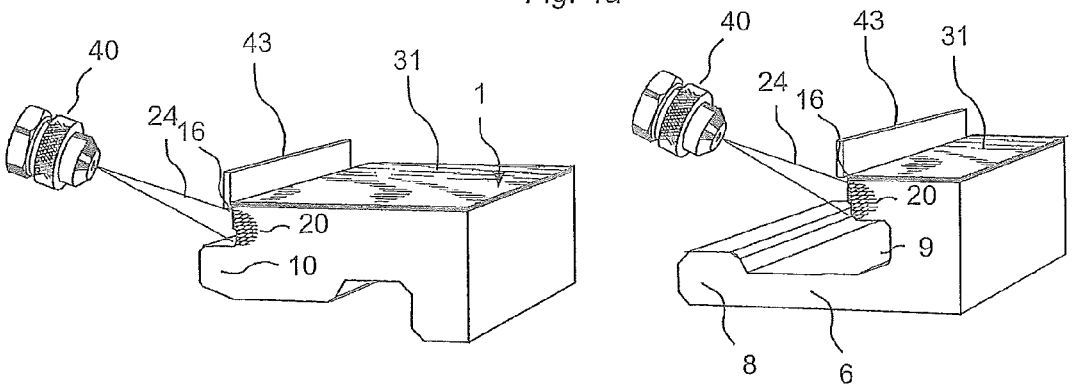
FIGS. 4*a-d* illustrate impregnation of an edge according to prior-art technique.
Figure 4B:
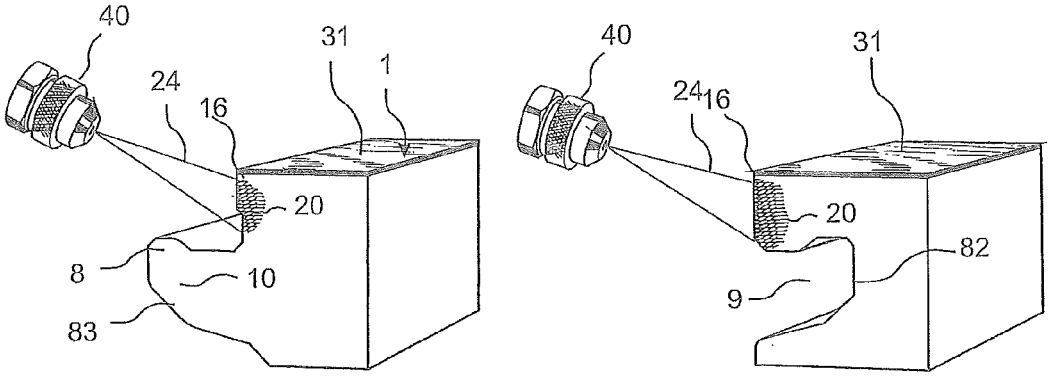
Figure 4C:
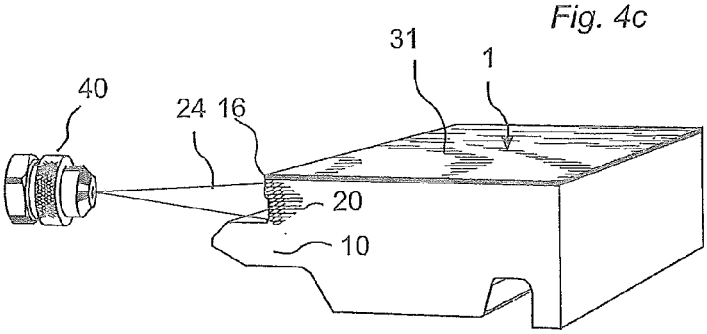
Figure 4D:
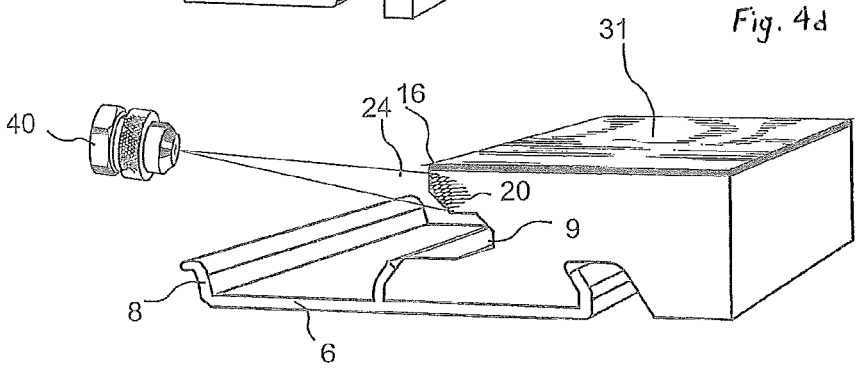

FIGS. 3*a-c* illustrate prior-art mechanical joint systems and how moisture, according to studies made by the inventors, affects the joint systems.

In FIG. 3*a*, the floor panel 1 consists of a direct-laminated surface layer 31, a core 30 of fiberboard-based material (HDF) and a balancing layer 32. The vertical locking means which locks the panels 1 and 1' in the D1 direction, consists of a tongue groove 9 and a tongue 10. The horizontal locking means which locks the panels parallel with the surface layer 31 in the D2 direction consists of a strip 6 having a locking element 8 which cooperates with a locking groove 12. The strip is made by machining of the core 30 of the floor panel and is therefore in this embodiment of the invention formed integrally with the core 30. Dashed arrows MPM indicate how moisture can penetrate from the joint edge into the core 30 as moisture penetrates into the joint system from the front side or upper side of the floor.

FIG. 3*b* illustrates an embodiment where both the vertical and the horizontal locking means are formed as a tongue groove 9 with a locking groove 112 and a tongue 10 with a locking element 108. The dashed arrow MPJ illustrates how moisture can penetrate through the parts of the locking system.

In FIG. 3*c*, the floor panel is provided with a surface layer 31 of high pressure laminate, a core 30 of HDF and a balancing layer 32 of high pressure laminate. Also in this embodiment, the vertical locking means consists of a tongue groove 9 and a tongue 10 which are made from the core 30 of the floor panel. The horizontal locking means consists of a strip 6 and the locking element 8, which are made of aluminum and mechanically attached to the core 30.

In the above cases, the joint systems are integrated with the core, i.e., formed or mounted at the factory, and at least part of the joint system is always made by cutting of the core 30 of the floor panel. The locking systems can be joined by angling, horizontal snapping or snapping in an upwardly angled position.

FIGS. 4*a*-4*d* illustrate impregnation of joint edges 82, 83 according to prior-art technique, the machined joint being impregnated by an impregnating material 24 being applied sideways by spraying.

To facilitate the understanding, the floor panels are in all figures illustrated with their surface layer directed upwards. In the actual production, the floor panels can however, be oriented with their front side (upper side) directed downwards in the processing machinery and in the subsequent impregnation.

In the prior-art type of impregnation, the floor panel is moved passed a stationary spray nozzle 40. It is difficult to direct the jet of impregnating material 24 so that the edge of the jet is placed immediately under the surface layer 31 in connection with the upper adjoining joint edges 16 with a view to making a material seal 20.

Even if the application can take place using protective plates 43 which protect the surface, it is difficult to provide an efficient protection. The strip 6 and the locking element 8 are in many cases an obstacle, and it is difficult to apply the impregnating material 24 with sufficient accuracy and to obtain sufficiently deep penetration into the area immediately under the surface layer 31 at the upper adjoining joint edges 16. Thus the impregnating depth varies and is smaller immediately under the surface layer and furthest away from the surface layer, as is evident from FIGS. 4*a*-4*d*.

Figure 5A:
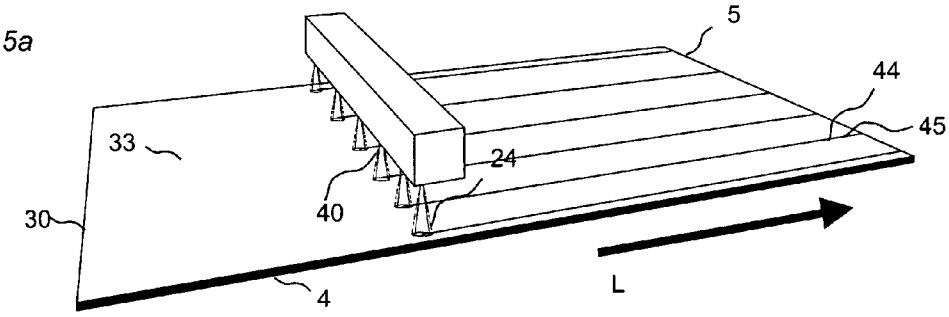
FIGS. 5*a-c* show impregnation to form a material seal according to the invention.
Figure 5B:
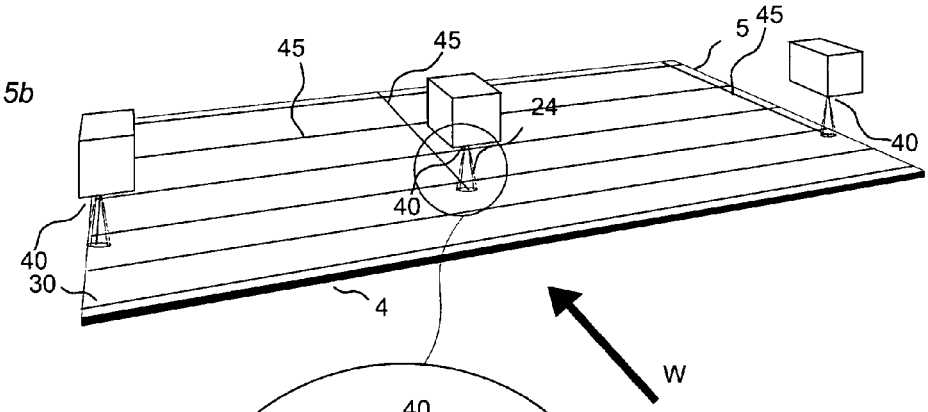
Figure 5C:
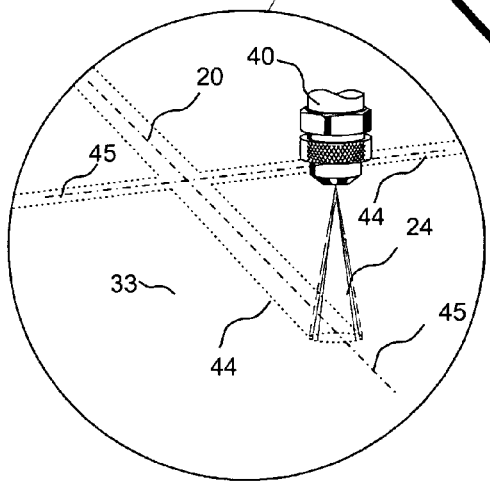

FIGS. 5*a*-5*c* illustrate impregnation to make a material seal according to the invention. The impregnating material 24 is applied in a suitable fashion in band-shaped areas 44 on the core surface 33, before the remaining layers, i.e., the decorative and the wear layer are applied. The application can take place, for instance, by being sprayed, rolled on etc. conveniently first in the longitudinal direction L in zones where the long sides of the floorboard are later to be formed.

Suitably one long side 4 of the core 30 is used as a guide surface which is then also used as guide surface to facilitate the positioning in connection with application of the surface layer 31, sawing up and machining. In this way, it will be easier to ensure that the material seal 20 is correctly positioned in relation to the completed joint edge.

FIG. 5*b* illustrates the corresponding impregnation of the parts that will later constitute the short sides 5 of the floorboards. In this impregnation, the core is moved in the transverse direction W perpendicular to the longitudinal direction L. Also in this case, one short side 5 of the core 30 can be used as guide surface in the subsequent manufacture.

FIG. 5*c* shows an enlargement of a portion that will constitute corners of the floor panel and that will be fully impregnated parallel with the long side to be as well as the short side to be. The parting lines 45 indicate the saw cuts along the long side and the short side for dividing the board element into floorboards.

Figure 6A:
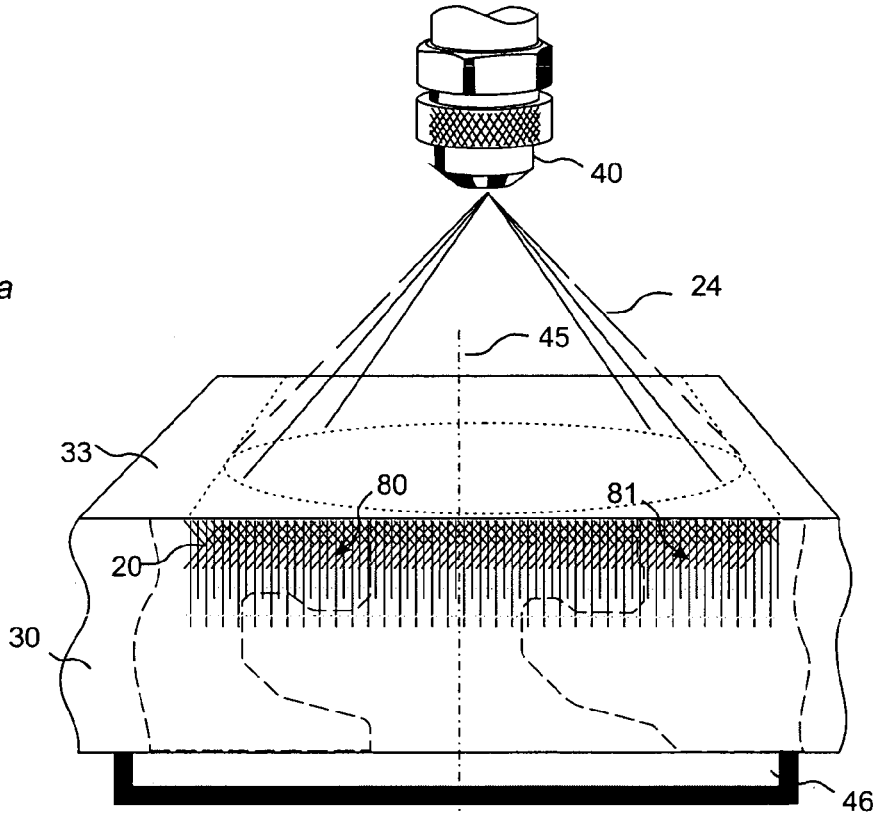
FIGS. 6*a-c* show impregnation of upper joint edges according to the present invention.
Figure 6B:
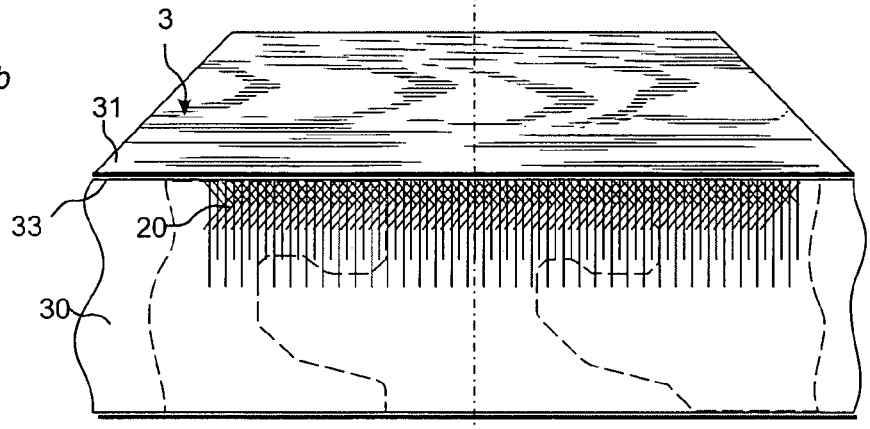
Figure 6C:
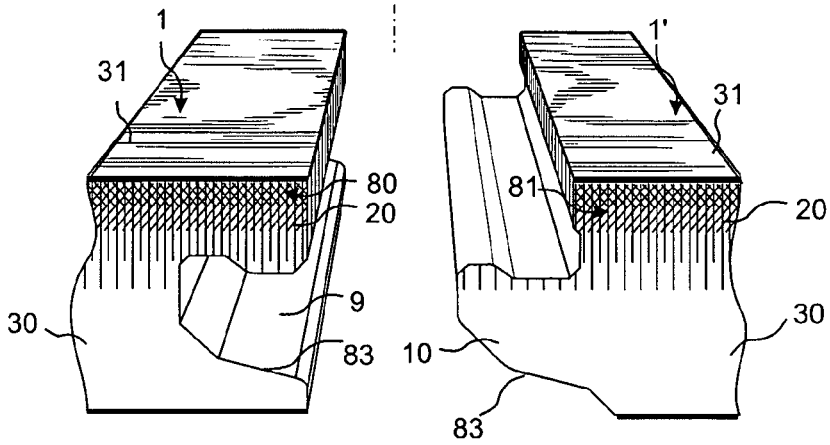

FIGS. 6*a*-6*c* illustrate in greater detail how the impregnation is carried out and penetrates into the core and how the impregnating area is positioned relative to the connecting means to be, which are indicated by dashed lines in FIGS. 6*a* and 6*b*. FIG. 6*c* shows the edges of two floor panels which are made of the board element after this has been cut into individual floorboards by sawing along the line 45.

FIG. 6*a* shows how the impregnating material 24, when being applied by means of a spray nozzle 40, will penetrate into the core 30 from the core surface 33 and towards the central portion of the core in order to form a material seal 20.

The penetration of the impregnating material 24 into the core 30 can be facilitated by establishing a vacuum on the underside of the core by means of a vacuum device 46. The vacuum device 46 may consist of, for instance, a stationary vacuum table or moving vacuum bands. If the core 30 is stationary during the application of the impregnating material 24, for instance moving spray nozzles 40 are used.

FIG. 6*b* shows how the impregnating material 24 is positioned in the core 30 of the board element 3 after application of the surface layer 31. The impregnating material then constitutes a material seal 20. The parting line 45 indicates the intended saw cut.

FIG. 6*c* shows the joint edges 82, 83 of the floor panels 1, 1' after machining. In order to simplify the illustration, the floor panel has a mechanical joint along one side only. The material seal 20 will be exactly positioned along the two perpendicular sides and in the corner, and in the shown embodiment it is to be found in the upper joint edge portions 80, 81.

A fiberboard-based core 30, e.g. HDF, is produced by ground wood fibers being mixed with a binder, such as melamine, after which a panel is formed by means of pressure and heat. Alternatively, the impregnating material 24 can be applied to the panel in connection with this production, the application taking place within special portions which will later constitute joint portions in the floor panel.

FIGS. 7*a*-7*d* illustrate in detail the different production steps to produce a material seal 20 in a mechanical joint system.

Figure 7A:
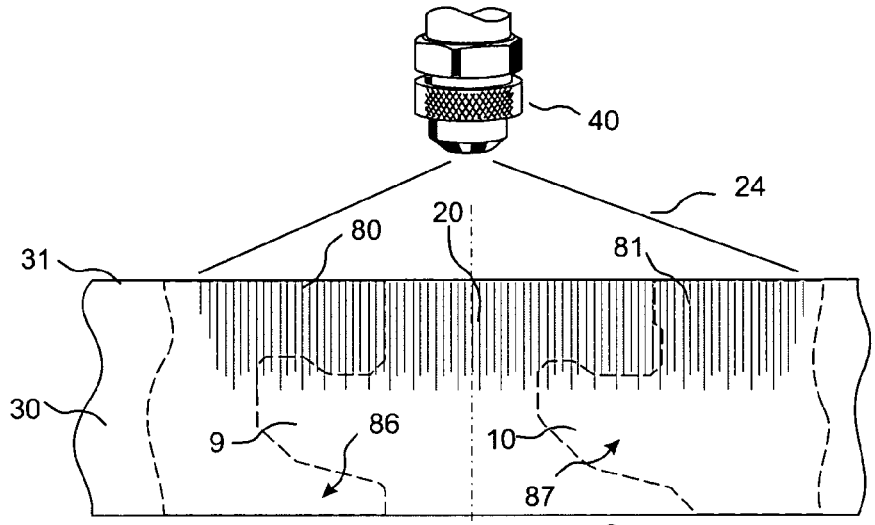
FIGS. 7*a-d* illustrate an embodiment of a material seal according to the invention.

According to FIG. 7*a*, impregnating material 24 is applied from the core surface 33 in the portions 86, 87 (dashed) which in the completed floor panel will constitute joint edge portions which are generally designated 86 and 87 and in which the joint system 9, 10 is formed. A considerable part of the upper joint edge portions 80, 81 is impregnated so as to form a material seal 20.

Figure 7B:
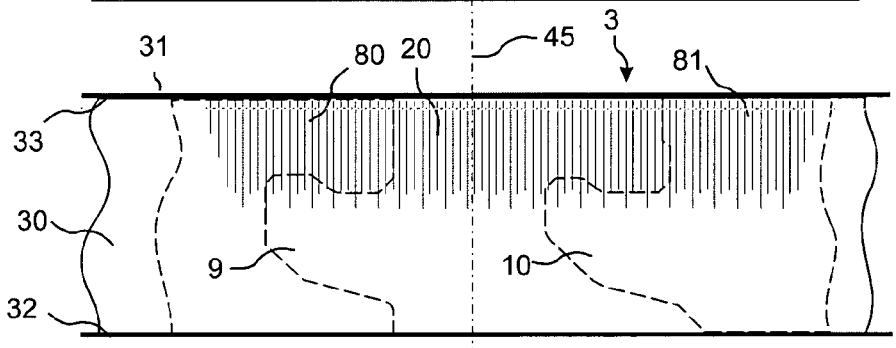

FIG. 7*b* shows the floor element 3 with a surface layer 31, a balancing layer 32 and a material seal 20 in the core 30 under the surface layer 31. The Figure also shows the intended saw cut 45 and the contours of the final connecting means by dashed lines.

Figure 7C:
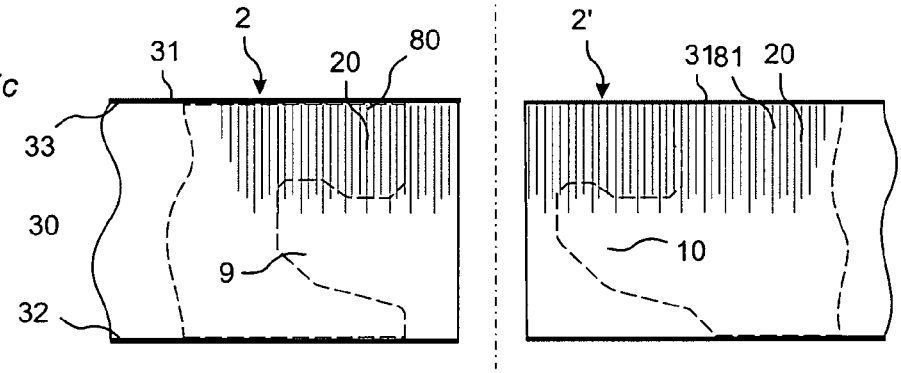

FIG. 7*c* shows the edges of the floorboard 2, 2' after sawing up. The sawing tolerance does not affect the final position of the material seal 20 closest to the joint edge. In the subsequent machining, no additional equipment is required to provide a material seal 20 in the upper joint edge portions 80, 81 of a locking system since this material seal has been provided even before the application of the different surface layers to the core 30.

Figure 7D:
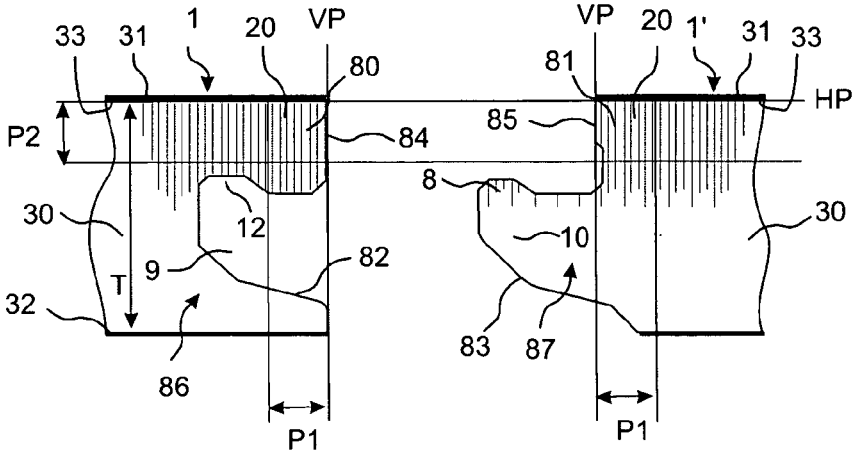

FIG. 7*d* illustrates the machined joint with a material seal 20 immediately under the surface layer 31. HP designates a horizontal plane parallel with the surface layer of the panel. The joint edges of the floor panel 1, 1' are generally designated 82, 83 and can have an optional joint system. In the shown embodiment, the joint edges are formed as a mechanical tongue-and-groove joint which can be locked by inward angling and snapping-in. VP designates a vertical plane (joint plane) which extends perpendicular to the horizontal plane HP at the upper joint edges 80, 81 closest to the surface layer. T indicates the thickness of the floor panel. The largest amount of impregnating material 20 is to be found in the upper joint edge portions 80, 81 immediately under the wear layer 31, i.e. within the area which is most critical in the viewpoint of moisture. This concentration of impregnating material immediately under the wear layer 31 is obtained as a result of the impregnating material being caused to penetrate into the core from the core surface during impregnation.

The material seal 20 in the upper joint edge portions 80, 81 is not only to be found in the core surface 31 closest to the surface layer 31 between the vertical plane or joint plane VP and a lower plane at a distance P2 from the core surface 33, but also all the way in the horizontal direction from the vertical plane VP to a plane at a distance P1 from the vertical plane VP. This entire volume of the core 30 under the core surface 33 is thus impregnated so as to form the material seal 20. Such a location and extent of a material seal cannot be provided by means of the known impregnating methods in which impregnating material 24 is applied to or sprayed onto the upper joint edges 84, 85 at the vertical plane VP when these upper joint edges are already provided with a surface layer 31 and machined to their final shape.

Since the impregnating material 24 penetrates from the core surface 33, the concentration of the impregnating material will be particularly high closest to the core surface 33. In the normal case, the concentration of impregnating material decreases downwards from the core surface 33, as shown schematically in FIGS. 4*a*-4*d*.

The material seal 20 can, because of the expense, be limited to a part of the floor panel 1 where the intended connecting means are formed, and therefore, in an exemplary embodiment, does not cover the entire core surface 33.

A material seal 20 can be provided under the surface layer 31 in a considerable portion of the parts of the joint system. Regarding the extent of the material seal in the transverse direction, i.e., transversely of the joint plane VP and along the horizontal plane HP, it can be mentioned that P1 may exceed 0.2 times the floor thickness T and, without difficulty, may amount to 1 time the floor thickness T or more. In many embodiments, the distance P1 can be so great that all parts of the joint edge portion which contain parts of the connecting means of the floor panel are impregnated with the material seal 20.

The impregnating depth, i.e. the distance P2, can conveniently be 0.1-0.3 times the floor thickness T. Preferably, the impregnating depth is such that at least upper parts of the connecting means will consist of impregnated core material.

The material seal 20 of the joint system is located in the core surface 33 at the vertical plane VP and at a distance P1 from VP and that the sealing properties within this area are approximately equivalent or homogeneous, i.e., the core surface 33 has been coated with approximately the same amount of impregnating material 24 per unit of volume of core material 30. As illustrated in FIGS. 4*a*-4*d*, the concentration of impregnating material decreases from the joint edge at the vertical plane VP and inwards to the panel parallel with the surface layer 31 at the distance P1 and where the impregnating depth in the horizontal plane will be smaller closest to the core surface 33 and greater at a distance therefrom.

FIGS. 8*a*-8*e* illustrate a different embodiment of the invention. In this case, a groove 41 is formed in the core surface 33, for instance in the area where the upper and inner part of the tongue 10 will later be formed. In the groove 41*a* sealing material 50 is then applied, which has the property that after application it will have a solid form, be moisture-proof, be elastically deformable and may be shaped by cutting.

Figure 8A:
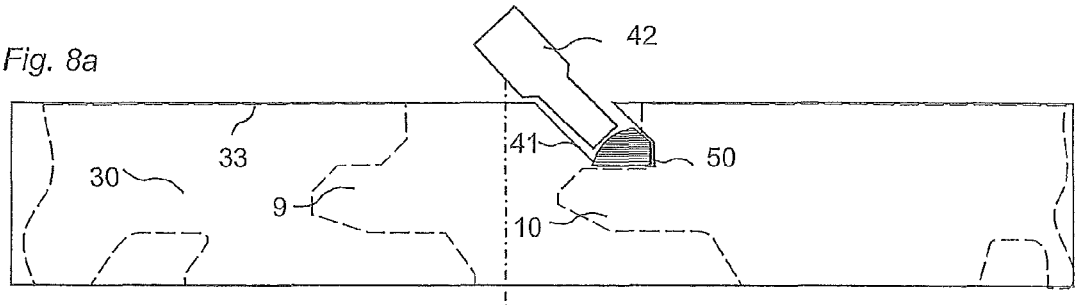
FIGS. 8*a-e* illustrate the making of a joint seal in a mechanical joint system according to the invention.
Figure 8B:
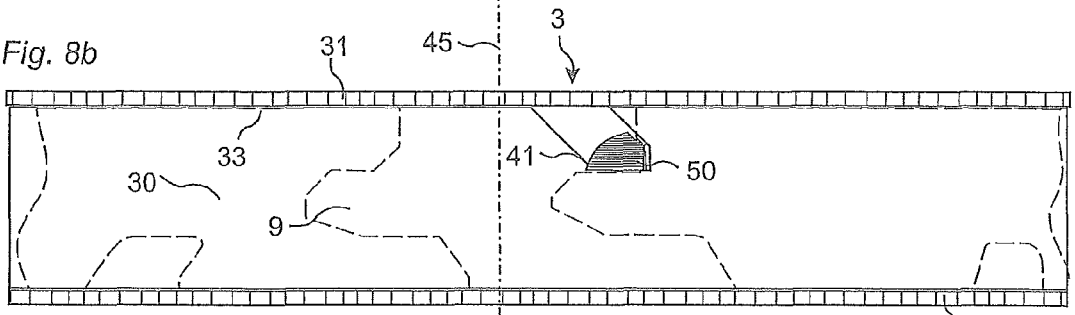
Figure 8C:
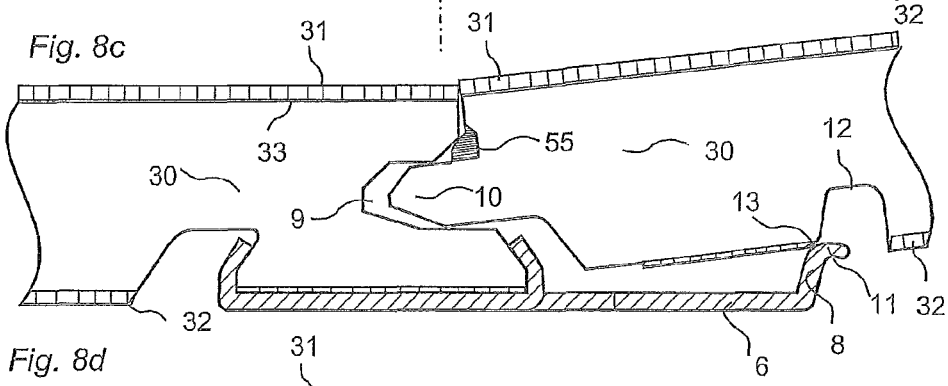
Figure 8D:
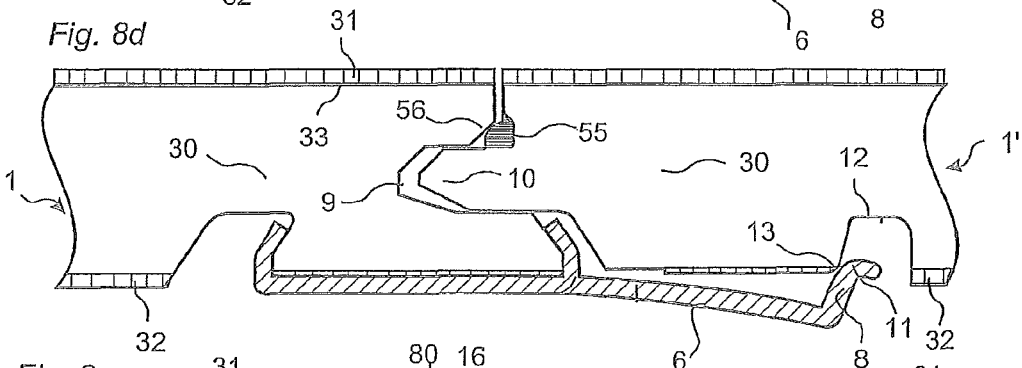
Figure 8E:
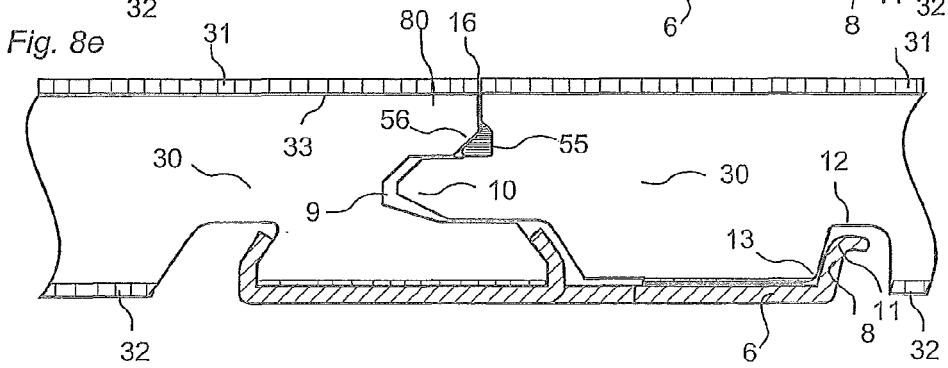

As shown in FIG. 8*b*, the core 30 with the groove 41 and the sealing material 50 is then coated with a surface layer 31 and preferably also with a balancing layer 32 to form a floor element. Then the floor element 3 is sawed up in floorboards by cutting along the line 45 and is machined to floor panels 1, 1' with joint systems. These floor panels are shown in FIGS. 8*c*-8*e*, and the joining of the floor panels according to this specific embodiment will be described in more detail below.

As described above, the groove 41 could also be formed in a floor element or floor board which comprises a surface layer 31, 32 that is bonded to the core 30. This means that the groove 41 may be formed both in the surface layer 31, 32 and in the core 30. This groove 41 could be impregnated and/or provided with a sealing material 50. This method offers the advantages that a standard floor element could be used and impregnation materials could be applied, which may be difficult to use in connection with gluing or lamination of the surface layer 31, 32 to the core 30.

The sealing material 50 is formed to a joint seal 55, preferably by cutting by means of tools which are especially adapted to form elastically deformable synthetic materials.

As mentioned above, a large number of sealing materials that can be used are available on the market. As a non-limiting example, materials having the following properties can be used.

A sealing compound based on acrylic plastics, elastomers of synthetic rubber, silicone rubber or the like, which have the properties that they can be applied in the groove 41 as a compound by extrusion, that they can adhere to the core material (optionally after applying a primer layer thereto), that they have good heat resistance, that they are moisture-proof, that they can resist detergents, and that after application they can be cured or dried and change into a solid, elastically deformable form. The properties of the materials are both sufficiently elastically deformable and preferably at the same time can be machined rationally by means of cutting tools.

Different types of polyurethane-based hot-melt adhesives that are applied by being heated and extruded can also be used to form the joint seal. When such materials solidify, they change into a solid, elastically deformable form. These materials can later be formed by cutting but also by using heated rolls or drag tools of a suitable form, which are moved along and in contact with the sealing material 50 to shape this to a suitable geometry.

Combinations of cutting rough machining and final forming by means of hot scraping or rolling tools are also possible as is also a two-step application, where the first application is carried out with a highly liquid material that penetrates into the core, and where the subsequent second application takes place with a material which is more viscous and has good adherence to the former material. It is also possible to use different types of primer system to improve the adhesion of the joint sealing material to the floor panel.

Different materials, methods of application and methods of forming can be used on opposite joint edges and respectively on the long side and the short side for the purpose of optimizing function and cost.

FIG. 8*c* shows the machined joint edge with a mechanical locking system 9, 10, 6, 8, 12 and an elastically deformable joint seal 55. The joint seal 55 is compressed in connection with the laying of the floor panel. In this embodiment, which shows inward angling, the compression and the deformation begin only when the locking element 8 is already in initial engagement with the locking groove 12 and when the tongue 10 is already in engagement with the tongue groove 9. Both the vertical and horizontal locking functions in the mechanical locking system are thus active as the compression proceeds. As a result, the compression in connection with laying can take place by applying an extremely small amount of force, and the need for compression therefore does not render laying difficult.

FIG. 8*d* shows how two floor panels 1, 1' are joined by snapping-in, where compression of the joint seal 55 can take place in the same manner as described above by interaction between a tongue groove 9 and a tongue 10 and where lateral displacement along the joint plane has been facilitated and where a flexible strip 6, a locking element 8 and a locking groove 12 cooperate in the compression of the joint seal and therefore will compress the joint seal in connection with snapping-in.

The joint seal 55 can be formed so that the compression can start when the guide part 11 of the locking element 8 engages the guide part 13 of the locking groove 12. This engagement can be facilitated if the guide part 11 of the locking element is formed as a rounded or beveled part in the upper portions of the locking element. The guiding as well as the compression can also be facilitated if the locking groove 12 is formed with a correspondingly rounded guide part 13 in the lower part of the locking groove 12 closest to the joint edge.

In connection with laying, the joint seal 55 is pressed against an opposite cooperating joint surface 56 in the joint system. In the embodiment illustrated in FIGS. 8*a*-8*e*, this joint surface 56 has an inclination of 45 (to the horizontal plane HP of the panel. This is illustrated in FIG. 8*e*. The pressure applied by the joint seal 55 will therefore be uniformly distributed on the vertical 9, 10 and horizontal 6, 8, 12 locking means of the joint system. This is advantageous since it is desirable to reduce the pressure both in connection with laying and in the locked position. Excessive pressure horizontally in the locked position may result in the floor panels separating and the joint obtaining an undesired joint gap at the adjoining upper joint edges 16. Excessive vertical pressure in the locked position may result in rising of the joint edge portion 80 in the upper part of the tongue groove 9.

FIGS. 9*a*-9*d* show how the material seal 20 and the joint seal 55 can be combined to a moisture-proof locking system. In this case, a groove 41 has been formed in the upper side of the core 30 after impregnation to form the material seal 20.

In this embodiment, both the tongue groove side 9 and the tongue side 10 have been provided with sealing material 50*a*, 50*b*. The impregnating material 24 serves as binder and increases the strength of the core 30. In this embodiment (see FIG. 9*a*) the impregnating material 24 has been applied in several areas on the core 30. These areas will constitute a material seal 20 and also a material reinforcement of the upper joint edge portions 80, 81. The impregnation can also provide an edge reinforcement 21*a*, 21*b* in the portions where the strip 6 is attached and in an area 21*c* in the core 30 adjacent to the locking groove 12 where the locking groove 12 cooperates with the locking element 8.

Figure 9A:
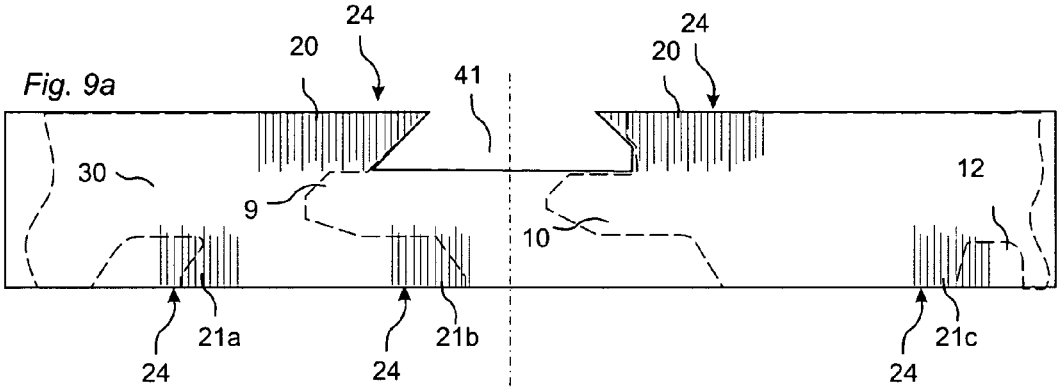
FIGS. 9*a-d* illustrate the making of a mechanical joint system with material seal and joint seal as well as edge reinforcement of parts of the joint system according to the invention.
Figure 9B:
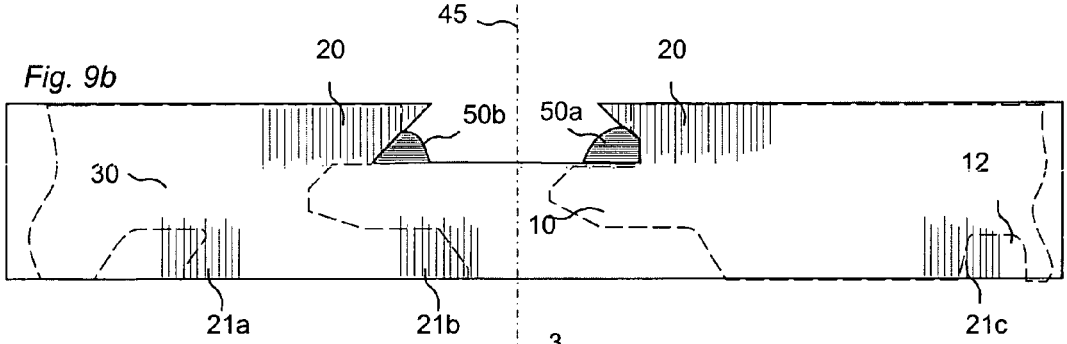
Figure 9C:
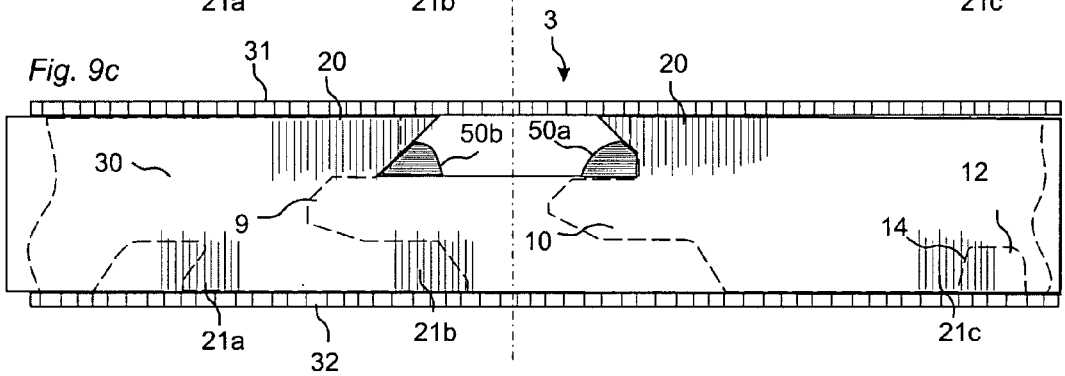
Figure 9D:
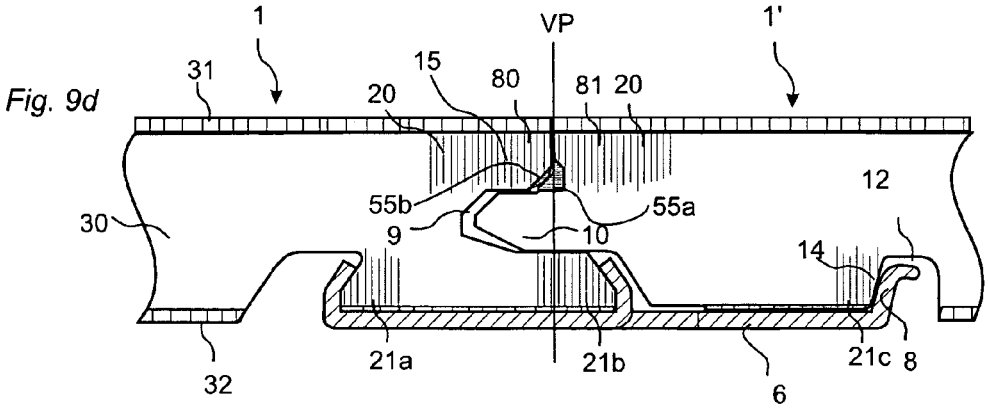

FIG. 9*b* shows how the sealing material 50*a*, 50*b* can be applied in the groove 41. Once the core 30 has been provided with a surface layer 31 and a balancing layer 32 (FIG. 9*c*), the joint edge and the sealing material 50*a*, 50*b* are formed to a joint seal 55*a*, 55*b* (FIG. 9*d*). As mentioned above in connection with FIG. 8*b*, the sealing material could be provided in a groove that is made in both the surface layer 31, 32 and in the core 30.

The strip 6 can be formed and fixed to the core 30 in different ways [for instance as shown and described in EP1061201 (Välinge Aluminium AB) or WO9824995 (Välinge Aluminium AB)], so that the mechanical locking system for locking together the floor panels 1, 1' in the vertical and horizontal directions will comprise the tongue 10 and the tongue groove 9; the joint seals 55*a* and 55*b*; the material seal 20; the strip 6 with its locking element 8; the edge-reinforced fixing parts 21*a*, 21*b* for the strip 6; and an edge-reinforced locking surface 14 in the locking groove 12.

The floor panels 1, 1' according to this embodiment will then have upper joint edge portions 80, 81 which in the vertical plane VP have a reinforced material seal 20 immediately under the surface layer 31 and joint seals 55*a*, 55*b* in connection with the material seal 20. The material seal 20 and the joint seals 55*a*, 55*b* together with the moisture-proof surface layer 31 counteract that moisture penetrates into the core 30 and that moisture penetrates through the joint system. This results in a moisture-proof floor. As mentioned above, the vertical 9, 10 and horizontal 6, 8, 12 locking means should be designed in such manner that they can hold the elastically deformable joint seals 55*a*, 55*b* compressed and elastically deformed during the life of the floor without the locking means being deformed. The tongue groove 9 is not to be too deep in the horizontal direction and for the upper part or lip 15 of the tongue groove can be rigid so as not to rise. Moreover the locking element 8 and the strip 6 can be designed in such manner that they can resist the pressure applied by the joint seals 55*a*, 55*b* without the floor panels 1, 1' separating while forming a visible joint gap adjacent to the upper joint edge portions 81, 82. The sealing material 50*a*, 50*b* can also be selected so that during the entire life of the floor it exerts a pressure and prevents moisture migration through the joint system.

As appears from FIG. 9*d*, the core 30 is impregnated and reinforced in the areas 21*a*, 21*b* and 21*c* where the strip 6 is fixed and where the locking element 8 locks against the locking groove 12. This can allow use of less expensive core material 30, which can be of lower quality and which by means of impregnation is reinforced to obtain greater strength in the critical areas. In this manner, high quality can be combined with low cost.

A plurality of variants of this moisture-proof locking system are conceivable. The joint seals 55*a*, 55*b* can be optionally arranged in the joint system, but it is advantageous if the joint seal is arranged invisibly from the surface close to the surface layer 31. They can be optionally arranged on the tongue groove side 9 or on the tongue side 10, and they can, like in the embodiment shown, be found in both joint parts. Of course, several joint seals 55 can be arranged on each joint part above and beside each other. Moreover, the contact surface between the joint seal 55 and the opposite part in the joint system can be designed in an optional manner with geometries that are, for instance, toothed, triangular, semicircular and the like. Basically all the forms that are normally used when designing sealing strips of elastic synthetic material or rubber can be used.

Using vacuum technique as described in connection with the embodiment according to FIG. 6*b*, the entire joint system from the surface layer 31 to the balancing layer 32 can be provided with a material seal and edge reinforcement 20. This can increase the joint's strength and protection against moisture, give the machined strip better flexibility, enable machining to obtain smoother surfaces and enable a reduction of the frictional forces when displacing one floor panel relative to another in the locked position. It is also possible to impregnate wood fibers with plastic material in such manner that the wood fibers, together with the impregnating material, will have such properties that they can be formed to a joint seal.

As described above, the sealing material 50*a*, 50*b* and/or 20 can alternatively be arranged in grooves which can also be made in the floor element 3 or in the floorboard 2 before the connecting parts are made. The groove 41 can then be made in both the core 30 and the surface layer 31.

Sealing material 50*a*, 50*b* can also be arranged at the edge of the floorboard 2 or the floor panel 1 when the entire joint system or parts thereof have been made, and the final forming of the joint seal 55*a*, 55*b* can also take place in a separate manufacturing step when the floor panel 1 has already obtained its final shape.

By changing the angle of the pressure surfaces between the elastically deformable joint seals 55*a*, 55*b*, the direction and distribution of the compression pressure can be adjusted between fully horizontal and fully vertical direction. It is an advantage if the pressure surfaces are not perpendicular but are inclined in relation to the horizontal plane HP, so that the pressure is distributed with vertical and horizontal components, so that the distribution of pressure is optimized in relation to the possibilities, afforded by the combinations of materials, of forming a rigid upper tongue groove part 15 and a strong horizontal joint 6, 8, 12.

Figure 10A:
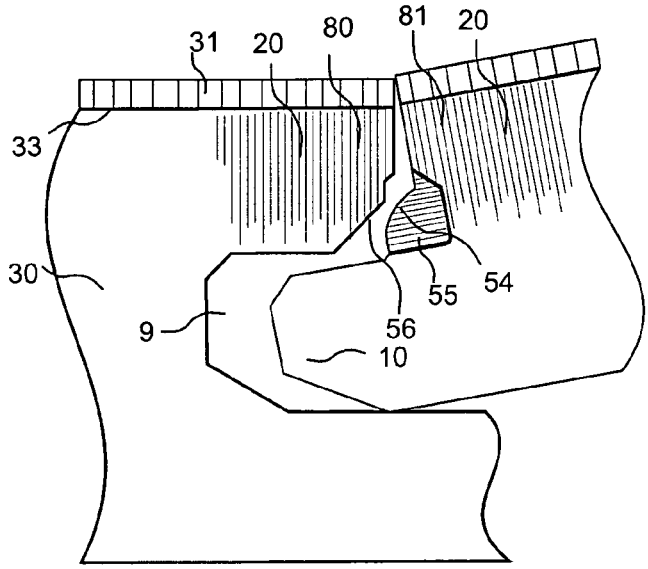
FIGS. 10*a-c* illustrate compression of a joint seal according to the invention.
Figure 10B:
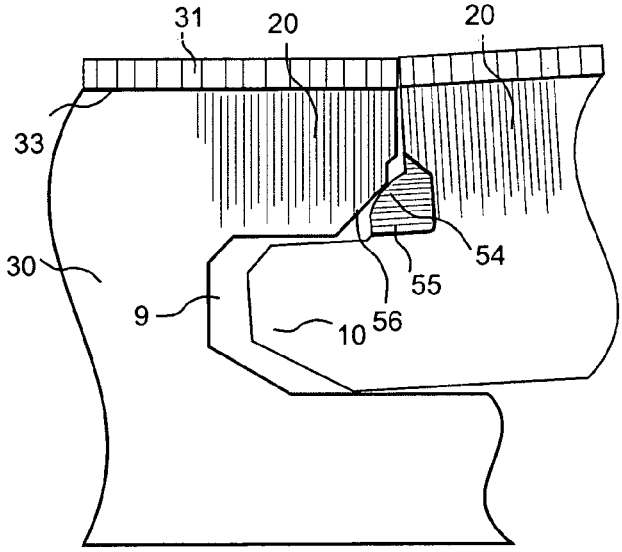
Figure 10C:
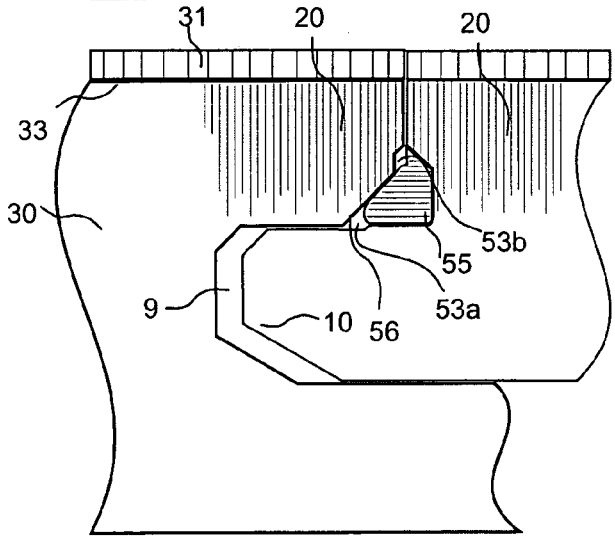

FIGS. 10*a*-10*c* illustrate in detail how compression can be achieved in connection with inward angling. The active part 54 of the joint seal 55 is formed with a convex outer part which starts to be compressed when the locking groove 12 engages the locking element 8. Such a position is shown in FIG. 10*b*. In connection with the final downward angling and locking, the final compression of the joint seal takes place against an opposite cooperating joint surface 56. The joint surface 56 can be coated with, for instance, wax or other similar materials after the joint system has been formed. This can facilitate displacement along the joint edge in the locked position and contribute to improving the functions of the material seal and the joint seal.

As is evident from FIG. 10*c*, the joint system can have one of more expansion spaces 53*a*, 53*b* where the joint seal 55 can swell when being pressed together. The joint seal 55 can thus be formed to have some excess, and if the joint system has been formed with appropriate expansion spaces 53*a*, 55*b*, the joint seal 55 can be formed with lower tolerance requirements and maintained function.

The material seal 20 in the upper joint edges has in this embodiment been made with a considerable depth from the core surface 33, which means that the entire area from the upper parts of the joint seal 55 to the core surface 33 is moisture-proof. In this embodiment, the major part of the joint edge portion between the tongue groove 9 and the core surface 33 will constitute a material seal 20.

Figure 11A:
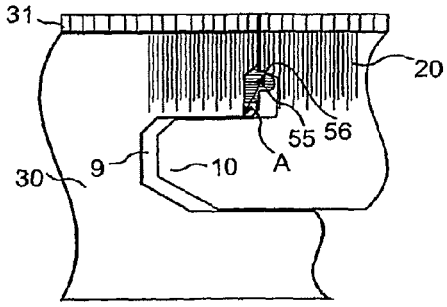
FIGS. 11*a-f* illustrate alternative embodiments of material and joint seals according to the invention.
Figure 11B:
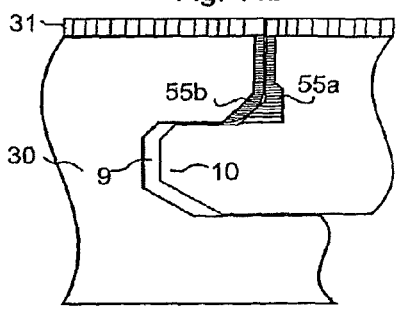
Figure 11C:
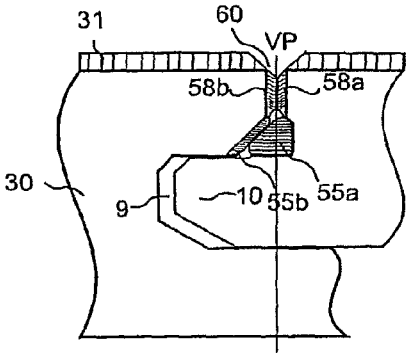

FIGS. 11*a*-11*c* illustrate different embodiments of the invention. FIG. 11*a* shows an embodiment according to the invention where the joint seal 55 has been formed to minimize edge rising and separation of the joint edges. The contact surface of the joint seal 55 with the opposite cooperating joint surface 56 has a small angle to the plane of the panel, which means that the major part of the compression force will be directed approximately vertically in the direction of the arrow A. The joint edge above the tongue, however, is rigid and the risk of edge rising is small.

In the embodiment in FIG. 11*b*, the elastically deformable joint seal 55*a*, 55*b* is arranged immediately under the surface layer 31, which surface layer thus covers the joint seal. The upper part of the seal 55*a*, 55*b* can constitute the material seal which prevents moisture from penetrating into the core 31, while the lower parts of the seal 55*a*, 55*b* can constitute the actual joint seal. The sealing 58*a*, 58*b* may also cover part of the surface layer 31, 32 closest to the core.

The embodiment according to FIG. 11*c* is characterized in that separate materials 58*a*, 58*b*, which can constitute a material seal, are arranged above the elastically deformable joints seals 55*a*, 55*b*. These separate materials 58*a*, 58*b* can also be used for the purpose of decoration by the surface layer 31, for instance, being a beveled portion 60, so that the separate materials 58*a*, 58*b* will be visible in the joint. Such a decorative material may also be applied in a grove formed in the core 30 and in the surface layer 31, 32 of the floorboard before the final machining of the edges of the floor panel.

The principles of sealing function also without the mechanical joint system if glue is applied between the tongue groove and the tongue 10.

Figure 11D:
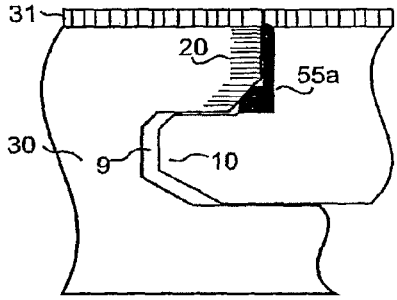
Figure 11E:
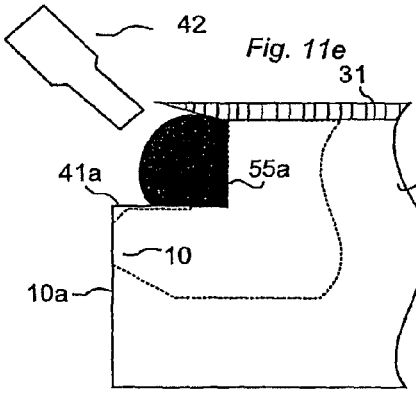
Figure 11F:
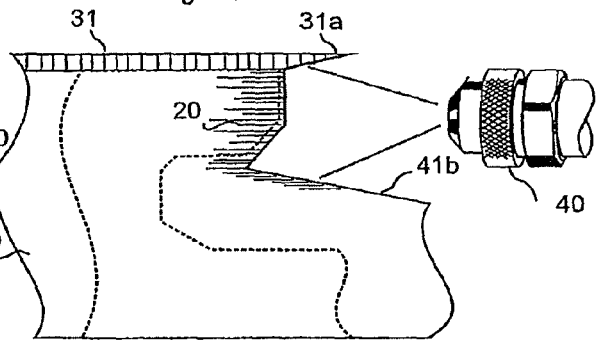

FIG. 11*d* shows an embodiment where one edge of a floor panel has a material seal 20 and the other edge a joint seal 55*a*. The joint seal covers the lower part of the surface layer 31. FIGS. 11*e* and 11*f* show how the sealing material 55*a* and 20 may be applied in groves 41*a* and 41*b*, which are made in the floor board. An advantage of the exemplary method is the sealing material may be applied with great accuracy. Furthermore, application on the surface may be avoided, a considerable amount of impregnation could be applied, and the locking system may be formed to its final shape with great accuracy in a second machining operation where a reference surface such as 10*a* may be used to position the floor board.

It is obvious that the application of a material seal and a joint seal could be combined in several ways. Both sides could, for example, have material seal and joint seal, or only join seal or material seal, etc. In this embodiment, a considerable amount of impregnating material 20 is to be found in the upper joint edge portions, immediately under the wear layer 31, i.e., within the area that is most critical in the viewpoint of moisture. This concentration of impregnating material immediately under the wear layer 31 is obtained as a result of the impregnating material being caused to penetrate into the core, from the groove 41*b* closest to the surface during impregnation. No protection of the surface closest to the final edge is necessary, since the surface is protected by the remaining part 31*a* of the surface layer and since a considerable amount of impregnation material could be applied. The core part which is closest to the surface could be impregnated to a horizontal depth of about 1 mm (0.039 inches) or more and the impregnation could be made with this depth over substantially the whole edge of the floor panel. The vertical concentration of impregnating material 20 under the wear layer 31 is higher at the joint surface than in the core. Naturally, the procedure above, which was described with reference to the upper surface 33 of the floor panel, may also be applied to the lower surface of the floor panel.

Figure 12A:
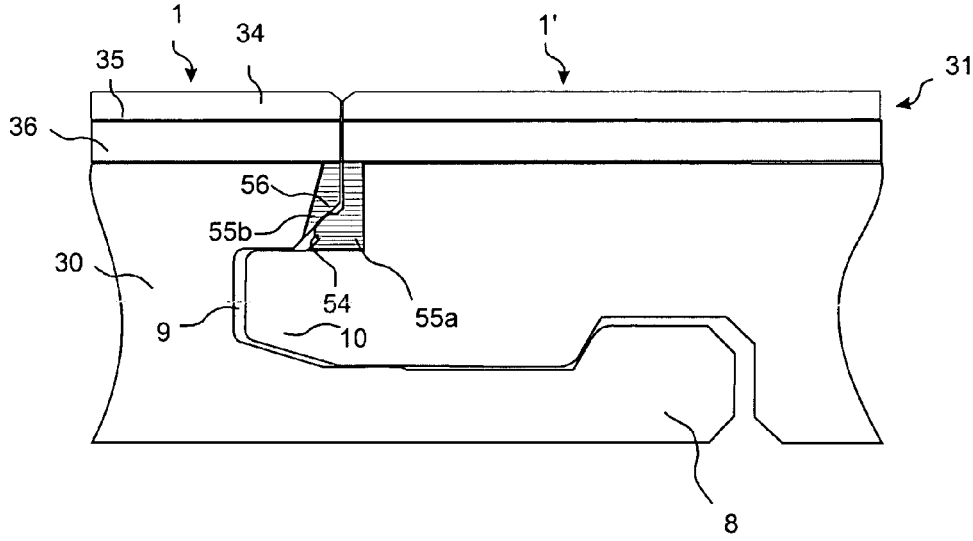
FIGS. 12*a-b* illustrate alternative embodiments of material and joint seals according to the invention.

FIG. 12*a* shows an embodiment according to the invention where the core 30 has been coated with three different surface layers having different functions. The surface of the floor panel 1, 1' comprises a transparent, hard and durable wear layer 34 of plastic material, an intermediate decorative layer 35 of plastic film and a reinforcement layer 36 which is made of an elastic material and which can be both moisture-proof and sound-absorbing. The decorative layer 35 of plastic film can be replaced with decorative patterns which are printed directly on the underside of the transparent wear layer 34 or on the upper side of the elastic reinforcement layer 36. This embodiment could also be produced without a seal and may then constitute a floating floor panel with a wood based core such as HDF/MDF, a resilient surface and a mechanical locking system for locking the floor panels horizontally and vertically at its long and short sides through angling and/or snapping. The seal could even in this embodiment be applied in a grove that is formed in the core and in the surface layer of the floor board.

The joint seal 55*a* on the tongue side has an active part 54 in the form of a convex bulge which presses against the opposite elastic cooperating joint surface 56. The active part 54 of the joint seal 55*a* has been made small, and this contributes to reducing the friction in connection with lateral displacement when the short sides of the floor panels are to be locked by snap action. Friction can also be reduced by the joint seals 55*a*, 55*b* being coated with different types of friction-reducing agents.

Figure 12B:
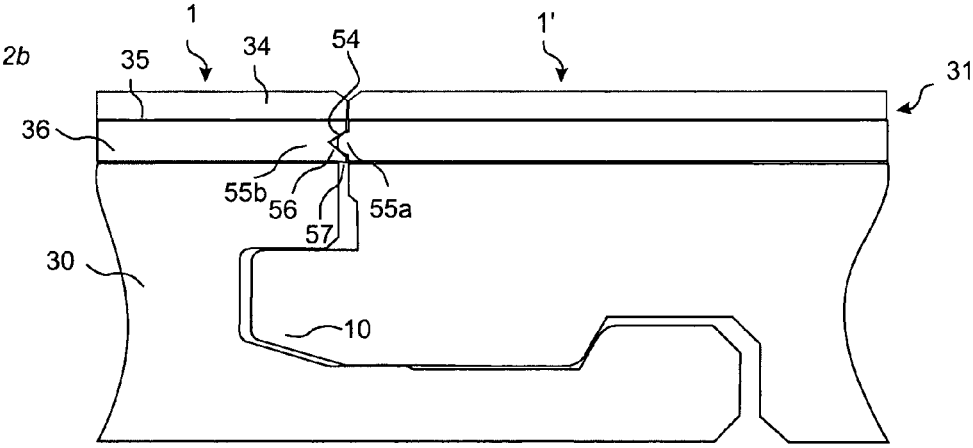

FIG. 12*b* shows an embodiment with the same surface layer 31 as in FIG. 12*a*, but the joint seals 55*a*, 55*b* have been formed in the elastic and deformable reinforcement layer 36 closest to the core 30. If the wear layer 34 is harder than the reinforcement layer 36, on the one hand the deformation of the joint seal 55*b* will take place in the lower part 57 of the joint seal closest to the core 30 and, on the other hand, no significant deformation of the wear layer 34 will take place. This can result in a moisture-proof and sound-absorbing floor. Also in this embodiment, the sealing means in the form of material seal and joint seal can be designed in many different ways as described above.

It is obvious that the above-described embodiments according to FIGS. 6-12 can be combined. For instance, the sealing means according to FIGS. 12*a* and 12*b* or 10*a* and 10*b* can be arranged in same joint system. The strip 6 can be made of aluminum etc.

Figure 13B:
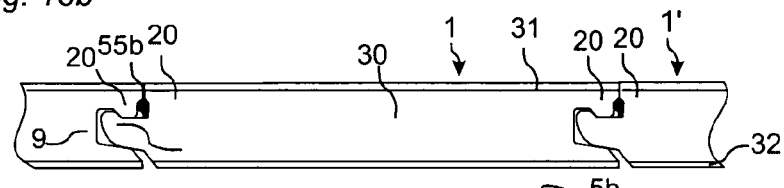
FIGS. 13*a-c* illustrate floor panels with a joint seal on two sides according to the invention.
Figure 13C:
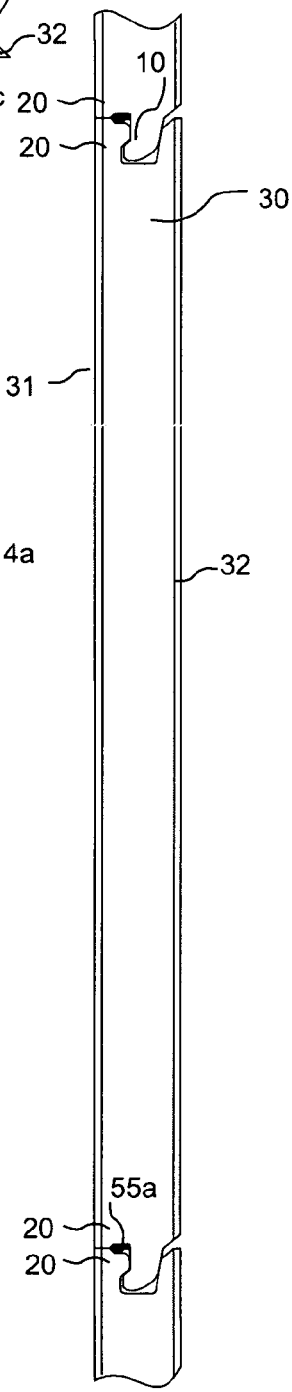
Figure 13A:
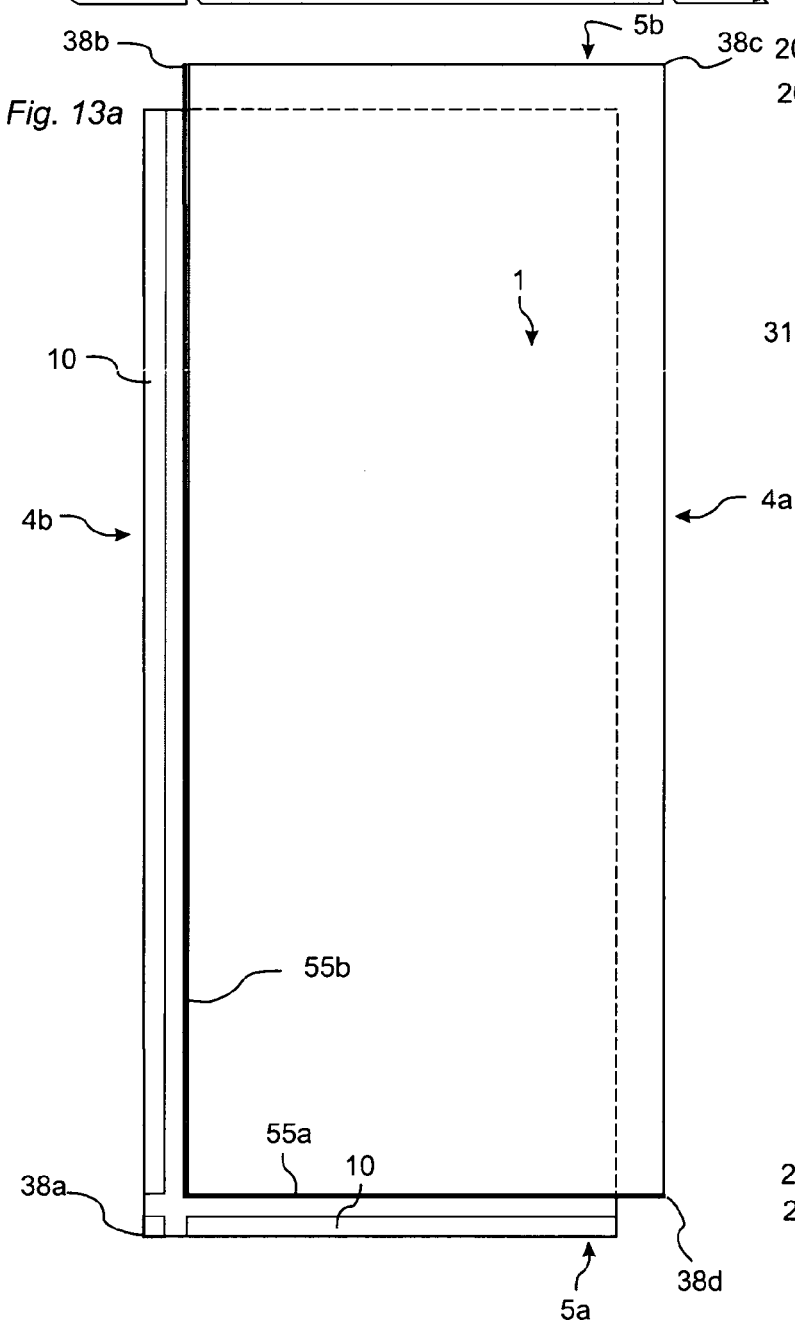

FIG. 13 shows a floor panel 1 with a mechanical joint system on the long sides 4*a*, 4*b* and on the short sides 5*a*, 5*b* and with a joint seal 55*a* and 55*b* on one short side 5*a* and one long side 4*b*. When the floor panel 1 is connected with other similar floor panels 1' on both long sides 4*a*, 4*b* and on both short sides 5*a*, 5*b* to form a floor, there will be a joint seal on all sides.

If, besides, the joint edges have a material seal 20 according to the embodiments described above, the joint system of the floor panels will counteract penetration of moisture into the joint system on all sides 4*a*, 4*b*, 5*a*, 5*b* and in all corner portions 38*a*, 38*b*, 38*c*, 38*d*.

Linear machining of long sides and short sides makes it possible to design the corner portions 38*a*, 38*b*, 38*c*, 38*d* with the same narrow tolerances as the sides 4*a*, 4*b*, 5*a*, 5*b* of the floor panels 1. The joint seal in the corners 38*a*, 38*b*, 38*c*, 38*d* can have an exact fit, and the angular displacements between the short sides 5*a*, 5*b* and the long sides 4*a*, 4*b* as well as the deviations from parallelism between the long sides 4*a*, 4*b* that may appear can be compensated for if it is ensured that the possibility of the joint seals 55*a*, 55*b* being deformed when the floor panels have been joined, can exceed these manufacturing tolerances.

Figure 14A:
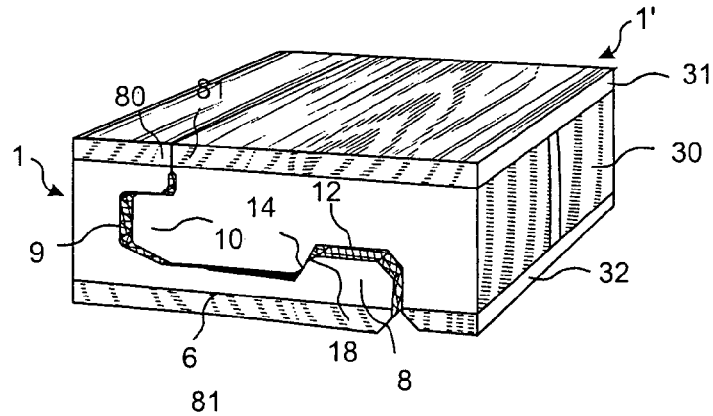
Fig. 14a PRIOR ART
FIGS. 14*a-e* illustrate mechanical locking systems, FIG. 14*a* illustrating prior-art technique and FIGS. 14*b-e* illustrating mechanical locking systems with a compensation seal in the form of an elastic locking means according to the invention.

FIG. 14*a* is a cross-sectional view of conventionally designed floor panels 1, 1', transversely of a joint along one long side of a wooden floor. The floor panels 1, 1' have a surface layer 31 of wood with a main direction of fibers parallel to the long side and a core 30 having a different direction of fibers approximately perpendicular to the long side. The longitudinal side edges of the floor panel 1, 1' have a mechanical joint system 9, 10, 6, 8, 12. In moist surroundings, the upper joint edge portions 80, 81 swell transversely of the direction of fibers (i.e. transversely of the joint between the neighboring floor panels 1, 1') more than does the core 30. This means that the floor panels 1, 1' along the long sides are pressed apart and that the strip 6 is bent backwards. This involves a risk of the upper joint edge portions 80, 81 or the cooperating locking surfaces 14, 18 being compressed or damaged. As the floor panels 1, 1' dry and shrink in winter (when the relative humidity falls), this may in turn result in a joint gap arising between the upper joint edge portions 80, 81.

FIGS. 14*b*-14*e* show how it is possible to compensate for this risk of joint gaps arising by utilizing according to the invention an elastic compensation seal 52 which is inserted into the horizontal locking means 6, 8, 12 for counteracting the effects of swelling and shrinking of the upper joint edge portions 80, 81.

Figure 14B:
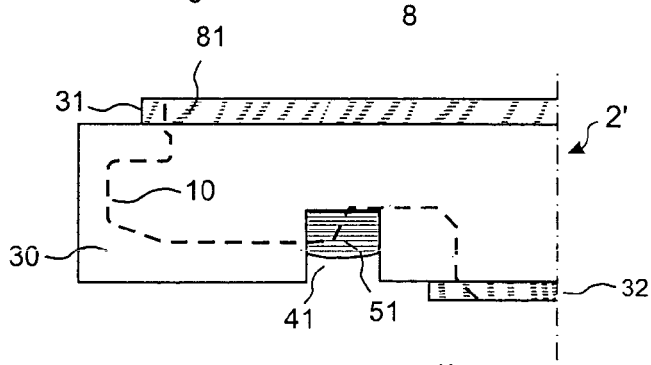

FIG. 14*b* shows an embodiment of a floorboard 2' which is suitable to form a joint system with a compensation seal according to the invention. The contour lines of the joint system to be have been indicated by dashed lines in FIG. 14*b*. The surface layer 31, the core 30 and the balancing layer 32 are laterally offset on both the tongue groove side 9 and the tongue side 10 to minimize the waste when machining the joint edges. In the underside of the floorboard 2 a groove 40 is formed in the core 30. An elastic material 51 is arranged and fixed in the groove 41 by, for instance, extrusion or the like according to the previously described methods or alternatively by gluing or mechanical fixing by, for instance, pressing material into a groove.

Figure 14C:
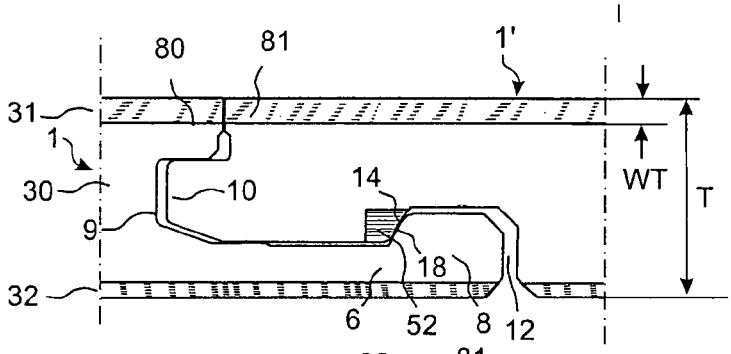

In the subsequent machining, the elastic material 51 is removed or reshaped only partially and is formed to an elastic compensation seal 52 which constitutes the active locking surface in the locking groove 12 and which is operative in the horizontal direction D2. This is illustrated in FIG. 14*c*.

As the joint edge portions 80, 81 swell, the elastic compensation seal 52 will be compressed by its locking surface 14 pressing against the locking surface 18 of the locking element 8. As a result, the mechanical looking system can compensate for the great movements due to moisture in the upper joint edge portions 80, 81 without the joint system being damaged or a visible joint gap appearing in winter when the floor has dried and shrunk.

The problem with the upper joint edges swelling will be greater if the thickness WT of the surface layer 31 is considerable and if this thickness is more than, for instance, 0.1 times the floor thickness T.

A joint system according to the above embodiment is especially suitable for use together with underfloor heating and in surroundings where the relative humidity varies significantly during the year. The elastic locking means or compensation seal 52 can be arranged optionally on the locking element 8 (as in FIG. 14*d*) or in the locking groove 12 (as in FIGS. 14*c* and 14*e*) or in both these parts, and it can be formed with many different geometries having different angles and radii which can facilitate inward angling and displacement. The elastic locking means or compensation seal 52 can also be combined with a material seal 20 and a joint seal 55 according to the previously described embodiments of the invention.

Figure 14D:
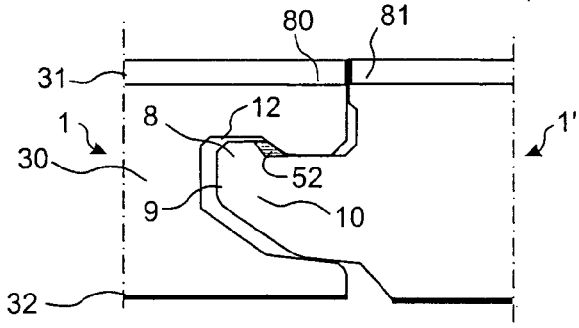

FIG. 14*d* illustrates an embodiment where the elastic locking means or compensation seal 52 also serves as a joint seal, sealing against moisture. In this case, the seal 52 will, when compressed, also take up the movements that are caused by swelling and shrinking of the upper joint edge portions 80, 81. The compression and, thus, sealing capacity of the elastic seal 52 can thus increase when the floor panels are located in moist surroundings. In this case, there is a material seal 20 which, however, has not been illustrated specifically in this Figure but which extends down to at least the upper parts of the connecting means in the same way as shown in, for instance, FIG. 7*d*.

Figure 14E:
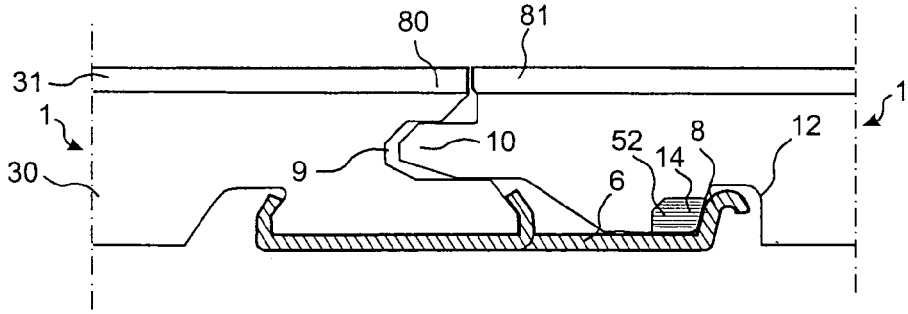

FIG. 14*e* illustrates an embodiment where the elastic compensation seal 52 is compressed by a locking element 8 which is made of a material other than that of the core 30. In this embodiment, the strip 6 and the locking element 8 can be made of aluminum or some other convenient metal. This construction has a flexibility which is greater than in the case where the strip 6 is formed integrally with the core of the floor panel. The invention can also be used in this embodiment. One of the advantages of this embodiment is that the friction is low during lateral displacement in the locked position.

FIGS. 15*a*-15*e* illustrate a embodiment of a joint system with a joint seal 55 which has been arranged in the groove 41 in the core 30 adjacent to the upper and inner part of the tongue 10 and which has been formed using a tool 70.

Figure 15A:
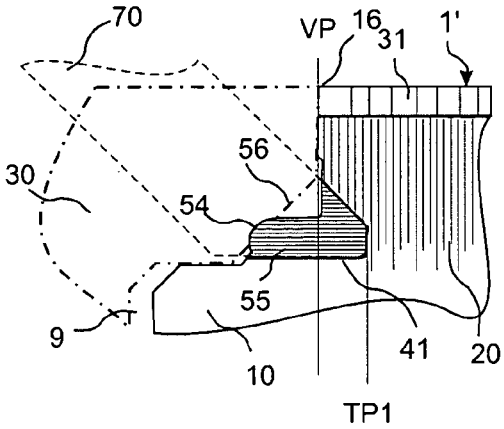
FIGS. 15*a-e* illustrate an embodiment of the invention.
Figure 15B:
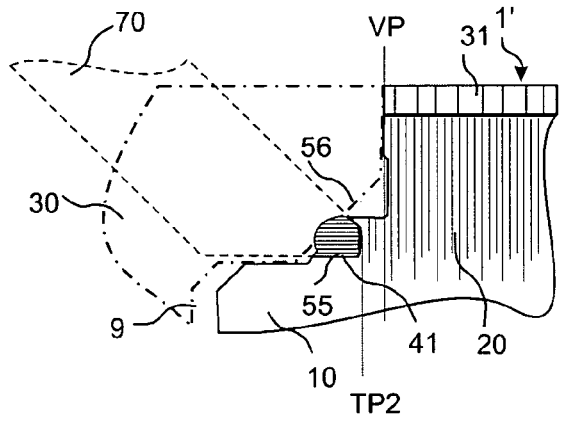

FIGS. 15*a* and 15*b* show the critical tolerance which lies in the position of the tool 70 when forming, for instance, a groove 41 in the core 30 or the board element relative to the vertical plane VP to be in the floor panel 1'. The innermost position of the tool 70 is defined by a plane TP1. FIG. 15*b* shows the outer position of the tool 70 which is defined by a plane TP2 outside the vertical plane VP. As is evident from these two Figures, the contact surfaces of the joint seal 55 for contact with the opposite cooperating joint portion 56 can be formed with great accuracy although the manufacturing tolerance TP1-TP2 for the horizontal positioning of the groove 41 relative to the joint edge to be at the vertical plane VP is fairly great and may exceed 0.2 times the floor thickness T. Using modern production equipment it is possible to manage a horizontal lateral positioning with these tolerances in the entire production chain from production of the surface layer 31 and the board element 3 to the completed floor panel 1'. The positioning of the tool 70 in the vertical direction is less critical since the tolerance mainly depends on the thickness tolerances of the materials and since these as a rule are small in relation to the tolerances in connection with the lateral positioning.

In this embodiment, it is also possible to use the core surface 33 or the surface of the surface layer 31 as reference surface. The groove 41 and the sealing material 50, which is then formed into the joint seal 55, can therefore be positioned with great accuracy in the vertical direction. The active contact surfaces of the joint system and the joint seal 55 can therefore be made with very narrow manufacturing tolerances, which may be below 0.01 times the floor thickness T although the original positioning of the sealing material 50 is effected with significantly lower tolerance requirements.

In an exemplary embodiment, the manufacturing tolerance between the active part 54 of the joint seal and the upper adjoining joint edges 16 can be significantly lower than the tolerance between another part of the joint seal which is not active, and the above-mentioned upper adjoining joint edge 16. This facilitates rational manufacture and enables high quality manufacture.

If the groove is formed in the core of the floor board and in the surface layer 31, 32, the outer part of the tongue 10 could be formed in the same machining step and this part of the tongue or some other parts of the floor board could be used as a reference surface when forming the locking system and the seal 55. In this case, the vertical and horizontal tolerances could be reduced to as little as 0.01 mm (0.0004 inches).

Figure 15C:
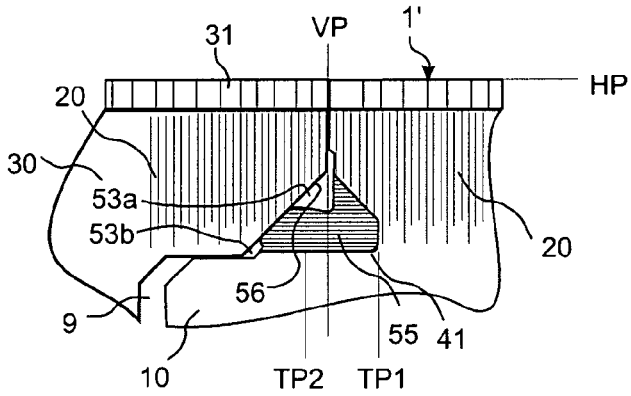

FIG. 15*c* shows the joint seal 55 in its compressed state with expansion spaces 53*a* and 53*b* on both sides of the joint seal.

Figure 15D:
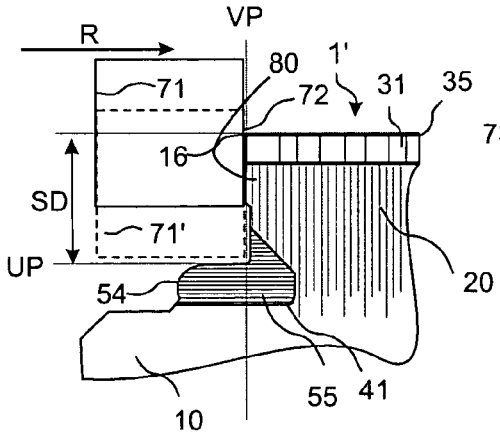
Figure 15E:
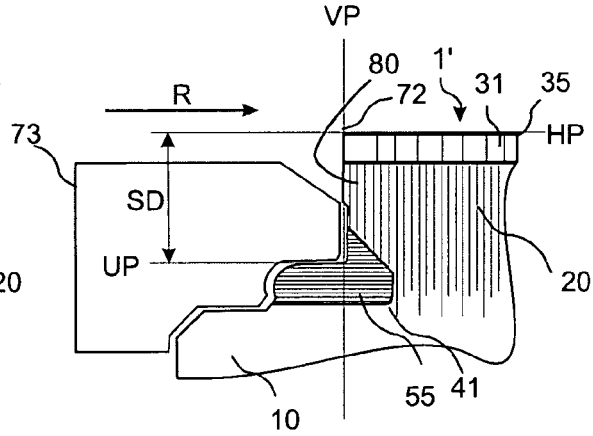

FIG. 15*d* shows how the joint seal 55 can be formed to facilitate machining of the surface layer 31 when this consists of a laminate. When machining the upper joint edge 80 using a diamond cutting tool 71 which operates horizontally, i.e., perpendicular to the vertical plane VP according to the arrow R, great wear arises at the point 72 on the diamond cutting tool that works on the laminate wear layer 35 which contains aluminum oxide. In order to utilize a greater part of the active surface of the diamond cutting tool, the tool is moved from its starting position 71, for example, step by step downwards in the direction of the tongue 10. The starting position of the tool is indicated by the position 71 and its end position by the position 71'. If the joint seal 55 is located adjacent to the upper and inner part of the tongue 10 in the shown groove 41 and if its upper boundary UP is located at a distance SD from the surface of the surface layer 31 that exceeds, for instance, 0.2 times the floor thickness T, it is possible to provide a joint seal 55 which is designed in such manner that the machining of the joint edge adjacent to and under the surface layer 31 can be facilitated. This form and location of the joint seal 55 at a distance from the surface layer 31 also makes it possible to form, by simple machining of the tongue 10 using the tool 73 (see FIG. 15*e*) and the opposite and cooperating joint portion 56 on the opposite joint edge, the locking system with radii and angles in a manner that facilitates a snapping-in and/or inward angling function of the locking system.

FIGS. 16*a*-16*e* show locking systems that have a plurality of horizontal locking means. These locking systems can be used in connection with moisture-proof locking systems but also merely as ordinary mechanical locking systems to provide a locking system with great horizontal strength. The basic principles can be used in locking systems which are joined by inward angling or snapping-in and using strips 6 which are optionally formed integrally with the core 30 or made of a separate material, such as aluminum, and then secured to the core.

Various combinations of the systems can be used on the long and short sides. The locking elements 8*a*, 8*b*, 8*c* and the locking grooves 12*a*, 12*b*, 12*c* can be made with different angles and radii of, for instance, wood, fiberboard-based materials, plastic materials and like panel materials with strips which are machined from the core or which consist of separate materials, and the locking elements can be designed for installation of the floor panels by angling or snapping-in.

Figure 16A:
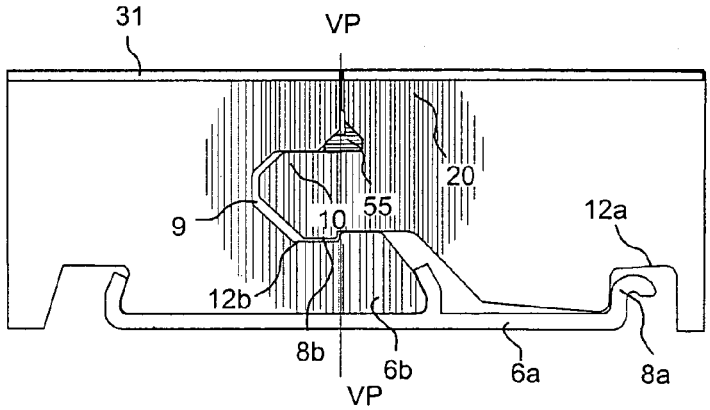
FIGS. 16*a-f* illustrate a joint system which is formed according to the invention and has high strength.

The locking system according to FIG. 16*a* has two strips 6*a* and 6*b*, two locking elements 8*a*, 8*b* and two locking grooves 12*a*, 12*b*. The locking element 8*a* and the locking groove 12*a* enable locking with great strength as well as good guiding in connection with, for example, inward angling. The locking element 8*b* results above all great in strength and can significantly increase the horizontal locking force. The locking element can be designed so as to be operative when the horizontal tensile force is so great that the upper joint edges begin to move apart, for instance when a joint gap of 0.05 mm (0.002 inches) or 0.10 mm (0.004 inches) arises.

Figure 16B:
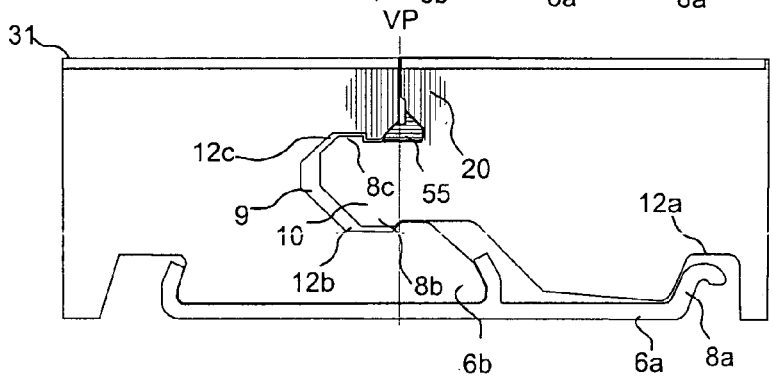

FIG. 16*b* illustrates a locking system with three horizontal locking means with the locking elements 8*a*, 8*b*, 8*c* and the locking grooves 12*a*, 12*b*, 12*c* which can be made according to these basic principles. This embodiment consists of a locking means with good guiding capacity 8*a*, 12*a*, and two locking means 8*b*, 12*b* and 8*c*, 12*c* which contribute to increasing the strength of the joint system in connection with horizontal tension load. This joint system can hold together the joint edges during compression of the joint seal 55. Several locking elements can be formed according to this method in the upper and lower parts of the tongue 10 and in the strip 6, and they can be adjusted to facilitate inward angling, snapping-in and guiding and to increase strength.

Figure 16C:
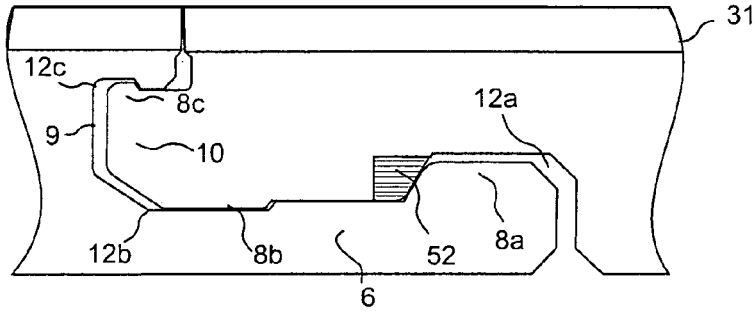

FIG. 16*c* illustrates that a separate locking means 8*b*, 12*b* and/or 8*c*, 12*c*, for example, can be used to limit separation in a joint system where parts of the locking groove 12*a* can consist of an elastic locking means 52.

The locking systems according to FIGS. 16*a* and 16*b* are mainly intended for snapping-in but they can be adjusted, with minor changes of the angles and radii of the locking system, so as to be easier to angle.

Figure 16D:
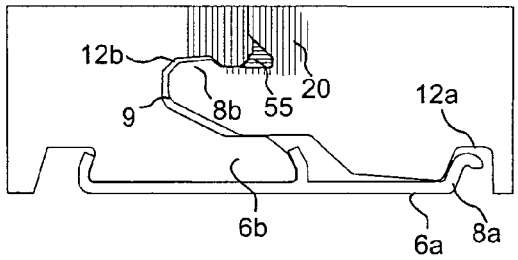

FIG. 16*d* shows a locking system with two horizontal locking means 8*a*, 12*a* and 8*b*, 12*b* which are convenient for, e.g., the long side which may be laid by inward angling.

Figure 16E:
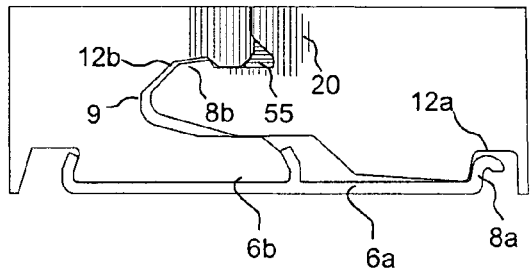

FIG. 16*e* illustrates a locking system for e.g. the short side which may be laid by snapping-in. The locking system according to FIG. 16*e* differs from that in FIG. 16*f* among other things by the locking element being smaller and having a greater inclination in relation to the surface layer, the strip 6*a* being longer and more flexible, the tongue groove 9 being deeper, and the upper locking element 8*b* having a locking surface which is more inclined in relation to the surface layer.

Figure 16F:
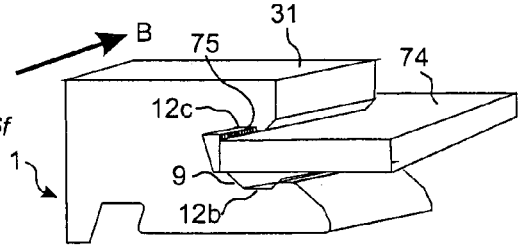

The locking grooves 12*b* and 12*c* can be made to have advanced forms by means of tools which need not necessarily rotate. FIG. 16*f* illustrates manufacture of the undercut groove 12*c* in a joint system according FIG. 16*b*. The panel can, according to prior-art technique in metal working, be moved past a stationary grooving tool 74 which in this embodiment has teeth 75 which operate perpendicular to the surface layer 31. When the floor panel 1 moves in the direction of the arrow B, the floor panel can pass the grooving tool 74 which is inserted into the tongue groove 9 and the teeth of which make the final forming of the undercut groove 12 with its locking surface. The major part of the tongue groove 9 is formed in a conventional manner using large rotating diamond cutting tools before the panel comes to such a position that the grooving tool 74 is operative. In this manner, geometric shapes can be formed in the same way as in extrusion of plastic or aluminum sections. This technique can also be used to form the groove 41 in the core where the sealing material is arranged.

FIGS. 17*a*-17*d* illustrate an enlargement of the corner portion 38*a* of the floor panel, which has previously been illustrated in FIG. 13, and show a joining of three floor panels 1, 1' and 1". Precisely the corner portions constitute one of the critical parts in a moisture-proof floor. To counteract penetration of moisture into the joint system through the corner, the joint seal 55*a*, 55*b* can be unbroken in at least one corner 38*a* according to FIG. 17*a*. Moreover, the joint seal in the corner 38*d* of the floor panel 1' can be positioned and formed in such manner that its active part 54 is not completely removed in connection with the machining of the different parts, specifically the tongue groove 9, of the joint system.

Figure 17A:
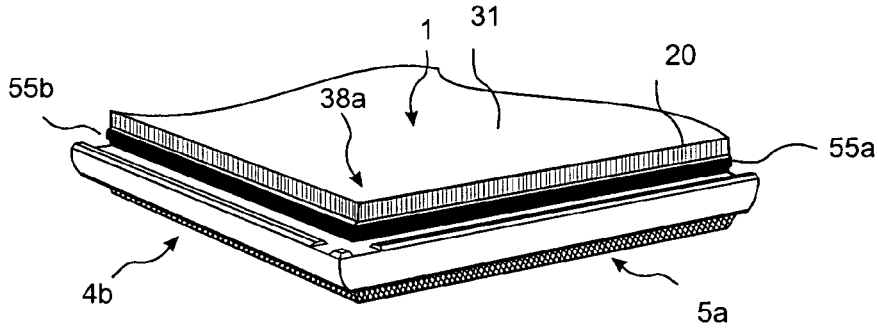
FIGS. 17*a-d* illustrate sealing of corner portions of neighboring floor panels.
Figure 17B:
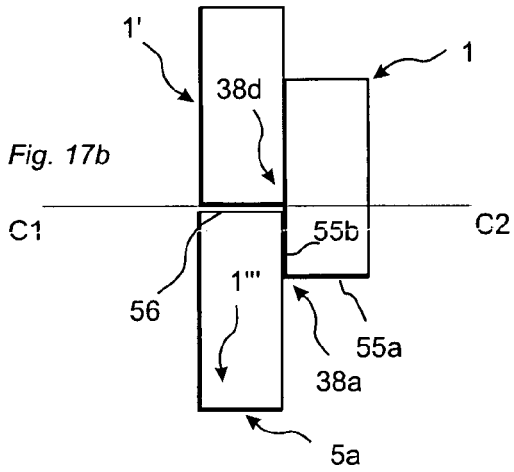
Figure 17C:
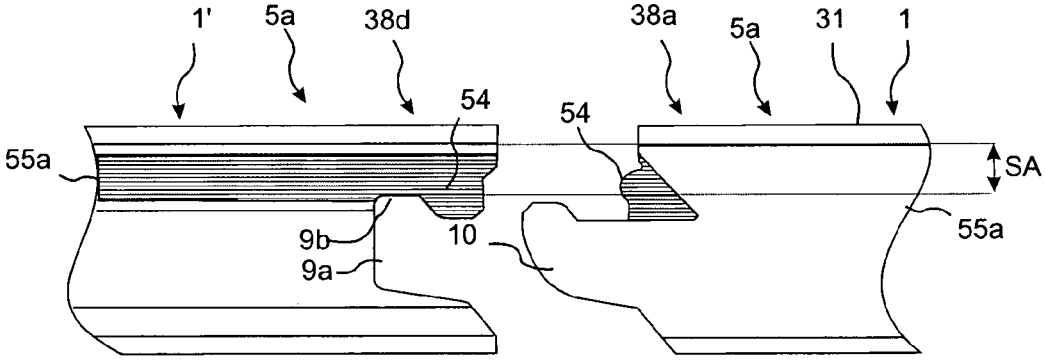
Figure 17D:
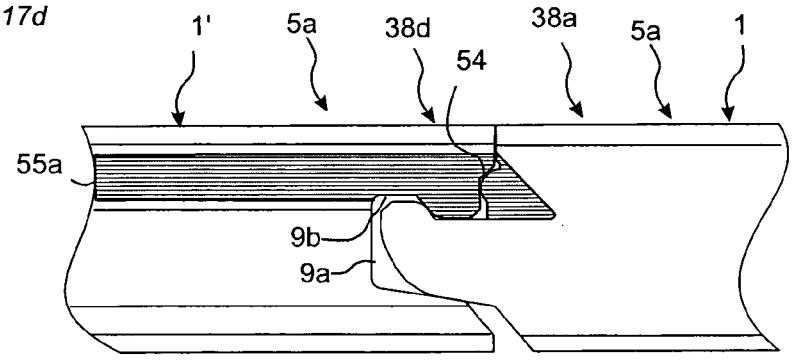

FIGS. 17*c* and 17*d* illustrate the joint system in a cross-sectional view along the line C1-C2 in FIG. 17*b*, i.e., the short side and the corner portion 38*a* of the panel 1' are shown in an end view whereas the panel 1 is shown in cross-section along this line C1-C2. In this embodiment, the active part 54 of the joint seal is intact in the panel 1' at the outer end of the upper lip of the tongue groove 9*b*. This is due to the fact that the active part 54 is placed in a plane SA which is positioned between the surface layer 31 and the upper part of the tongue groove which in this case is an undercut groove 9*b*. The active part 54 of the joint seal can thus in this plane be in contact with an opposite cooperating joint surface 56 of the third floor panel 1".

This embodiment makes the corner 38*a* have an area SA where the sealing material 55*a* is positioned in one or more planes and where the joint seal 55*a* is unbroken. There can thus be no gaps or hollows where moisture can penetrate from the surface and spread in the joint system. The exemplary embodiment of the floor panel has two corners 38*b*, 38*d* where the joint seals 55*a*, 55*b* are in unbroken contact with the opposite cooperating joint surface. The active part 54 of the joint seal 55 is thus continuous along one entire long side and one entire short side as well as in the corners between these long and short sides.

Hence, a system has been described, for forming a joint between two adjoining edges 4*a*, 4*b*; 5*a*, 5*b* of floor panels 1, 1' which have a fiberboard core 30 and a surface layer 31 applied to the upper side 53 of the core and consisting of at least one layer, and which at their adjoining joint edges 82, 83 have connecting means 9, 10 for joining the floor panels with each other in the vertical direction D1, the upper adjoining joint edges 16 of said floor panels 1, 1' meeting in a vertical joint plane VP. In the system, adjoining joint edge portions 80, 81 of the floor panels 1, 1' have a material seal 20 for counteracting penetration of moisture into the cores 30 of the floor panels from the joint edges 82, 83, said material seal 20 comprising an impregnation of the core 30 within said joint edge portions with a moisture-sealing agent and/or an agent counteracting or significantly reducing swelling caused by moisture, from the upper side 33 of the core 30 and at least a distance down towards the connecting means 9, 10.

In the system, the concentration of the moisture-sealing agent in the joint edge portion may be higher at the core surface 33 than at a distance therefrom.

In the system, the impregnation of the core 30 may extend down to a depth P2 which is at least 0.1 times the thickness T of the floor panel.

In the system, the impregnation of the core 30 may extend down to a depth P2 which corresponds to at least half the distance between the surface 33 of the core and the upper surfaces of the connecting means 9, 10.

In the system, the impregnation may extend down to at least upper parts of the connecting means 9, 10.

In the system, the impregnation may extend from the joint plane VP inwards in the core 30 a distance P1 which is at least 0.1 times the thickness of the floor panel.

In the system, the impregnation may extend from the joint plane VP inwards in the core 30 a distance P1 which corresponds to at least half the width of the connecting means 9, 10, seen from the joint plane.

In the system, the impregnation may extend from the joint plane VP inwards in the core 30 a distance P1 which corresponds to the width of approximately the entire connecting means 9, 10, seen from the joint plane.

In the system, the core 3 within at least its joint edge portions may be impregnated with a property-improving agent also from its underside.

In the system, the adjoining joint edges 82, 83 may also have connecting means 6, 8, 12 for joining the floor panels 1, 1' with each other in the horizontal direction HP perpendicular to the joint plane VP.

In the system, the core 30 within at least said joint edge portions may be impregnated with a property-improving agent also from its underside and at least a distance up towards the connecting means 9, 10, 6, 8, 12.

In the system, the impregnation may extend up to at least lower parts of the connecting means 6-10, 12, 14, 18.

In the system, the impregnating agent may be an agent improving the mechanical properties of the core 30.

In the system, the impregnating agent may be an agent improving the elasticity properties of the core 30.

In the system, the core 30 may be impregnated over less than half the distance between said opposite joint edge portions.

In the system, the core 13 may be impregnated within said joint edge portions within which at least parts of the connecting means 6-10, 12, 14, 18 are formed.

In the system, the connecting means 9, 10, 6, 8, 12 may be designed for mechanical joining of neighboring floor panels 1, 1" at a vertical joint plane VP both perpendicular to the same and perpendicular to the front side of the floor panel.

In the system, the floor panels 1, 1' may be quadrilateral and have all their opposite joint edge portions impregnated.

In the system, the entire core surface 33 at the joint edge portion of the corner portions 38*a-d* may be impregnated.

In the system, the floor panels 1, 1' may be quadrilateral and have mechanical joint systems 9, 10, 6, 8, 12 for vertical and horizontal joining on all sides.

In the system, the connecting means 9, 10, 6-8-12 may be designed for joining a floor panel 1 with a previously installed floor panel 1' by inward angling and/or snapping-in to a locked position.

In the system, the connecting means 9, 10, 6, 8, 12 may comprise a lower lip or locking strip 6 which may be formed integrally with the core and is included in the mechanical connecting means.

In the system, the lower lip or locking strip 6 is impregnated with an elasticity-improving agent.

In the system, the connecting means 9, 10, 6, 8, 12 may comprise an integrated locking strip 6 which is made of a material other than that of the core 30 and which is fixed to fixing elements 21*a*, 21*b* which are formed along one of the opposite parallel joint edge portions of each floor panel.

In the system, the fixing elements 21*a*, 21*b* made in the core 30 for the locking strip 6 may be impregnated with a property-improving agent.

In the system, the fixing elements 21*a*, 21*b* may be impregnated with a strength-increasing agent.

In the system, the connecting means 9, 10, 6, 8, 12 may be made by cutting.

In the system, the opposite joint edge portions 86, 87 of the floor panels 1, 1' may also have a joint seal 55 for counteracting penetration of moisture along the joint surfaces of the joint edges between neighboring floor panels when joined, and that this joint seal 55 is formed at the joint edge portions 86, 87 and is made of an elastic sealing material 50, 50*a*, 50*b*, which is secured in at least one of the floor panels 1, 1' and which is compressed, when neighboring floor panels are joined together.

In the system, the joint seal 55 may be formed of parts of the connecting means 9, 10, 6, 8, 12 and/or portions of the floor panel parts above and/or below the connecting means.

In the system, the joint seal 55 may be designed in such manner that the tolerance within a floor panel and/or between different floor panels is smaller between the active part and the upper adjoining joint edges 16 of the joint seal 55 than between another part of the joint seal 55 and said upper adjoining joint edges.

In the system, the joint seal 55 may be made of parts of the vertical connecting means 9, 10 and/or portions of the floor panel parts positioned above the vertical connecting means.

In the system, the joint seal 55 may be made by machining of the elastic sealing material 50, 50*a*, 50*b* in connection with the designing of one of the joint edges 82, 83.

In the system, the joint seal 55 may be made by machining of the elastic sealing material 50, 50*a*, 50*b* in connection with the designing of one of the vertical connecting means 9, 10.

In the system, the active part 54 of the joint seal 56 may be designed in such manner that the compression is begun approximately when the locking element 8 during inward angling comes into contact with the active locking surface of the locking groove 12.

In the system, the active part 54 of the joint seal 56 may be designed in such manner that the compression is begun approximately when the locking element 8*a* during snapping-in comes into contact with the active locking surface of the locking groove 12.

In the system, the floor panels may have a joint seal 56 with an active part 54 on a long side and a short side, and that this active part 54 is continuous and covers all these long sides and short sides as well as the corner portion between these long sides and short sides.

The system may further comprise an impact sound insulating layer 36 of plastic between the core 30 and the decorative and wear layer 34. Also, in the system, the free surface portions of the impact sound insulating layer 36 facing the joint VP may be designed by cutting in connection with the designing of the joint edge and are formed as joint sealing means 55*a*, 55*b* which are compressed when neighboring floor panels 1, 1' are joined together.

In the system, the joint sealing means 55, 55*a*, 55*b* may be formed with contact surfaces which are inclined to the upper side of the floor panels 1, 1' in the joined state.

The system may comprise more than one locking means 8*a*, 8*b*, 8*c* for horizontal joining of neighboring floor panels 1, 1'.

In the system, the locking means 8*a*, 8*b*, 8*c* for horizontal joining, one may be placed on one side of the vertical joint plane VP and another on the other side of the vertical joint plane VP.

In the system, the locking means 8*a*, 8*b*, 8*c* for horizontal joining may be arranged at different levels relative to the front side of the floor panels 1, 1'.

Furthermore, a floor panel has been described, which has a fiberboard core 30 and at least one surface layer 31 applied to the upper side of the core and which at least at two opposite parallel joint edge portions 86, 87 has connecting means 9, 10 for joining of the floorboard in the vertical direction D1 with similar floorboards. In the floorboard, the core 30 within at least said upper joint edge portions 80, 81 is impregnated with a property-improving agent all the way from its upper side 33 and at least a distance down towards the connecting means 9, 10.

In the floor panel, the concentration of the property-improving agent in the joint edge portion may be higher at the core surface 33 than at a distance therefrom.

In the floor panel, the impregnation may extend to a depth which is at least 0.1 times the thickness of the floor panel.

In the floor panel, the impregnation of the core 30 may extend down to a depth P2 corresponding to at least half the distance between the surface 33 of the core and the upper parts of the connecting means 9, 10.

In the floor panel, the impregnation may extend down to at least upper parts of the connecting means 9, 10.

In the floor panel, the impregnation may extend inwards from the joint plane VP in the core 30 a distance which is at least 0.1 times the thickness of the floor panel.

In the floor panel, the impregnation may extend inwards from the joint plane VP in the core 30 a distance corresponding to at least half the width of the connecting means 9, 10, seen from the joint plane VP.

In the floor panel, the impregnation extends inwards from the joint plane VP in the core 30 a distance P1 corresponding to at least half the width of the connecting means 9, 10, seen from the joint plane.

In the floor panel, the impregnation may extend down to at least upper parts of the connecting means 9, 10.

In the floor panel, the core 30 within at least said joint edge portions may be impregnated with a property-improving agent also from its underside and at least a distance up towards the connecting means 610, 12, 14, 18.

In the floor panel, the adjoining joint edges 82, 83 may also have connecting means 6, 8, 12 for joining the floor panel 1 in the horizontal direction HP with another similar floor panel 1' perpendicular to the joint plane VP.

In the floor panel, the impregnation may extend up to at least lower parts of the connecting means 6-10, 12, 14, 18.

In the floor panel, the impregnating agent is an agent improving the mechanical properties of the core 30.

In the floor panel, the impregnating agent may be an agent improving the elasticity properties of the core 30.

In the floor panel, the impregnating agent may be a moisture-sealing agent and/or an agent counteracting or significantly reducing swelling caused by moisture and intended to form a material sealing means 20.

In the floor panel, the core 30 may be impregnated over less than half the distance between said opposite joint edge portions.

In the floor panel, the core 30 may be impregnated within said joint edge portions, within which at least part of the connecting means 6-10, 12, 14, 18 are formed.

In the floor panel, the connecting means 6-10, 12, 14, 18 may be formed for mechanical joining of the floor panel 1 with a neighboring similar floor panel 1' at a vertical joint plane VP both perpendicular to the same and perpendicular to the front side of the floor panel.

The floor panel may be quadrilateral and have all its opposite joint edge portions impregnated.

In the floor panel, the connecting means 610, 12, 14, 18 may be formed for joining a floor panel 1 with a previously installed floor panel 1' by inward angling and/or snapping-in to a locked position.

In the floor panel, the connecting means 6-10, 12, 14, 18 may comprise a lower lip or locking strip 6 which is formed integrally with the core 30 and is included in the mechanical connecting means 6-10, 12, 14, 18.

In the floor panel, the lower lip or locking strip 6 may be impregnated with an elasticity-improving agent.

In the floor panel, the connecting means 610, 12, 14, 18 may comprise an integrated locking strip 6 which is made of a material other than that of the core 30 and which is fixed to fixing elements 21*a*, 21*b* which are formed along one of the opposite parallel joint edge portions of the floor panel.

In the floor panel, the fixing elements 21*a*, 21*b* formed in the core 30 and intended for the locking strip 6 may be impregnated with a property-improving agent.

In the floor panel, the fixing elements 21*a*, 21*b* may be impregnated with a strength-increasing agent.

In the floor panel, the connecting means 6-10, 12, 14, 18 may be made by cutting.

In the floor panel, parts of the connecting means 6-10, 12, 14, 18 and/or adjoining portions of the core 30 within the upper parts of the joint edge portions may be made of an elastic sealing material 50, 50*a*, 50*b*, which is secured in the core 30 and designed by machining in connection with the designing of the connecting means 6-10, 12, 14, 18 and which is made to form a joint sealing means 55, 55*a*, 55*b* for counteracting penetration of moisture between neighboring joined floor panels 1, 1'.

In the floor panel, the joint seal 55 may be made of parts of the connecting means 9, 10, 6, 8, 12 and/or portions of the floor panel parts positioned above and/or below the connecting means.

In the floor panel, the joint seal 55 may be designed in such manner that the tolerance within a floor panel and/or between different floor panels is smaller between the active part of the joint seal 55 and upper adjoining joint edges 16 than between another part of the joint seal 55 and said upper adjoining joint edges.

In the floor panel, the joint seal 55 may be made of parts of the vertical connecting means 9, 10 and/or portions of the floor panel parts positioned above the vertical connecting means.

In the floor panel, the joint seal 55 may be made by machining of the elastic sealing material 50, 50*a*, 50*b* in connection with the designing of one of the joint edges 82, 83.

In the floor panel, the joint seal 55 may be made by machining of the elastic sealing material 50, 50*a*, 50*b* in connection with the designing of one of the vertical connecting means 9, 10.

In the floor panel, the active part 54 of the joint seal 56 may be designed in such manner that the compression is begun approximately when the locking element 8, during inward angling, comes into contact with the active locking surface of the locking groove 12 when the floor panel is joined with a similar floor panel.

In the floor panel, the active part 54 of the joint seal 56 may be designed in such manner that the compression is begun approximately when the locking element 8, during snapping-in, comes into contact with the active locking surface of the locking groove 12 when the floor panel is joined with a similar floor panel.

In the floor panel, there may be a joint seal 156 with an active part 54 on a long side and a short side and that this active part 54 is continuous and covers the entire long sides and short sides as well as the corner portion between said long sides and short sides.

The floor panel, may comprise an impact sound insulating layer 36 of plastic between the core 30 and the decorative and wear layer 34. In that floor panel, the free surface portions of the impact sound insulating layer 36 facing the joint VP may be designed by cutting in connection with the designing of the connecting means 6-10, 12, 14, 18 and be made as joint sealing means 55*a*, 55*b* which are compressed, when neighboring floor panels 1, 1' are joined together.

Also described is a method of making a fiberboard core 30 which is intended for production of floorboards 2 or board elements 3 to be divided into floorboards 2 which have opposite joint edge portions 86, 87. The fiberboard core 30 in the exemplary method is impregnated with at least one property-improving agent within defined band-shaped areas 44 which comprise joint edge portions 86, 87 to be of the floorboards 2.

In the method, the impregnation of the wood-based panel may take place from its front side to be.

In the method, the impregnation may be carried out in such manner that the concentration of the property-improving agent in the joint edge portion is higher at the core surface 33 of the core than at a distance from the core surface.

In the method, the impregnation of the wood-based panel may take place from its rear side to be.

In the method, the impregnation may be carried out to a depth corresponding to at least 0.1 times the panel thickness T.

In the method, the impregnation may be carried out at least to such a depth that parts of the connecting means 9, 10 to be of the floor panels will be impregnated.

In the method, the impregnation may be carried out by applying a liquid impregnating agent over the band-shaped areas 44.

In the method, the impregnation may take place with an agent improving the mechanical properties of the core 30.

In the method, the impregnation may take place with an agent improving the elasticity properties of the core 30.

In the method, the impregnation may take place with a moisture-sealing agent.

In the method, the impregnation may take place with a swelling-reducing agent.

In the method, the core 30 may be impregnated over less than half the distance between said opposite joint edge portions.

In the method, grooves 41 may be formed in the panel within the band-shaped areas 44 to a depth on a level with the connecting means 6-10, 12, 14, 18 to be of the floorboards, and an elastic sealing material may be inserted in said grooves.

In the method, the elastic sealing material may be cast in said grooves 41.

There is also described a method of producing a floorboard 2 or a floorboard element 3 which is intended to be divided into floorboards, which have opposite joint edge portions 86, 87, in which method a fiberboard core 30 is coated with a surface layer 31 on its front side and preferably also a balancing layer 32 on its rear side. Before the coating with the surface layer 31 and a possible balancing layer 32, the fiberboard core 30 is impregnated with at least one property-improving agent within defined band-shaped areas 44 comprising joint edge portions 86, 87 to be of the floorboards.

In the method, the impregnation of the wood-based panel 30 may take place from its upper side to be.

In the method, the impregnation of the wood-based panel 30 may take place from its underside to be.

In the method, the impregnation may be carried out at least to such a depth that parts of connecting means 9, 10, 6-8-12 to be of the floorboards will be impregnated.

In the method, the impregnation may be carried out by applying a liquid impregnating agent over the band-shaped areas 44.

In the method, the impregnation may take place with an agent improving the mechanical properties of the core 30.

In the method, the impregnation may take place with an agent improving the elasticity properties of the core 30.

In the method, the impregnation may take place with a moisture-sealing agent and/or an agent counteracting or significantly reducing swelling caused by moisture.

In the method, the core 30 may be impregnated over less than half the distance between said opposite joint edge portions.

In the method, grooves 41 may be formed in the panel 30 within the band-shaped areas 44 to a depth on a level with the connecting means 9, 10 to be of the floorboards and an elastic sealing material 50, 50*a*, 50*b* may be inserted into said grooves.

There is also described a floorboard which is intended as semi-manufacture for producing a floor panel 1 and which has a fiberboard core 30 and a surface layer 31 applied to the upper side 33 of the core and which has at least two opposite parallel joint edge portions 86, 87 which are intended for cutting to form connecting means 9, 10 of the floor panel. The core 30 within at least said joint edge portions 86, 87 is impregnated with a property-improving agent all the way from its upper side 33 and at least a distance down towards the connecting means 9, 10.

In the floorboard, the concentration of the moisture-sealing agent in the joint edge portion may be higher at the core surface 33 than at a distance therefrom.

In the floorboard, the impregnation may extend to a depth which is at least 0.1 times the thickness of the floorboard.

In the floorboard, the impregnation of the core 30 may extend to a depth P2 which corresponds to at least half the distance between the surface 33 of the core and the upper surfaces of the connecting means 9, 10.

In the floorboard, the impregnation may extend down to at least upper parts of the connecting means 6-10, 12, 14, 18 to be.

In the floorboard, the core 30 within at least said joint edge portions may be impregnated with a property-improving agent also from its underside and at least a distance up towards the connecting means 6-10, 12, 14, 18.

In the floorboard, the impregnation may extend up to at least lower parts of the connecting means 6-10, 12, 14, 18.

In the floorboard, the impregnating agent may be an agent improving the mechanical properties of the core 30.

In the floorboard, the impregnating agent may be an agent improving the elasticity properties of the core 30.

In the floorboard, the impregnating agent may be a moisture-sealing agent and/or an agent counteracting or significantly reducing swelling caused by moisture.

In the floorboard, the core 30 may be impregnated over less than half the distance between said opposite joint edge portions.

In the floorboard, the core 30 may be impregnated within said joint edge portions, within which at least parts of the connecting means 6-10, 12, 14, 18 of the floor panel are to be formed.

The floorboard may be quadrilateral and have all its opposite joint edge portions impregnated.

In the floorboard, the joint edge portions on the upper side of the floorboard may be impregnated with a moisture-sealing agent and/or an agent counteracting or significantly reducing swelling caused by moisture.

In the floorboard, the joint edge portions on the underside of the floorboard may be impregnated with a strength-increasing agent.

In the floorboard, the joint edge portions on the underside of the floorboard may be impregnated with an elasticity-improving agent.

The floorboard may comprise an elastically deformable sealing material 54, which is secured in the core in such positions thereof as, in machining the floorboard to a floor panel, will form parts of the connecting means 6-10, 12, 14, 18 of the floor panel and/or adjoining portions of the core 30 of the floor panel within the upper parts of the joint edge portions.

In the floorboard, the elastic joint sealing material 56 may be secured in the core 30 within areas which are intended to form a long side and a short side of a floor panel to be and which are continuous along the entire long sides and short sides as well as a corner portion between said long sides and short sides.

The floorboard may comprise an impact sound insulating layer 36 of plastic between the core 30 and the decorative and wear layer 34.

According to this embodiment, a system is provided for forming a joint between two adjoining edges of floor panels which have a fiberboard core and a surface layer applied to the upper side of the core and consisting of at least one layer, and which adjacent to their adjoining joint edge portions have connecting means for joining the floor panels with each other in the vertical direction and which meet in a vertical joint plane. According to this aspect of the invention, the adjoining joints edge portions of the floor panels have a material seal for counteracting penetration of moisture into the cores of the floor panels from the joint plane. This material seal comprises an impregnation of the core within said joint edge portions with a moisture-sealing agent and/or an agent counteracting or significantly reducing swelling caused by moisture all the way from the upper side of the core and at least a distance down towards the connecting means.

This impregnation may extend to a depth which is at least 0.1 times the thickness of the floor panel, seen from the upper side of the core. More preferably, the impregnation extends down to at least upper parts of the connecting means of the floor panels. The extent of the impregnation seen from the joint plane and inwards in the core is preferably also at least 0.1 times the thickness of the floor panel. More preferably, the impregnation, seen from the joint plane, extends a distance corresponding to at least half the width of the connecting means.

It is also preferred for the core to be impregnated from its underside and at least a distance up towards the connecting means. The impregnation of the underside of the core can be effected using a property-improving agent, especially an agent which improves the mechanical properties of the core.

In some connecting systems, it is possible to choose to improve the strength and elasticity properties of the core for the core to better satisfy its function as starting material for mechanical connecting means.

Through this embodiment, the properties of the core are obtained within those parts of the floor panels which are most exposed to influence, i.e., the edge portions. This causes great economic advantages since the impregnation of the core has been limited to precisely the portions that need be improved so as to obtain a floor having the desired properties as regards resistance to the influence of penetrating moisture. The impregnation of the core therefore preferably takes place to less than half the distance between the opposite edges of the core. The impregnation is restricted to those parts of the edge portions within which at least parts of the connecting means are formed.

As mentioned above, the embodiment is particularly usable in connection with systems which are based on mechanical joining of neighboring floor panels, i.e., systems where the mechanical locking means join the floor panels at a vertical joint plane both perpendicular thereto and perpendicular to the front side of the floor panels. The connecting means can particularly advantageously be designed for joining a floor panel with a previously installed floor panel by inward angling and/or snapping-in to a locked position.

When utilizing the embodiment for floor panels with mechanical locking means, the connecting means may comprise a lower lip or locking strip which is formed integrally with the core. In such a case, it is particularly advantageous, as mentioned above, to impregnate the lower parts of the core with a property-improving agent, especially an elasticity-improving agent, so that this lower lip or locking strip obtains optimal properties for its intended function. Within the scope of the invention, however, such a locking strip can also be made of a different material, for instance aluminum, and in that case the parts of the core which form the attachment for the separate locking strip can advantageously be impregnated with such a property-improving agent in order to further increase the core's capability of retaining the attached locking strip.

According to this embodiment, the problem of providing a material seal has thus been solved by the core, and thus not the completed joint edge, being impregnated in the areas where the joint system will later be formed. The impregnating agent can be caused to penetrate so that the upper part of the core closest to the front side will be impregnated in an area where the joint edge will later be formed. Then the core is coated with a surface layer on its front side and preferably also a balancing layer on its rear side. The board element or the floorboard will thus contain parts where the core under the surface layer is impregnated. The board element is sawn, where appropriate, into floorboards having edge portions within which the core under the surface layer is impregnated. The edges of the floorboards are then machined and the completed floor panels will have upper joint edge portions which are impregnated.

An impregnating agent can be applied to the surface of the core and/or in the parts of the core under the surface using methods which do not require the impregnation to take place from the joint edge of the machined joint systems.

The main advantage of a joint system made according to this manufacturing method is that the impregnating agent can be applied without actually requiring tolerances. A further advantage is that the production line in the manufacture of board elements may have a high capacity although the impregnation is carried out at a relatively low speed since the impregnation takes place in connection with the production of the large board elements which are later divided into a plurality of floorboards, and not in connection with the individual edge machining of the floorboards. The impregnating material can also be allowed to penetrate into the core during a relatively long time.

Further advantages are that the method allows impregnating material to be applied directly under the surface layer in areas adjacent to the completed joint edge, i.e., in the upper joint edge portion, and to have a significantly greater extent horizontally from the joint edge towards the floor panel compared with what can be achieved by impregnation from the joint edge of the floor panel after this has been machined for making the connecting means. A further advantage is that all corners will have joint edge portions that are impregnated. Since the joint is formed after impregnation, any swelling in connection with the impregnation will not affect the joint geometry, nor will there be any impregnating residues on the joint surfaces or on the surface layer closest to the joint edge.

One more advantage is that the impregnating result can be checked by measuring the swelling of the core, the board element or the floorboard in portions where the joint edge will be made and in another, not impregnated, part of the panel at a distance from this joint edge, for instance closest to the central part of the floor panel to be.

The impregnating result can be ensured before the final machining of the floor panels is made and this can result in a higher capacity and a considerable saving in costs in the form of a smaller amount of rejects.

This method of providing a material seal is suitable for all fiberboard-based core materials such as homogeneous wood, plywood consisting of a plurality of veneer layers, materials consisting of wood blocks glued together, fiberboard of the type HDF and MDF, particle board, flake board (OSB) and the like. The method can also be used in other core materials which, for instance, do not contain wood fibers and which do not swell when exposed to moisture but where the intention above all is to obtain impregnation of certain parts with a view to providing an edge reinforcement.

In principle, impregnating materials available on the market can be used which contribute to increasing the protection against moisture in wood or fiberboard-based materials. However, it should preferably be possible to apply them in liquid form, and they should have such properties as to allow surface layers to be applied to the core using such prior-art application methods as gluing, direct lamination, varnishing, calendaring or coating of plastic films or the like by extrusion, optionally in connection with grinding or application of primer layers and the like with a view to improving adhesion. As non-restrictive examples of usable impregnating materials, polyurethane, phenol and melamine can be mentioned.

The impregnating liquid can be applied in different ways, for example, by spraying. Other methods, which are very difficult to use in the systems that are used today for impregnating machined joint edges of a completed floor panel, such as rolling, spreading, injecting and the like, function in an excellent fashion in connection with the present invention. The penetration of impregnating agent into the core can be facilitated by applying heat, vacuum, pressure or the like, optionally in combination with, e.g., grinding of the surface of the core before application of the impregnating agent. Grinding of the impregnated core can also take place before applying the surface layer so as thus to remove any swollen surface parts before applying the surface layer. Vacuum and grinding of surface parts cannot be used when impregnation is carried out from the joint edge, and several of the methods described above are also considerably more difficult to use when impregnating from the joint edge.

It is also possible to make grooves in the core in areas that will later constitute joint portions of the floor panel. The impregnating agent can then be applied both from the surface of the core and from the edges of the groove. Different layers having different properties can also be applied. Rolling or spreading is particularly advantageous in the cases where the impregnating agent contains substances which are not environment-friendly such as polyurethane (PUR) with isocyanate. When rolling on the impregnating agent, it is possible to use, within valid limits, up to 10 times more isocyanate than if application takes place by spraying.

The impregnating method can also be used to reinforce the edge. Various chemicals, such as those mentioned above, can be supplied in liquid form which after curing or solidification reinforce the wood fibers and give the joint edge a higher compression, shearing or impact strength or elasticity. The preferred method is particularly suitable to provide a moisture-proof but also strong joint edge with the aid of e.g. thermosetting plastics such as melamine or phenol which as a rule require both heat and pressure to cure. Direct lamination of the surface layer in fact takes place at a high temperature and under high pressure, and in connection with this operation also the impregnating layer can be cured. Hot-gluing of surface layers can also cause curing or drying. This method can be used in combination with moisture impregnation.

Different layers can also be produced by, for instance, a two-step impregnation where the first impregnating step is made with an agent that penetrates deep under the surface of the core and gives increased protection against moisture, while the second impregnating step is carried out with an agent which, for instance, has a different viscosity or other curing properties and which results in a strong joint edge immediately under the surface layer. In this way, for instance direct-laminated floor panels can be produced which have reinforced joint edge portions, whose properties can be equivalent to or better than the considerably more expensive laminate floors which have a surface layer of high pressure laminate.

The embodiment above is intended to be used in order to change the properties of the core by adding different materials before application of the surface layer in those parts of the core which will constitute the joint edge portions of the floor panel.

While the present invention has been described by reference to the above-mentioned embodiments, certain modifications and variations will be evident to those of ordinary skill in the art. Therefore, the present invention is to be limited only by the scope and spirit of the appended claims.

What is claimed is:

1. A floor panel comprising:

a body having a wood fiber-based core; and a locking system comprising a tongue, a tongue groove, a locking element and a locking groove, the locking system at least at two opposite parallel joint edge portions of the floor panel for mechanical joining of the floor panel in the horizontal direction with similar floor panels, and the locking element including a first side surface and a second side surface, the first side surface facing toward the floor panel, and a second side surface facing away from the floor panel, wherein said locking groove is located within the core, wherein the locking system is designed for joining of the floor panel with a previously installed floor panel by inward angling and/or snapping in, the locking system having a first set of active locking surfaces, one of the active locking surfaces on the locking groove and the other on the first side surface of the locking element, and a second set of active locking surfaces above the tongue, the first and second sets of active locking surfaces for engaging with corresponding first and second active locking surfaces of the similar floor panels after the floor panel has been joined therewith to lock the floor panels together horizontally, wherein a portion of the active locking surface of the first set locking groove or a portion of one of the active locking surfaces of the second set comprises a recess having therein an elastically compressible material other than that of the body of the floor panel, wherein the elastically compressible material is arranged in the recess so the elastically compressible material directly contacts a corresponding active locking surface of a set of active locking surfaces so that when there is horizontal swelling of an upper region of the joint edge portions the elastically compressible material compresses in the horizontal direction to counteract the effect of the horizontal swelling of the upper region of the joint edge portions.

2. The floor panel as claimed in claim 1, further comprising a surface layer of wood, wherein the wood fiber-based core is a wood or fiberboard material and the direction of fibers in the surface layer is different from that in the core.

3. The floor panel as claimed in claim 2, wherein the locking system is designed for joining of the floor panel with a previously installed floor panel by both inward angling and snapping-in to a locked position.

4. The floor panel as claimed in claim 1, wherein the locking system comprises a lower lip or a locking strip which is made integrally with the core.

5. The floor panel as claimed in claim 1, wherein the panel is rectangular with long and short sides and wherein the locking system is provided on both a long side and a short side of the floor panel.

6. The floor panel as claimed in claim 1, wherein the elastically compressible material is a polymeric material.

7. The floor panel as claimed in claim 1, wherein the elastically compressible material is made of a material based on acrylic plastic, elastomers of synthetic rubber, urethane rubber, silicone rubber or a polyurethane-based hot-melt adhesive.

8. The floor panel as claimed in claim 1, wherein the elastically compressible material is an elastic sealing material.

9. The floor panel as claimed in claim 1, wherein the locking system comprises a lower lip or a locking strip.

10. The floor panel as claimed in claim 9, wherein the tongue and the tongue groove are made integrally with the core such that the floor panel is locked in a vertical direction after the floor panel has been joined with a previously installed floor panel.

11. The floor panel as claimed in claim 1, wherein a portion of the active locking surface of the locking groove comprises a recess having therein an elastically compressible material other than that of the body of the floor panel.

12. The floor panel as claimed in claim 1, wherein a portion of one of the active locking surfaces of the second set comprises a recess having therein an elastically compressible material other than that of the body of the floor panel.

13. A floor panel comprising:

a body having a wood fiber-based core; and a locking system comprising a tongue, a tongue groove, a locking element and a locking groove, the locking system at least at two opposite parallel joint edge portions of the floor panel for mechanical joining of the floor panel in the horizontal direction with similar floor panels, and the locking element including a first side surface and a second side surface, the first side surface facing toward the floor panel, and a second side surface facing away from the floor panel, wherein said locking groove is located within the core, wherein the locking system is designed for joining of the floor panel with a previously installed floor panel by inward angling, the locking system having a first set of active locking surfaces, one of the active locking surfaces on the locking groove and the other on the first side surface of the locking element, and a second set of active locking surfaces above the tongue, the first and second sets of active locking surfaces for engaging with corresponding first and second active locking surfaces of the similar floor panels after the floor panel has been joined therewith to lock the floor panels together horizontally, wherein a portion of the active locking surface of the locking groove or a portion of one of the active locking surfaces of the second set comprises a recess having therein an elastically compressible material other than that of the body of the floor panel, wherein the elastically compressible material is positioned in the recess so the elastically compressible material directly contacts a corresponding active locking surface of a set of active locking surfaces so that when horizontal swelling occurs at an upper region of the joint edge portions the elastically compressible material compresses in the horizontal direction and counteracts the effect of the horizontal swelling of the upper region of the joint edge portions.

14. The floor panel as claimed in claim 13, wherein a portion of the active locking surface of the locking groove comprises a recess having therein an elastically compressible material other than that of the body of the floor panel.

15. The floor panel as claimed in claim 13, wherein a portion of one of the active locking surfaces of the second set comprises a recess having therein an elastically compressible material other than that of the body of the floor panel.

16. A floor panel comprising:

a body having a wood fiber-based core; and a locking system comprising a tongue, a tongue groove, a locking element and a locking groove, the locking system at least at two opposite parallel joint edge portions of the floor panel for mechanical joining of the floor panel in the horizontal direction with similar floor panels, and the locking element including a first side surface and a second side surface, the first side surface facing toward the floor panel, and a second side surface facing away from the floor panel, wherein said locking groove is located within the core, and wherein the locking groove is located between an upper edge portion and a lower edge portion, wherein the upper edge portion is shorter in length than the lower edge portion, wherein the locking system is designed for joining of the floor panel with a previously installed floor panel by inward angling and/or snapping in, the locking system having a first set of active locking surfaces, one of the active locking surfaces on the locking groove and the other on the first side surface of the locking element, and a second set of active locking surfaces above the tongue, the first and second sets of active locking surfaces for engaging with corresponding first and second active locking surfaces of the similar floor panels after the floor panel has been joined therewith to lock the floor panels together horizontally, wherein a portion of the active locking surface of the locking groove or a portion of one of the active locking surfaces of the second set comprises a recess having therein an elastically compressible material other than that of the body of the floor panel, wherein the elastically compressible material is positioned in the recess so the elastically compressible material directly contacts a corresponding active locking surface of a set of active locking surfaces so that when horizontal swelling occurs at an upper region of the joint edge portions the elastically compressible material compresses in the horizontal direction and counteracts the effect of the horizontal swelling of the upper region of the joint edge portions.

17. The floor panel as claimed in claim 16, wherein a portion of the active locking surface of the locking groove comprises a recess having therein an elastically compressible material other than that of the body of the floor panel.

18. The floor panel as claimed in claim 16, wherein a portion of one of the active locking surfaces of the second set comprises a recess having therein an elastically compressible material other than that of the body of the floor panel.

19. A floor panel comprising:

a body having a wood fiber-based core; and a locking system comprising a tongue, a tongue groove, a locking element and a locking groove, the locking system at least at two opposite parallel joint edge portions of the floor panel for mechanical joining of the floor panel in the horizontal direction with similar floor panels, and the locking element including a first side surface and a second side surface, the first side surface facing toward the floor panel, and a second side surface facing away from the floor panel, wherein the locking system is designed for joining of the floor panel with a previously installed floor panel, the locking system having a first set of active locking surfaces, one of the active locking surfaces on the locking groove and the other on the first side surface of the locking element and a second set of active locking surfaces above the tongue, the first and second sets of active locking surfaces for engaging with corresponding first and second active locking surfaces of the similar floor panels after the floor panel has been joined therewith to lock the floor panels together horizontally, wherein a portion of the active locking surface of the locking groove or a portion of one of the active locking surfaces of the second set comprises a recess having therein an elastically deformable material, other than that of the body of the floor panel, wherein the elastically deformable material is positioned in the recess so the elastically compressible material directly contacts a corresponding active locking surface of a set of active locking surfaces, and is an acrylic plastic-based material, an elastomer of synthetic rubber, a urethane rubber, a silicone rubber, or a poly-urethane-based hot-melt adhesive.

20. The floor panel as claimed in claim 19, wherein a portion of the active locking surface of the locking groove comprises a recess having therein an elastically compressible material other than that of the body of the floor panel.

21. The floor panel as claimed in claim 19, wherein a portion of one of the active locking surfaces of the second set comprises a recess having therein an elastically compressible material other than that of the body of the floor panel.

* * * * *